US011559999B2

(12) United States Patent
Mizutani

(10) Patent No.: US 11,559,999 B2
(45) Date of Patent: Jan. 24, 2023

(54) PRINTER CAPABLE OF PERFORMING BACKWARD CONVEYANCE

(71) Applicant: Brother Kogyo Kabushiki Kaisha, Nagoya (JP)

(72) Inventor: Hiromitsu Mizutani, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 792 days.

(21) Appl. No.: 16/233,502

(22) Filed: Dec. 27, 2018

(65) Prior Publication Data

US 2019/0299657 A1 Oct. 3, 2019

(30) Foreign Application Priority Data

Mar. 30, 2018 (JP) ..... JP2018-066374

(51) Int. Cl.
*B41J 11/42* (2006.01)
*B65H 29/20* (2006.01)
(Continued)

(52) U.S. Cl.
CPC ..... *B41J 11/42* (2013.01); *B41J 11/703* (2013.01); *B65H 29/20* (2013.01); *B41J 3/4075* (2013.01);
(Continued)

(58) Field of Classification Search
None
See application file for complete search history.

(56) References Cited

U.S. PATENT DOCUMENTS 5,462,265 A * 10/1995 Mandel ..... B65H 31/36 414/789.9
6,078,345 A * 6/2000 Yamakawa ..... B41J 11/005 347/218
(Continued)

FOREIGN PATENT DOCUMENTS

CN 1672946 A 9/2005
CN 101096153 A 1/2008
(Continued)

OTHER PUBLICATIONS

Feb. 9, 2021—(JP) Notice of Reasons for Refusal—App 2018-066374, Eng Tran.
(Continued)

*Primary Examiner* — Jill E Culler
(74) *Attorney, Agent, or Firm* — Banner & Witcoff, Ltd.

(57) ABSTRACT

A printer includes: a conveyor that performs a forward-conveyance operation for conveying a printing medium downstream in a conveying direction and a backward-conveyance operation for conveying the printing medium upstream in the conveying direction; a printing device; a roller provided downstream of the conveyor in the conveying direction; an opposed member opposed to the roller; a moving mechanism that moves a moving member, which is one of the roller and the opposed member, between (i) a first position at which the printing medium is nipped between the moving member and the other of the roller and the opposed member and (ii) a second position at which the moving member is separated from the printing medium; and a controller that executes a first conveyor-backward-conveyance processing for controlling the conveyor to perform the backward-conveyance operation in a state in which the moving member is located at the second position.

12 Claims, 34 Drawing Sheets

(51) Int. Cl.

| | |
|---|---|
| ***B41J 11/70*** | (2006.01) |
| *B41J 3/407* | (2006.01) |
| *B41J 3/46* | (2006.01) |
| *B65H 35/04* | (2006.01) |
| *B41J 13/00* | (2006.01) |
| *B41J 11/00* | (2006.01) |
| *B65H 5/06* | (2006.01) |
| *B65H 35/00* | (2006.01) |

(52) U.S. Cl.
CPC ..... *B41J 3/46* (2013.01); *B41J 11/006* (2013.01); *B41J 13/0018* (2013.01); *B65H 5/06* (2013.01); *B65H 35/0066* (2013.01); *B65H 35/04* (2013.01); *B65H 2404/1441* (2013.01)

(56) References Cited

U.S. PATENT DOCUMENTS

| | | | | |
|---|---|---|---|---|
| 7,315,317 | B2 * | 1/2008 | Kitamura | B41J 11/42 347/171 |
| 7,674,056 | B2 * | 3/2010 | Shaw | B41J 29/38 400/637 |
| 2005/0212890 | A1 | 9/2005 | Kitamura et al. | |
| 2012/0048079 | A1 | 3/2012 | Mitsuhashi et al. | |
| 2013/0001860 | A1 | 1/2013 | Oshiro et al. | |
| 2015/0174926 | A1 * | 6/2015 | Kosuge | B41J 11/703 347/104 |
| 2015/0217580 | A1 | 8/2015 | Yamamoto et al. | |

FOREIGN PATENT DOCUMENTS

| | | | | |
|---|---|---|---|---|
| CN | 102849481 | A | | 1/2013 |
| CN | 104816552 | A | | 8/2015 |
| JP | 2008049677 | A | | 3/2008 |
| JP | 2011-101948 | A | | 5/2011 |
| JP | 2012-046299 | A | | 3/2012 |
| JP | 2013060265 | A | * | 4/2013 |
| JP | 2017-128009 | A | | 7/2017 |

OTHER PUBLICATIONS

Dec. 31, 2021—(CN) The First Office Action—CN App 201910237319.9, Eng Tran.
Jul. 8, 2022—(CN) Second Office Action—CN App 201910237319.9, Eng Tran.
Nov. 21, 2022—(CN) Third Office Action—CN App 201910237319.9, Eng Tran.

* cited by examiner

FIG.24

30

| ROTATION-AMOUNT DETERMINATION TABLE | |
|---|---|
| TYPE OF TAPE | BEFORE-CUTTING ROTATION AMOUNT OF OUTPUT ROLLER |
| RECEPTOR TAPE | LARGE |
| DIE CUT TAPE | ZERO |
| THERMAL TAPE | LARGE |
| STENCIL TAPE | SMALL |
| LAMINATE TAPE | MEDIUM |
| ⋮ | ⋮ |

PRINTER CAPABLE OF PERFORMING BACKWARD CONVEYANCE

CROSS REFERENCE TO RELATED APPLICATION

The present application claims priority from Japanese Patent Application No. 2018-066374, which was filed on Mar. 30, 2018, the disclosure of which is herein incorporated by reference in its entirety.

BACKGROUND

The following disclosure relates to a printer.

There are known printers configured to perform printing on a printing medium being conveyed. For example, there is known a recording apparatus configured to control a conveying device to convey a sheet, and control a recording head to perform printing on the sheet being conveyed. A first roller and a second roller are provided downstream of the recording head in a conveying direction in which the sheet is conveyed. The recording apparatus conveys the sheet in a state in which the sheet is nipped between the first roller and the second roller.

SUMMARY

It is considered that the above-described recording apparatus performs leading-end positioning of the sheet before printing, for example. In the leading-end positioning, the recording apparatus controls the conveying device to convey the sheet upstream in the conveying direction and position a leading end of the sheet. In the case where the sheet is conveyed upstream in the conveying direction, if the sheet is being nipped by the first roller and the second roller, there is a possibility of damage to the sheet.

Accordingly, an aspect of the disclosure relates to a printer capable of reducing damage to a printing medium in the case where the printing medium is conveyed upstream in the conveying direction.

In one aspect of the disclosure, a printer includes: a conveyor configured to perform a forward-conveyance operation in which the conveyor conveys a printing medium downstream in a conveying direction, the conveyor being configured to perform a backward-conveyance operation in which the conveyor conveys the printing medium upstream in the conveying direction; a printing device configured to print an image on the printing medium conveyed by the conveyor; a roller provided downstream of the conveyor in the conveying direction; an opposed member opposed to the roller; a moving mechanism configured to move a moving member, which is one of the roller and the opposed member, between (i) a first position at which the printing medium is nipped between the moving member and the other of the roller and the opposed member and (ii) a second position at which the moving member is separated from the printing medium; and a controller configured to execute a first conveyor-backward-conveyance processing in which the controller controls the conveyor to perform the backward-conveyance operation in a state in which the moving member is located at the second position.

In another aspect of the disclosure, a printer includes: a conveyor configured to perform a forward-conveyance operation in which the conveyor conveys a printing medium downstream in a conveying direction, the conveyor being configured to perform a backward-conveyance operation in which the conveyor conveys the printing medium upstream in the conveying direction; a printing device configured to print an image on the printing medium conveyed by the conveyor; a roller provided downstream of the conveyor in the conveying direction; an opposed member opposed to the roller; an adjusting mechanism configured to adjust a nip load at which the printing medium is nipped between the roller and the opposed member, selectively to one of at least a first load and a second load that is less than the first load; and a controller configured to execute a second conveyor-backward-conveyance processing in which the controller controls the conveyor to perform the backward-conveyance operation in a state in which the nip load is the second load.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which:

FIG. 24 is a conceptual view of a rotation-amount determination table;

DETAILED DESCRIPTION OF THE EMBODIMENT

Figure 1:
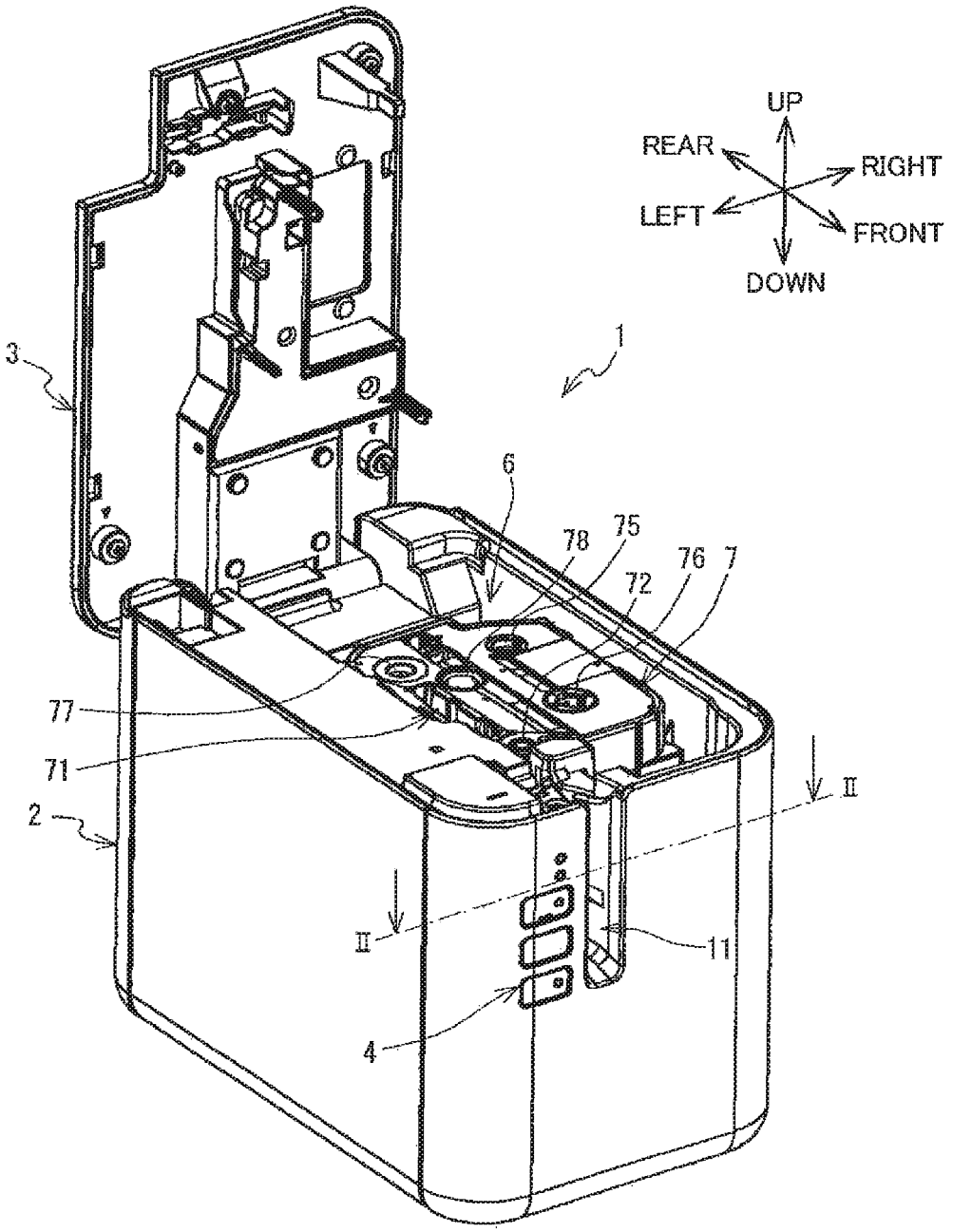
FIG. 1 is a perspective view of a printer viewed from an upper front left side thereof.

Hereinafter, there will be described one embodiment by reference to the drawings. The drawings are for explanation of technical features employable in the present disclosure. It is to be understood that the configuration illustrated in the drawings does not limit the present disclosure and is only one example. It is further noted that teeth of gears are not illustrated in the drawings for simplicity.

Figure 2:
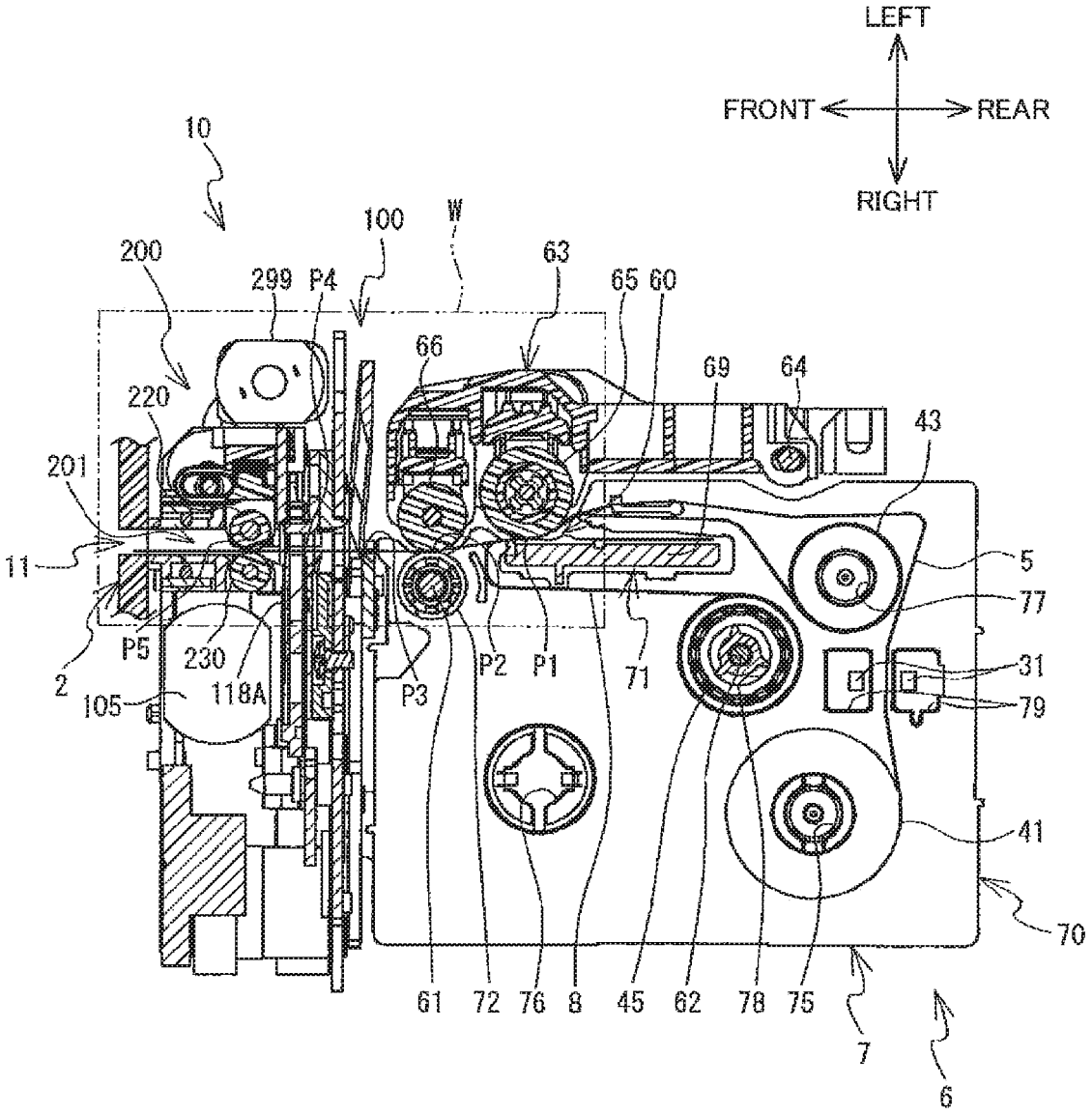
FIG. 2 is a cross-sectional view taken along line II-II in FIGS. 1 and 13 and viewed in the direction indicated by the arrows.

There will be described a configuration of a printer 1 with reference to FIGS. 1 and 2. The lower left side, the upper right side, the lower right side, the upper left side, the upper side, and the lower side in FIG. 1 are defined respectively as the left side, the right side, the front side, the rear side, the upper side, and the lower side of the printer 1. The printer 1 is a general-type printer capable of using cassettes of various types such as a receptor type, a thermal type, and a laminate type. FIG. 2 schematically illustrates a cassette 7 of a receptor type. Hereinafter, various kinds of elongated printing media storable in a cassette (e.g., a receptor tape 5, a die cut tape 9, a thermal tape, a stencil tape, a double-sided adhesive tape, and a transparent film tape) will be collectively referred to as "tape". The printer 1 is connectable to external terminals, not illustrated, via any of a network and a cable, not illustrated, for example. Examples of the external terminals include a personal computer and a smartphone. For example, the printer 1 prints characters on the tape based on print data transmitted from the external terminal. Examples of the characters include letters, numbers, signs, and figures.

As illustrated in FIG. 1, the printer 1 includes a housing 2 and a cover 3. The housing 2 has a substantially rectangular parallelepiped shape. The cover 3 is pivotably supported by a rear end portion of an upper surface of the housing 2 and opened and closed with respect to the upper surface of the housing 2. An input interface 4 is provided at an upper left corner portion of a front surface of the housing 2. The input interface 4 includes buttons for inputting various kinds of information to the printer 1. An output opening 11 is formed in the front surface of the housing 2 at a position located to the right of the input interface 4. The output opening 11 extends in the up and down direction and communicates with the inside and the outside of the housing 2. The upper surface of the housing 2 has a mount portion 6. The mount portion 6 is recessed downward from the upper surface of the housing 2. The cassette 7 is removably mountable in the mount portion 6.

As illustrated in FIG. 2, the mount portion 6 is provided with a thermal head 60, a tape driving shaft 61, a ribbon take-up shaft 62, and a mark detecting sensor 31. The thermal head 60 is provided on a left surface of a head holder 69 and includes a plurality of heating elements arranged in the up and down direction. The head holder 69 is shaped like a plate provided on a left portion of the mount portion 6 and extending in a direction orthogonal to the right and left direction. The tape driving shaft 61 is rotatably disposed in front of the head holder 69 so as to extend in the up and down direction. The ribbon take-up shaft 62 is rotatably disposed to the right of the head holder 69 and extends in the up and down direction. The mark detecting sensor 31 is a photo sensor of a transmission type which detects the marks 99 (see FIG. 3) provided on the die cut tape 9 which will be described below.

A platen holder 63 is provided to the left of the mount portion 6. A rear end portion of the platen holder 63 is rotatably supported by a shaft 64. The shaft 64 extends in the up and down direction. The platen holder 63 supports a platen roller 65 and a conveying roller 66 rotatably in the clockwise direction and the counterclockwise direction in plan view, respectively. The platen roller 65 is disposed to the left of and opposed to the thermal head 60. The conveying roller 66 is provided in front of the platen roller 65 and to the left of the tape driving shaft 61. The conveying roller 66 is opposed to the tape driving shaft 61. The platen holder 63 pivots about the shaft 64 such that a front end portion of the platen holder 63 moves substantially in the right and left direction. This movement moves each of the platen roller 65 and the conveying roller 66 between a position (see FIG. 2) at which each of the platen roller 65 and the conveying roller 66 is located near a corresponding one of the thermal head 60 and the tape driving shaft 61 and a position, not illustrated, at which each of the platen roller 65 and the conveying roller 66 is located far from the corresponding one of the thermal head 60 and the tape driving shaft 61.

The tape driving shaft 61, the ribbon take-up shaft 62, the platen roller 65, and the conveying roller 66 are coupled to a conveying motor 68 (see FIG. 18) via gears, not illustrated. The conveying motor 68 is driven so as to be rotated in any of a forward-conveyance direction and a backward-conveyance direction. The forward-conveyance direction and the backward-conveyance direction are rotational directions reverse to each other.

An internal unit 10 is provided in the housing 2 at a position near a rear portion of the output opening 11. The internal unit 10 includes a cutting unit 100 and an output unit 200. The cutting unit 100 performs a cutting operation of cutting at least a portion of the tape in the thickness direction, along the widthwise direction. The output unit 200 holds the tape to be cut by the cutting unit 100 and discharges the tape cut by the cutting unit 100, from the output opening 11 to the outside of the printer 1. The cutting unit 100 and the output unit 200 will be described later in detail.

There will be next described the cassette 7 with reference to FIG. 2. The cassette 7 includes a casing 70. The casing 70 is shaped like a box and includes a tape driving roller 72 and support holes 75-78. The tape driving roller 72 is a cylindrical member disposed at a front left corner portion of the casing 70 so as to extend in the up and down direction. The tape driving roller 72 is rotatably supported by the casing 70. A left end portion of the tape driving roller 72 is exposed from the casing 70 to the outside.

The support hole 75 is formed through the casing 70 in the up and down direction. The support hole 75 supports a first tape spool 41 such that the first tape spool 41 is rotatable. The first tape spool 41 extends in the up and down direction. A first tape is wound around the first tape spool 41. The support hole 77 is formed through the casing 70 in the up and down direction. The support hole 77 supports a ribbon spool 43 such that the ribbon spool 43 is rotatable. The ribbon spool 43 extends in the up and down direction. An ink ribbon 8 having not yet been used for printing is wound around the ribbon spool 43. The support hole 78 is formed through the casing 70 in the up and down direction. The support hole 78 supports a ribbon take-up spool 45 such that the ribbon take-up spool 45 is rotatable. The ribbon take-up spool 45 is a cylindrical member extending in the up and down direction. The ink ribbon 8 having already been used for printing is taken up and wound around the ribbon take-up spool 45. The support hole 76 is formed through the casing 70 in the up and down direction. The support hole 76 supports a second tape spool, not illustrated, such that the second tape spool is rotatable. The second tape spool extends in the up and down direction. The second tape is wound around the second tape spool.

The casing 70 has a head opening 71 and a pair of holes 79. The head opening 71 is formed through a left portion of the casing 70 in the up and down direction. The tape is exposed at a front left portion of the head opening 71. The holes 79 are formed through the casing 70 in the up and down direction and opposed to each other in a state in which the tape drawn from the first tape spool 41 is interposed between the holes 79.

The type of the tape contained in the casing 70 and/or the presence or absence of the ink ribbon 8 may be changed, for example. Thus, the cassette 7 may be of any of the thermal type, the receptor type, the laminate type, and the tube type, for example.

In the case of the cassette 7 of the receptor type, the support hole 75 supports the first tape spool 41 around which the receptor tape 5 or the die cut tape 9 as the first tape is wound. In the case of the cassette 7 of the receptor type, the second tape cannot be used, and accordingly the support hole 76 does not support the second tape spool. The support hole 77 supports the ribbon spool 43.

In the case of the cassette of the thermal type, not illustrated, the support hole 75 supports the first tape spool 41 around which the thermal tape or the stencil tape as the first tape is wound. The support hole 76 does not support the second tape. The support hole 77 does not support the ribbon spool 43.

In the case of the cassette of the laminate type, not illustrated, the support hole 75 supports the first tape spool 41 around which the transparent film tape as the first tape is wound. The support hole 76 supports the second tape spool around which the double-sided adhesive tape as the second tape is wound. The support hole 77 supports the ribbon spool 43.

Figure 3A:
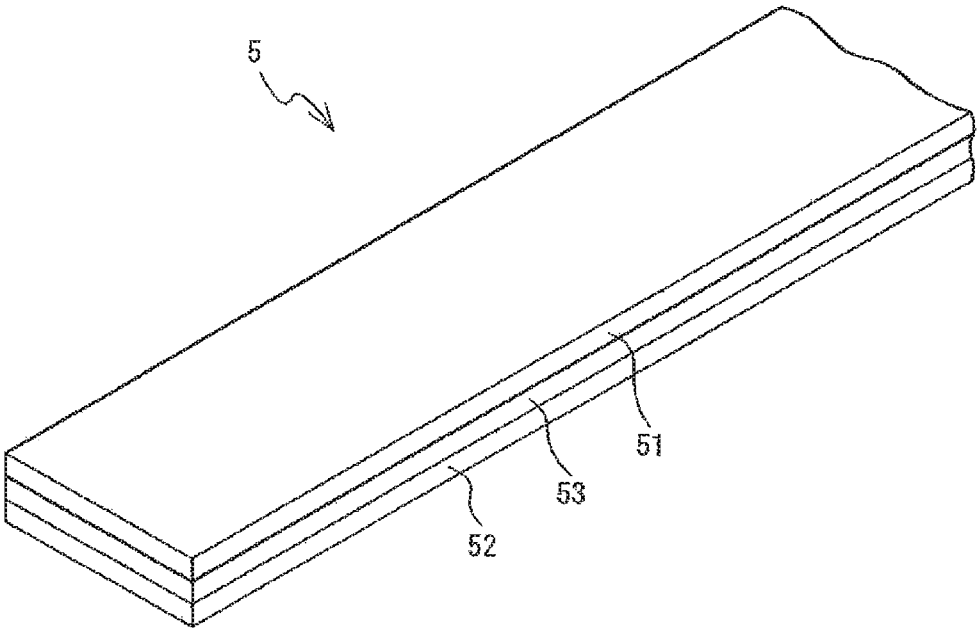
FIGS. 3A and 3B are perspective views of a receptor tape and a die cut tape, respectively.
Figure 3B:
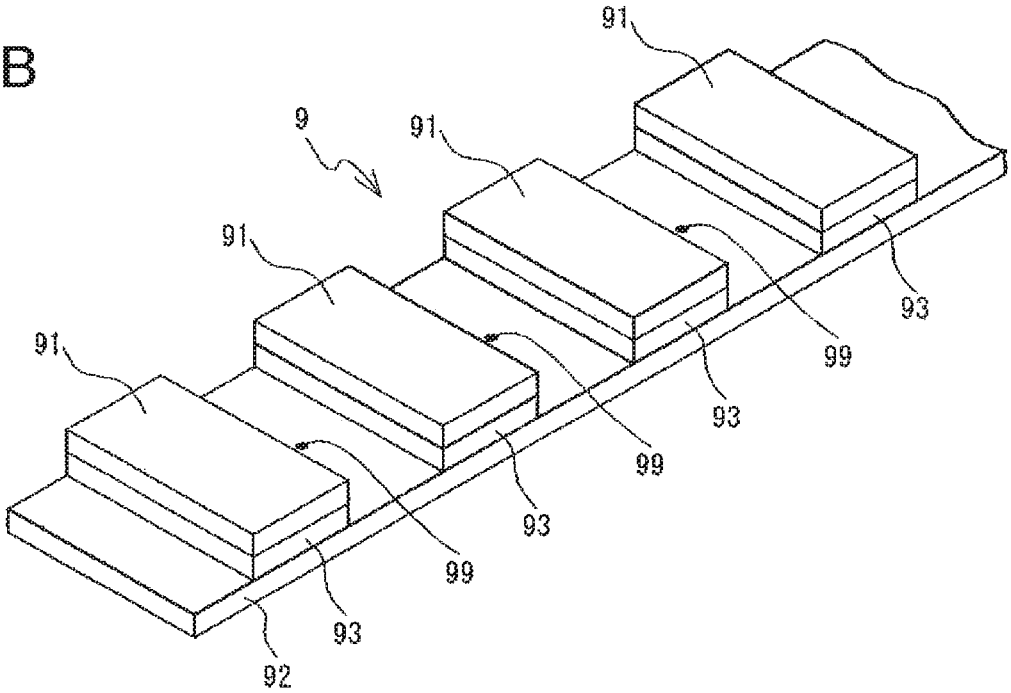

There will be next described the receptor tape 5, the die cut tape 9, the thermal tape, not illustrated, the transparent film tape, not illustrated, and the double-sided adhesive tape, not illustrated, as examples of the tape with reference to FIGS. 3A and 3B. As illustrated in FIG. 3A, the receptor tape 5 includes a substrate 51 and a release paper sheet 52. An adhesive layer 53 is provided on the substrate 51.

The adhesive layer 53 is coated with an adhesive (noted that an adhesive layer 93 which will be described below is also coated with an adhesive). The adhesive layer 53 is provided on one of opposite surfaces of the substrate 51, and the other of the opposite surfaces of the substrate 51 is a printing surface on which characters are to be printed. The release paper sheet 52 is peelably stuck to the substrate 51 by the adhesive layer 53.

As illustrated in FIG. 3B, the die cut tape 9 includes a plurality of substrates 91 and a release paper sheet 92. The adhesive layers 93 are provided on the respective substrates 91. The release paper sheet 92 is elongated. The substrates 91 are peelably stuck to the release paper sheet 92 using the adhesive layers 93 so as to be spaced uniformly on the release paper sheet 92 in the longitudinal direction of the release paper sheet 92. Each of the adhesive layers 93 is provided on one of opposite surfaces of a corresponding one of the substrates 91, and the other of the opposite surfaces of the substrate 91 is a printing surface on which characters are to be printed. The marks 99 are provided on portions of the release paper sheet 92 at which the substrates 91 are not provided. The marks 99 are through holes spaced uniformly in the longitudinal direction of the release paper sheet 92. The thermal head 60 performs thermal transfer of ink of the ink ribbon 8 to the printing surface of each of the substrates 51, 91 to print characters on each of the receptor tape 5 and the die cut tape 9.

The thermal tape, not illustrated, is a tape which the thermal head 60 heats to print characters on the thermal tape. The stencil tape, not illustrated, is a tape which the thermal head 60 heats to form holes shaped like characters. In the present embodiment, the word "printing" includes an operation of forming holes shaped like characters, in the tape.

The transparent film tape is a tape having a printing surface for which the thermal head 60 performs thermal transfer of the ink of the ink ribbon 8 to print characters. The double-sided adhesive tape is stuck to the printing surface of the printed transparent film tape. Hereinafter, the tape in which the double-sided adhesive tape is stuck to the printed transparent film tape will be referred to as "laminate tape".

In the present embodiment, the die cut tape 9 is bent more easily than the receptor tape 5 and the thermal tape. The receptor tape 5 and the thermal tape are more easily bent than the laminate tape. The laminate tape is more easily bent than the stencil tape. The bendability of the tape is determined based on the thickness of the tape and Young's modulus of the tape, for example For example, the greater the thickness of the tape or the greater Young's modulus of the tape, the less easily the tape is bent. Each of the receptor tape 5, the thermal tape, the stencil tape, and the laminate tape is more easily damaged than the die cut tape 9. The susceptibility of the tape to damage is determined based on the properties of the material of a surface of the tape (which include the presence or absence of coating) and the shape of the surface of the tape (e.g., the presence or absence of protrusions and recesses), for example. The larger the hardness of the surface of the tape, the less easily the tape is damaged, for example. It is noted that the tape is not limited to these types and may be a tube tape, for example. The bendability and the susceptibility of the tape to damage are merely examples.

There will be next described, with reference to FIGS. 1 and 2, a procedure in which the printer 1 performs printing using the cassette 7 of the receptor type, as one example. In a state in which the cover 3 is open, the platen roller 65 and the conveying roller 66 are respectively spaced apart from and located to the left of the thermal head 60 and the tape driving shaft 61. In this state, the user mounts the cassette 7 onto the mount portion 6. When the cassette 7 is mounted onto the mount portion 6, the ribbon take-up shaft 62 is inserted into the ribbon take-up spool 45. The tape driving shaft 61 is inserted into the tape driving roller 72. The head holder 69 is inserted into the head opening 71. A light emitter and a light receiver of the mark detecting sensor 31 enter from the pair of holes 79 into the casing 70. The light emitter and the light receiver of the mark detecting sensor 31 are opposed to each other in a state in which the tape drawn from the first tape spool 41 is interposed between the light emitter and the light receiver. Each of the receptor tape 5 and the ink ribbon 8 is disposed in a state in which its widthwise direction coincides with the up and down direction.

When the cover 3 is closed, the platen roller 65 and the conveying roller 66 are respectively moved to positions located near and to the left of the thermal head 60 and the tape driving shaft 61. As a result, the platen roller 65 presses the receptor tape 5 and the ink ribbon 8 against the thermal head 60 in a state in which the ink ribbon 8 is placed on the printing surface of the substrate 51 of the receptor tape 5. The conveying roller 66 presses the receptor tape 5 against the tape driving roller 72. The state in which the cassette 7 is mounted on the mount portion 6, and the cover 3 is closed may be hereinafter referred to as "printing prepared state".

Hereinafter, a direction in which the tape is conveyed may be referred to as "conveying direction". A position in the conveying direction at which the tape is nipped between the platen roller 65 and the thermal head 60 will be referred to as "printing position P1". A position in the conveying direction at which the tape is nipped between the conveying roller 66 and the tape driving roller 72 may be referred to as "first nipping position P2". A load at which the tape is nipped between the platen roller 65 and the thermal head 60 may be referred to as "nip load at the printing position P1". A load at which the tape is nipped between the conveying roller 66 and the tape driving roller 72 may be referred to as "nip load at the first nipping position P2". The first nipping position P2 is located downstream of the printing position P1 in the conveying direction. The nip load at the first nipping position P2 is less than the nip load at the printing position P1.

The printer 1 rotates the tape driving shaft 61, the platen roller 65, and the conveying roller 66 to convey the tape. The wording "conveyance" in the present embodiment includes forward conveyance and backward conveyance. The forward conveyance is conveyance of the tape downstream in the conveying direction. That is, the forward conveyance is conveyance of the tape such that the tape is drawn from the first tape spool 41. The backward conveyance is conveyance of the tape upstream in the conveying direction.

To perform the forward conveyance of the tape, the printer 1 rotates the conveying motor 68 (see FIG. 18) in the forward-conveyance direction to rotate the tape driving shaft 61 in the counterclockwise direction in plan view and rotate the platen roller 65 and the conveying roller 66 in the clockwise direction in plan view. In this case, the tape driving roller 72 is rotated in the counterclockwise direction in plan view. As a result, the tape is conveyed forward (that is, the tape is conveyed downstream in the conveying direction) in the state in which the tape is nipped between the conveying roller 66 and the tape driving roller 72. The receptor tape 5 is nipped between the platen roller 65 and the thermal head 60 and conveyed forward.

To perform the backward conveyance of the tape, the printer 1 rotates the conveying motor 68 in the backward-conveyance direction to rotate the tape driving shaft 61 in the clockwise direction in plan view and rotate the platen roller 65 and the conveying roller 66 in the counterclockwise direction in plan view. In this case, the tape driving roller 72 is rotated in the clockwise direction in plan view. As a result, the tape is conveyed backward (that is, the tape is conveyed upstream in the conveying direction) in the state in which the tape is nipped between the conveying roller 66 and the tape driving roller 72. The receptor tape 5 is nipped between the platen roller 65 and the thermal head 60 and conveyed backward. Hereinafter, an operation for conveying the tape forward may be referred to as "forward-conveyance operation", and an operation for conveying the tape backward may be referred to as "backward-conveyance operation".

The printer 1 performs a leading-end positioning operation before performing a printing operation. In the leading-end positioning operation, the printer 1 controls the conveying motor 68 to perform at least the backward-conveyance operation among the backward-conveyance operation and the forward-conveyance operation. As a result, leading-end positioning of the tape is performed.

After the end of the leading-end positioning operation, the printer 1 performs the printing operation. In the printing operation, the printer 1 performs printing on the tape while conveying the tape forward. Specifically, the printer 1 generates heat in the thermal head 60 to heat the ink ribbon 8. This operation thermally transfers the ink of the ink ribbon 8 to the printing surface of the substrate 51 of the receptor tape 5, whereby characters are printed at the printing position P1. The printer 1 rotates the conveying motor 68 in the forward-conveyance direction to rotate the ribbon take-up shaft 62, the tape driving shaft 61, the platen roller 65, and the conveying roller 66. The rotation of the ribbon take-up shaft 62 rotates the ribbon take-up spool 45, whereby the ribbon take-up spool 45 takes up the ink ribbon 8. The rotation of the tape driving shaft 61 rotates the tape driving roller 72 in the counterclockwise direction in plan view. The rotations of the tape driving roller 72 and the conveying roller 66 convey the receptor tape 5 forward at the first nipping position P2 in the state in which the receptor tape 5 is nipped between the conveying roller 66 and the tape driving roller 72. The rotation of the platen roller 65 conveys the receptor tape 5 forward in the state in which the receptor tape 5 is nipped between the platen roller 65 and the thermal head 60.

The printed receptor tape 5 is discharged from the cassette 7 and then cut by the cutting unit 100 which will be described below. The cut receptor tape 5 is discharged from the output opening 11 to the outside of the printer 1 by the output unit 200.

Figure 4:
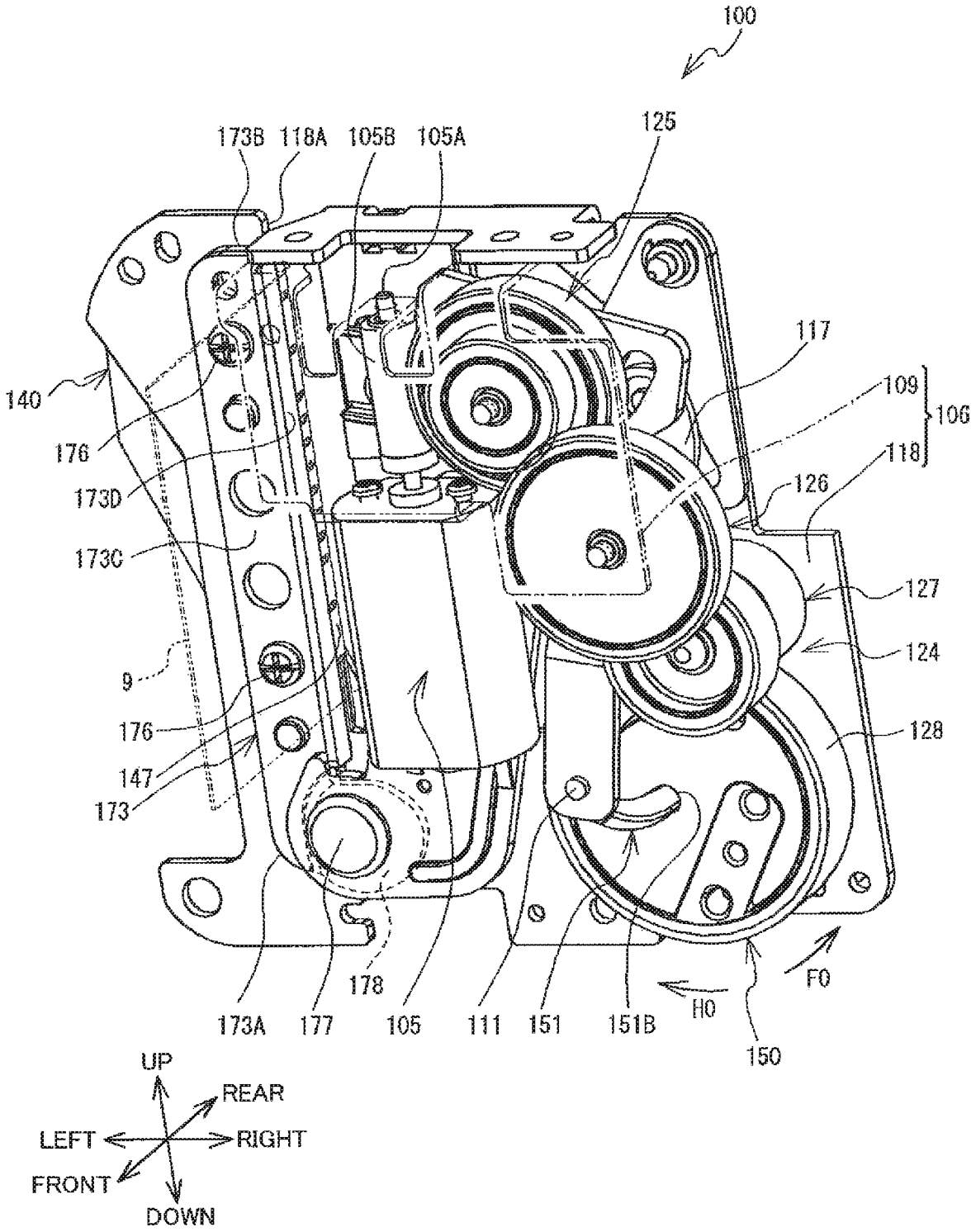
FIG. 4 is a perspective view of a cutting unit in its initial state which is viewed from an upper front right side thereof.
Figure 5:
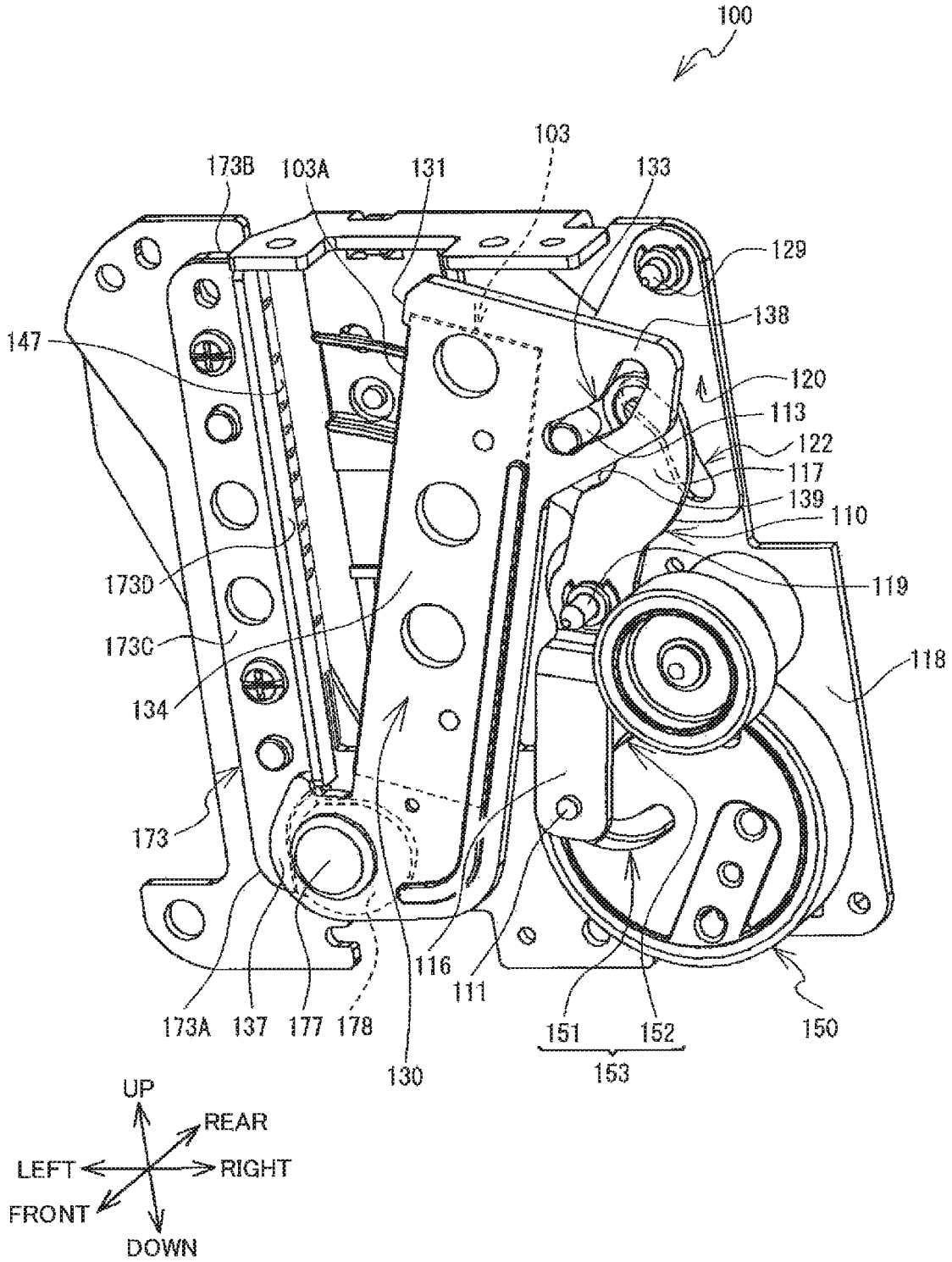
FIG. 5 is a perspective view of the cutting unit in FIG. 4 from which a second frame and coupling gears are omitted.
Figure 6:
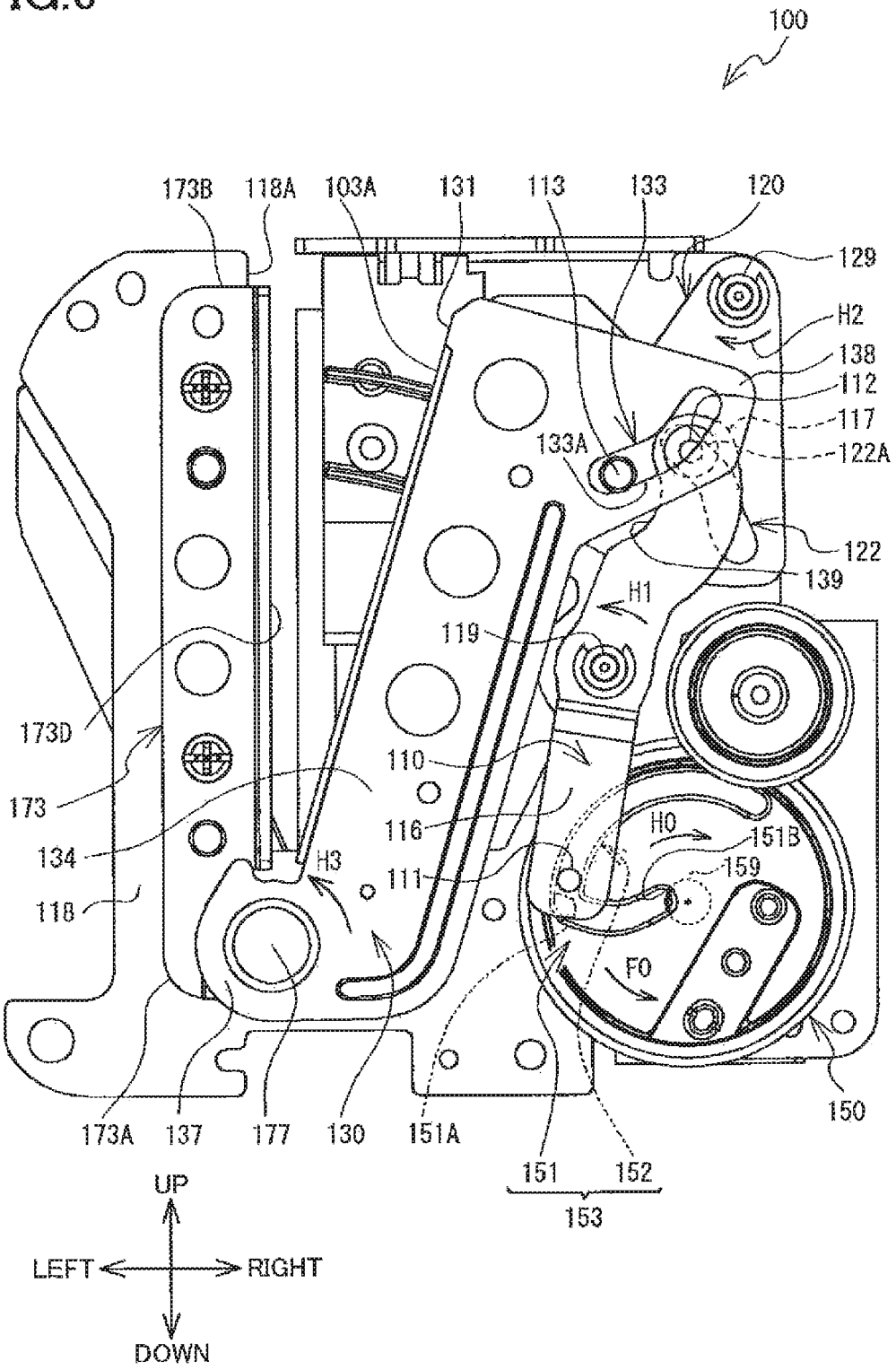
FIG. 6 is a front elevational view of the cutting unit in the initial state.

There will be next described a configuration of the cutting unit 100 in detail with reference to FIGS. 4-8. FIGS. 5 and 6 omit illustration of a second frame 109 and coupling gears 105B, 125, 126 of the cutting unit 100 (noted that illustration of these components is also omitted in FIGS. 9 and 10). The cutting unit 100 is provided in the housing 2 at a position located at a rear of the output opening 11 and in front of the conveying roller 66.

As illustrated in FIG. 4, the cutting unit 100 includes a fixed frame 106. The fixed frame 106 is fixed in the housing 2 (see FIG. 1). The fixed frame 106 includes a first frame 118 and the second frame 109. The second frame 109 has a rectangular shape in rear view and indicated by the two-dot chain line in FIG. 4. The first frame 118 is disposed in front of the second frame 109 and has a first passage opening 118A. The first passage opening 118A is formed through the first frame 118 in the front and rear direction and located at a rear of and next to a second passage opening 201 which will be described below. The tape passes through the first passage opening 118A. A guide member 147 is provided at a left end of the first passage opening 118A. A plurality of ribs each protruding rightward are disposed on the guide member 147 so as to be arranged in the up and down direction. The guide member 147 guides the tape being conveyed forward, to the second passage opening 201.

A receiver stand 173 is secured to the first frame 118. The receiver stand 173 is shaped like a plate. A lower end 173A of the receiver stand 173 is located under the first passage opening 118A. The lower end 173A has a projecting portion 178. The projecting portion 178 protrudes frontward from the lower end 173A. The projecting portion 178 has a fixing hole. The fixing hole has a round shape in front view. A shaft 177 is fixed in the fixing hole. The shaft 177 extends in the front and rear direction. The receiver stand 173 includes an extending portion 173C and a receiver plate 173D. The extending portion 173C extends between the lower end 173A and an upper end 173B of the receiver stand 173. The extending portion 173C is fastened to the first frame 118 by two screws 176 at a position located to the left of the first passage opening 118A. The receiver plate 173D protrudes frontward from a right end of the extending portion 173C. When viewed from a right side, the receiver plate 173D has a rectangular shape extending in the up and down direction. A portion of the tape which is located upstream of (i.e., at a rear of) the guide member 147 in the conveying direction is placed on the receiver plate 173D.

A cutting motor 105 is secured to a lower end of the second frame 109 at a position located to the right of the first passage opening 118A. An output shaft 105A of the cutting motor 105 extends upward from the cutting motor 105. The coupling gear 105B is secured to the output shaft 105A.

A rotor 150 is provided on a lower right side and a rear side of the cutting motor 105. The rotor 150 is disposed to the right of the shaft 177 and has a round shape in front view. The rotor 150 is rotatably supported by a shaft 159 (see FIG. 8). The shaft 159 extends through the first frame 118 in the front and rear direction and is secured to the first frame 118.

A gear train 124 is provided to the right of the output shaft 105A. The gear train 124 includes the coupling gears 125, 126, a coupling gear 127, and a cam gear 128. The coupling gears 125-127 and the cam gear 128 are arranged in this order from the upper side in the up and down direction. Each of the coupling gears 125-127 and the cam gear 128 is rotatable with its axial direction coinciding with the front and rear direction. Each of the coupling gears 125-127 is a double gear. Each of the coupling gears 125, 126 is rotatably supported by the second frame 109. The coupling gear 125 is engaged with the coupling gear 105B. The coupling gear 127 is rotatably supported by the first frame 118. The cam gear 128 is the most-downstream driven gear among the gears of the gear train 124, that is, the cam gear 128 is driven by the coupling gears 125, 126, 127. The cam gear 128 is formed integrally with an outer circumferential surface of the rotor 150. The coupling gears 125-127 and the cam gear 128 are engaged with one another. Thus, a driving force generated by the cutting motor 105 is transmitted to the rotor 150 via the coupling gear 105B and the gear train 124.

As illustrated in FIGS. 5 and 6, the rotor 150 is provided with grooved cams 151, 152. The grooved cams 151, 152 are opened frontward and continuous to each other as one unit. The grooved cam 151 has opposite ends, namely, a starting end 151A and a terminal end 151B and extends from the starting end 151A to the terminal end 151B toward the shaft 159. The grooved cam 152 has an arc shape centered about the shaft 159 and extends from the starting end 151A in the clockwise direction in front view. The grooved cams 151, 152 may be hereinafter collectively referred to as "grooved cam 153".

A support shaft 119 is provided on an upper left side of the rotor 150. The support shaft 119 protrudes frontward from the first frame 118 and supports a first linkage member 110 such that the first linkage member 110 is pivotable. The first linkage member 110 is opposed to the first frame 118 with a space therebetween in the front and rear direction and extends in the up and down direction. A portion of the first linkage member 110 which is located below the support shaft 119 extends frontward and is bent downward. A portion of the first linkage member 110 which is located above the support shaft 119 extends in the up and down direction. A lower end portion 116 of the first linkage member 110 is located in front of the rotor 150. A pin 111 is provided on the lower end portion 116. The pin 111 protrudes rearward from the lower end portion 116 and is engaged with the grooved cam 153. The grooved cam 151 is slid relative to the pin 111 with rotation of the rotor 150, whereby the first linkage member 110 is pivotable about the support shaft 119.

An upper end portion 117 of the first linkage member 110 is provided with a pin 112 and a recessed portion 139. The pin 112 protrudes rearward from the upper end portion 117 and is inserted in a through hole 197 (see FIG. 8). The through hole 197 is formed through the first frame 118 in the front and rear direction. The recessed portion 139 is recessed in the clockwise direction centered about the support shaft 119 in front view.

A second linkage member 120 is provided between the first linkage member 110 and the first frame 118. The second linkage member 120 is pivotably supported by a support shaft 129. The support shaft 129 is located to the right of the upper end 173B and protrudes frontward from the first frame 118. The second linkage member 120 is a plate member having a fan shape centered about the support shaft 129. The second linkage member 120 is disposed in front of the first frame 118 and opposed to the first frame 118 with contact therebetween. An end portion 121 of the second linkage member 120 which is far from the support shaft 129 is located at a rear of and opposed to the upper end portion 117.

Figure 7:
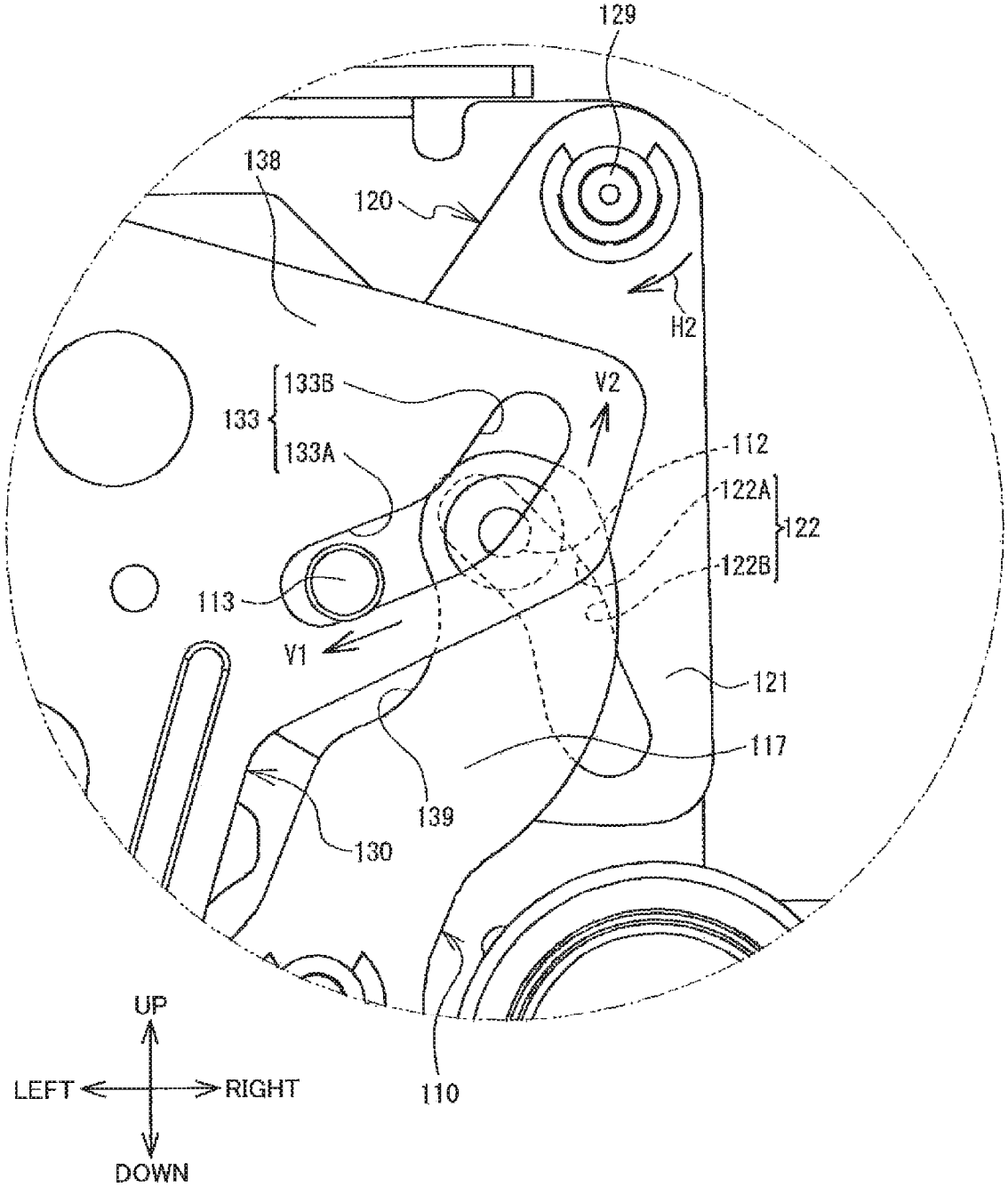
FIG. 7 is an enlarged front elevational view of a second linkage member when the cutting unit is in the initial state.

As illustrated in FIG. 7, the end portion 121 is provided with a grooved cam 122. The grooved cam 122 is engaged with the pin 112 and has cams 122A, 122B. The cams 122A, 122B are grooves continuous to each other as one unit, and the cam 122A is nearer to the support shaft 129 than the cam 122B. The cam 122A extends away from the support shaft 129, and the cam 122B extends from the cam 122A further away from the support shaft 129. The direction in which the cam 122A extends and the direction in which the cam 122B extends intersect each other. The pin 112 is slid relative to the grooved cam 122 with pivotal movement of the first linkage member 110, whereby the second linkage member 120 is pivotable about the support shaft 129. A pin 113 is provided on the end portion 121. The pin 113 illustrated in FIG. 7 protrudes frontward from the end portion 121 and is located on an inner side of the recessed portion 139.

As illustrated in FIGS. 5 and 6, a movable holder 130 is provided in front of the second linkage member 120. The movable holder 130 is pivotably supported by the shaft 177. A lower end portion 137 of the movable holder 130 is located in front of the lower end 173A of the receiver stand 173 and coupled to the shaft 177 such that the movable holder 130 is pivotable. An upper end portion 138 of the movable holder 130 is located in front of and opposed to the upper end portion 117 of the first linkage member 110.

The movable holder 130 includes a blade-fixed portion 134, a partial-cut blade 103, and a protrusion 131. The blade-fixed portion 134 extends between the lower end portion 137 and the upper end portion 138. The blade-fixed portion 134 is located at a rear of and opposed to the cutting motor 105 (see FIG. 4). The partial-cut blade 103 is shaped like a plate having a thickness in the front and rear direction. The partial-cut blade 103 is fixed to a rear surface of the blade-fixed portion 134. A left end of the partial-cut blade 103 has a cutting edge 103A. The cutting edge 103A slightly protrudes leftward from the extending portion 173C along the direction of pivotal movement of the movable holder 130. The cutting edge 103A is opposed to the receiver plate 173D of the receiver stand 173 along the direction of pivotal movement of the movable holder 130. The protrusion 131 protrudes leftward from the upper end portion 138 along the direction of pivotal movement of the movable holder 130 and is opposed to the receiver plate 173D along the direction of pivotal movement of the movable holder 130. A distal end (i.e., a left end) of the protrusion 131 is located slightly to the left of the cutting edge 103A.

As illustrated in FIG. 7, the upper end portion 138 is provided with a grooved cam 133. The grooved cam 133 is engaged with the pin 113 and has grooves 133A, 133B. The grooves 133A, 133B are continuous to each other as one unit. The groove 133A extends away from the shaft 177 (see FIG. 6). The groove 133B extends from the groove 133A further away from the shaft 177. The grooves 133A, 133B respectively extend different directions.

The pin 113 is slid relative to the grooved cam 133 with pivotal movement of the second linkage member 120, whereby the movable holder 130 is pivotable about the shaft 177 between a partial-cut position (see FIG. 9) and a retracted position (see FIG. 5). When the movable holder 130 is located at the partial-cut position, the distal end of the protrusion 131 is in contact with the receiver plate 173D. When the movable holder 130 is located at the retracted position, the movable holder 130 is retracted rightward from the partial-cut position. When the movable holder 130 is located at the retracted position, the cutting edge 103A is located to the right of the tape placed on the receiver plate 173D without contact between the cutting edge 103A and the tape. The cutting edge 103A is located to the right of the distal end of the protrusion 131. Accordingly, when the movable holder 130 is located at the partial-cut position, a space is formed between the cutting edge 103A and the receiver stand 173. The size of this space in the direction of pivotal movement of the movable holder 130 is less than the thickness of the tape.

Figure 8:
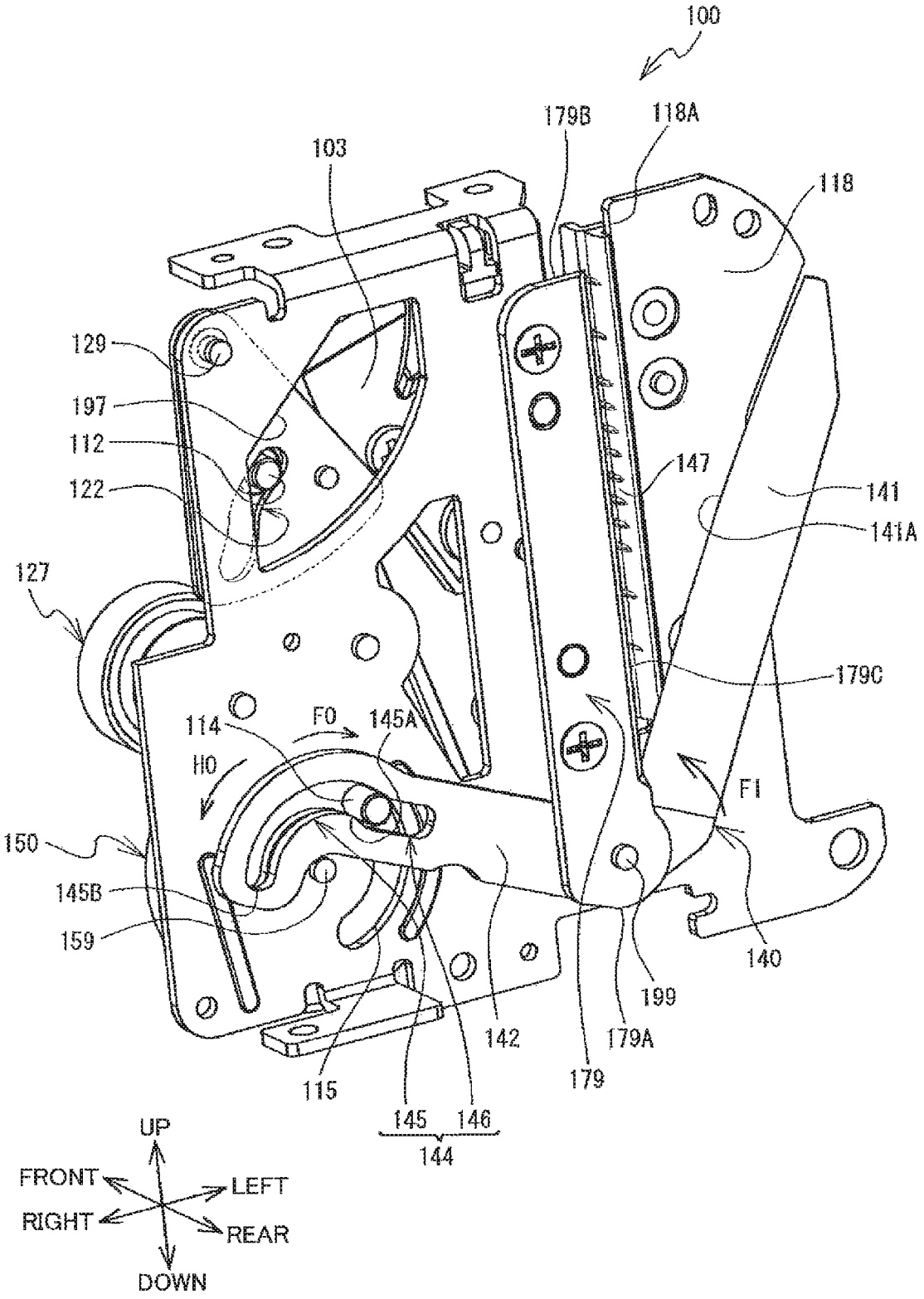
FIG. 8 is a perspective view of the cutting unit viewed from an upper rear right side thereof when a full-cut blade is located at a separated position.

As illustrated in FIG. 8, a fixed blade 179 and a full-cut blade 140 are provided at a rear of the first frame 118. The fixed blade 179 is fixed to the first frame 118 and located to the right of the first passage opening 118A. The fixed blade 179 is a plate member having a rectangular shape extending in the up and down direction in rear view. A shaft 199 is secured to a lower end 179A of the fixed blade 179. The shaft 199 extends in the front and rear direction and protrudes rearward from the first frame 118. A left end of the fixed blade 179 has a cutting edge 179C. The cutting edge 179C extends in the up and down direction. The tape is placed on the cutting edge 179C between the lower end 179A and an upper end 179B of the fixed blade 179.

The full-cut blade 140 is a plate member having an L-shape in front view. The full-cut blade 140 is pivotably supported by the shaft 199 at a position between the first frame 118 and the full-cut blade 140 in the front and rear direction. The full-cut blade 140 includes arms 141, 142. The arm 141 extends upward from the shaft 199. The arm 142 extends rightward from the shaft 199. The arm 141 has a cutting edge 141A extending in a direction in which the arm 141 extends. The cutting edge 141A is formed on one of opposite ends of the arm 141, which one is located nearer to the fixed blade 179 than the other in the counterclockwise direction centered about the shaft 199 in rear view in FIG. 8. In other words, the cutting edge 141A is formed on a counterclockwise-direction-side end of the arm 141. The cutting edge 141A is opposed to the cutting edge 179C of the fixed blade 179 along a direction of pivotal movement of the full-cut blade 140.

A right portion of the arm 142 is provided with a grooved cam 144. The grooved cam 144 is opened in the front and rear direction and engaged with a pin 114. The pin 114 protrudes rearward from the rotor 150 and is inserted in an insertion hole 115. The insertion hole 115 is formed through the first frame 118 in the front and rear direction and extends in an arc shape about the shaft 159.

The grooved cam 144 includes an arc cam 145 and a straight cam 146. The arc cam 145 and the straight cam 146 are grooves continuous to each other as one unit. The arc cam 145 has opposite ends, namely, a starting end 145A and a terminal end 145B and extends from the starting end 145A to the terminal end 145B in an arc shape in the counterclockwise direction centered about the shaft 159 in rear view. The straight cam 146 extends straight from the starting end 145A of the arc cam 145 to the shaft 199.

The pin 114 is slid relative to the straight cam 146 with rotation of the rotor 150, whereby the full-cut blade 140 is pivotable about the shaft 199 between a full-cut position (see FIG. 12) and a separated position (see FIG. 8). When the full-cut blade 140 is located at the full-cut position, the cutting edge 141A is located to the right of the cutting edge 179C of the fixed blade 179. When the full-cut blade 140 is located at the separated position, the cutting edge 141A is located to the left of and separated from the tape disposed on the cutting edge 179C. The direction of pivotal movement of the full-cut blade 140 is parallel with the direction of pivotal movement of the movable holder 130.

There will be next described a partial-cut operation performed by the cutting unit 100 with reference to FIGS. 6 and 9-11. The partial-cut operation is a cutting operation for cutting the tape along the widthwise direction such that a portion of the tape is left in the thickness direction. Before the start of the partial-cut operation, the tape is conveyed by the rollers of the printer 1 partially through the first passage opening 118A and placed on the receiver plate 173D. Before the start of the partial-cut operation, the cutting unit 100 is in its initial state (see FIGS. 6 and 8). When the cutting unit 100 is in the initial state, the pin 111 is in contact with the starting end 151A. The pin 112 is in contact with an upper end of the cam 122A. The pin 113 is in contact with a lower portion of the groove 133A. The movable holder 130 is located at the retracted position. The pin 114 is in contact with the starting end 145A. The full-cut blade 140 is located at the separated position.

When driving of the cutting motor 105 (see FIG. 4) is started, the coupling gear 105B is rotated with the output shaft 105A. When the gear train 124 transmits the driving force of the cutting motor 105 to the rotor 150, the rotor 150 is rotated in the clockwise direction in front view (as indicated by arrow H0). The grooved cam 151 of the rotor 150 is rotated while pressing the pin 111 rightward (see FIGS. 6 and 10). As a result, the first linkage member 110 pivots in the counterclockwise direction in front view (as indicated by arrow H1). The pivotal movement of the first linkage member 110 causes the pin 112 to pivot while pressing the cam 122A of the grooved cam 122 leftward. As a result, the second linkage member 120 pivots in the clockwise direction in front view (as indicated by arrow H2) while sliding relative to the first frame 118. In this movement, the pin 112 pivots relative to the second linkage member 120 to a position located above the recessed portion 139. The pivotal movement of the second linkage member 120 causes the pin 113 to press the groove 133A of the grooved cam 133 leftward. As a result, the movable holder 130 pivots from the retracted position toward the partial-cut position (as indicated by arrow H3). In this movement, the pin 113 slides from one of opposite sides in the direction in which the grooved cam 133 extends to the other side. In other words, the pin 113 slides from an arrow-V1 side in FIGS. 7 and 11 to an arrow-V2 side in FIGS. 7 and 11.

During the pivotal movement of the movable holder 130 toward the partial-cut position, the pin 114 (see FIG. 8) slides from the starting end 145A to the terminal end 145B of the arc cam 145 and thus does not press the full-cut blade 140. Accordingly, the full-cut blade 140 is kept stopped at the separated position.

Figure 9:
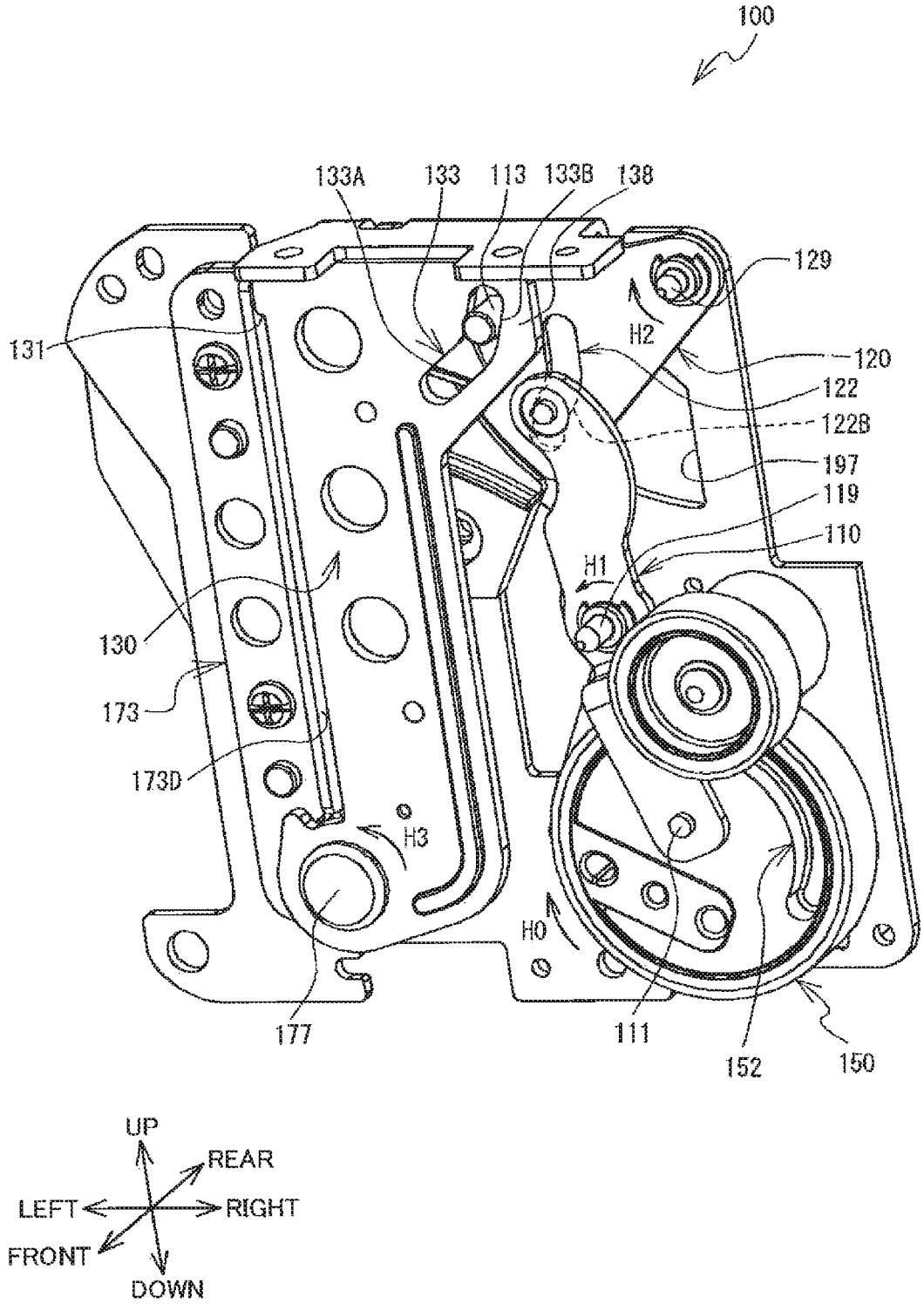
FIG. 9 is a perspective view of the cutting unit viewed from an upper front right side thereof when a partial-cut operation is being performed.
Figure 10:
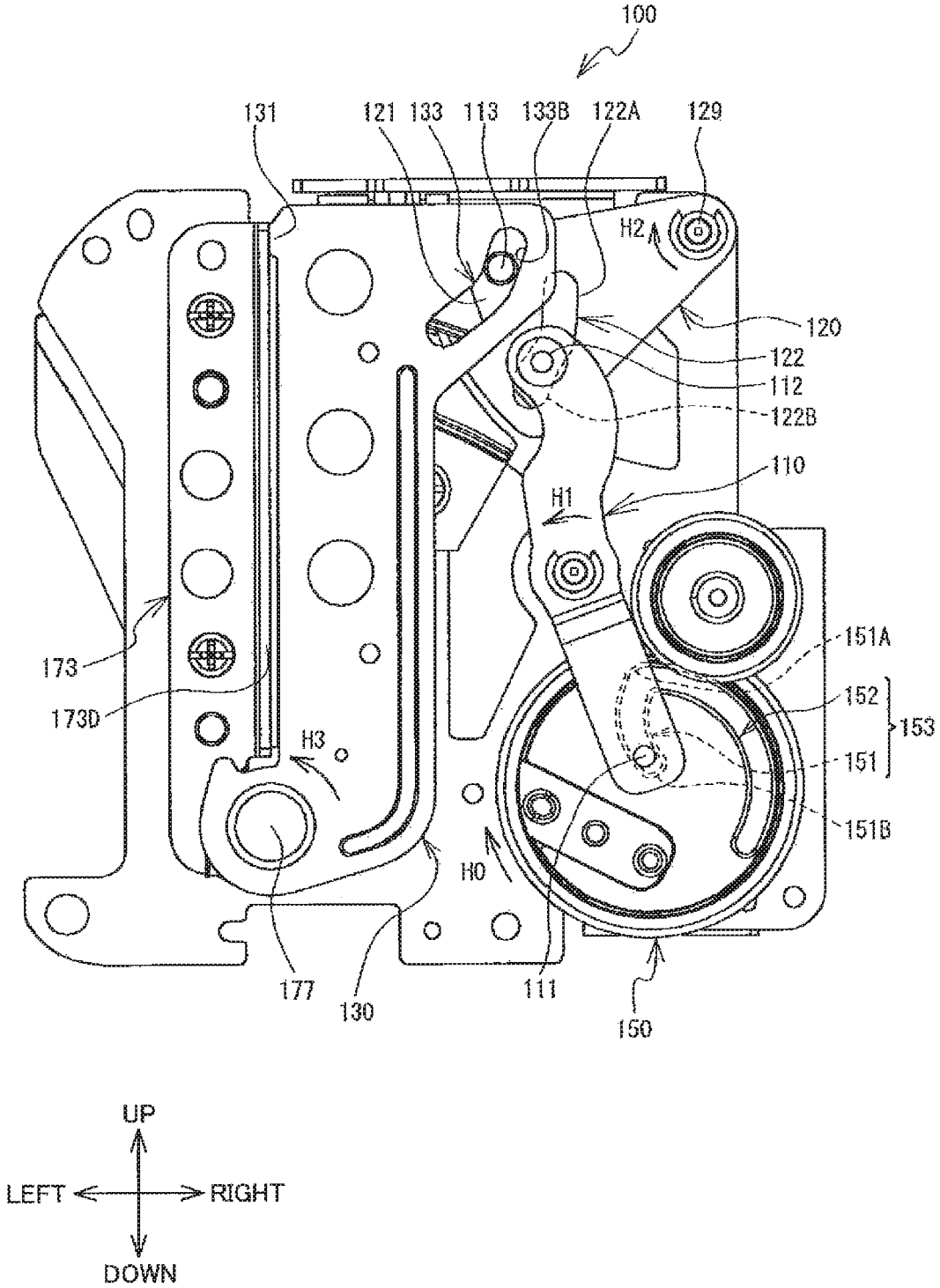
FIG. 10 is a front elevational view of the cutting unit when the partial-cut operation is being performed.
Figure 11:
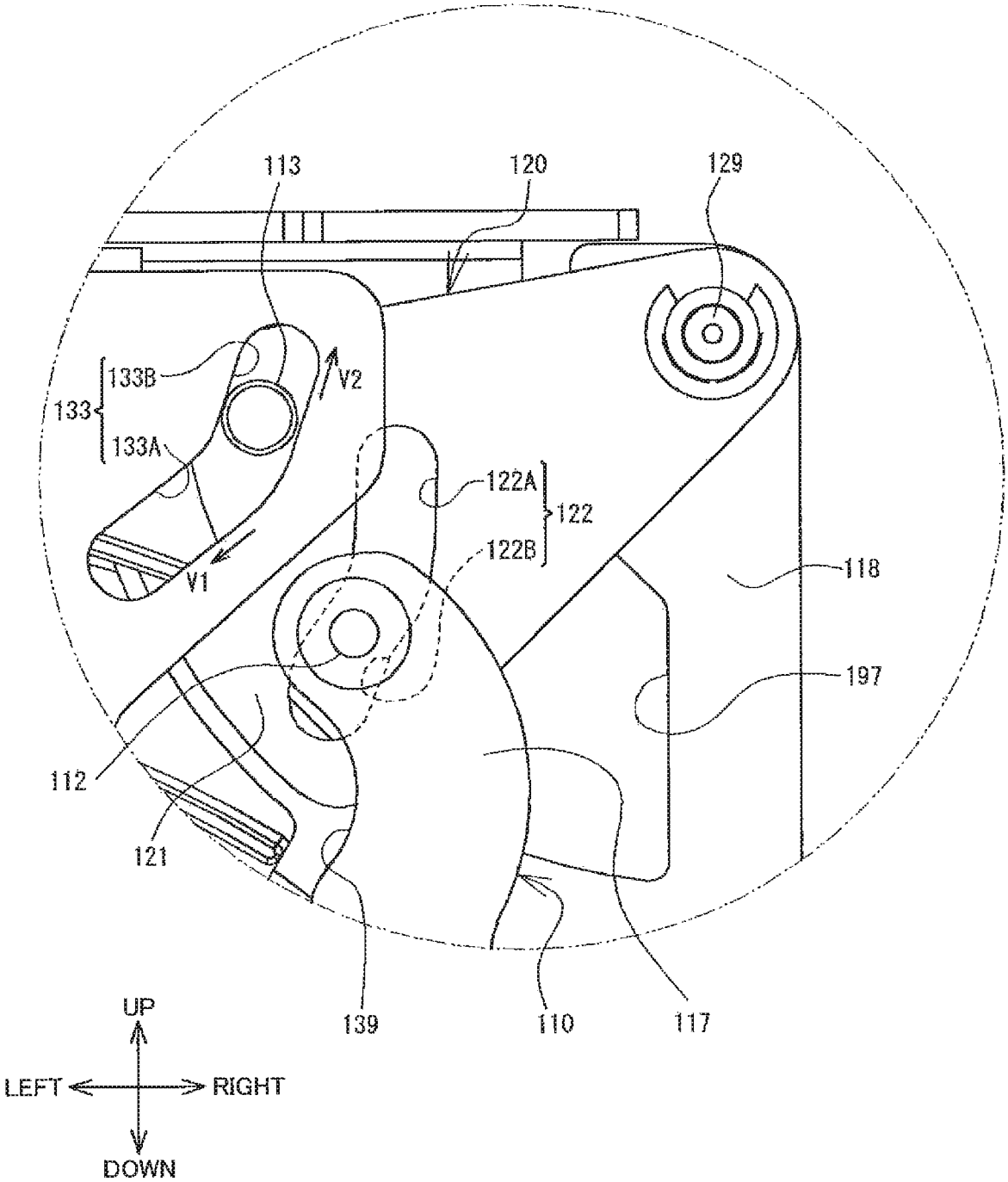
FIG. 11 is an enlarged front elevational view of the second linkage member when the partial-cut operation is being performed.

As illustrated in FIGS. 9-11, while the pin 111 is being slid toward the terminal end 151B with rotation of the rotor 150, the pin 112 slides relative to the cam 122B instead of the cam 122A, and the pin 113 slides relative to the groove 133B instead of the groove 133A. While the movable holder 130 continues pivoting, the cutting edge 103A starts cutting the tape gradually from below, in other words, the cutting edge 103A starts forming a slit in the tape.

When the cutting edge 103A starts forming a slit, the sliding pin 112 slides relative to the cam 122B while pivoting away from the support shaft 129. After the slit reaches an upper end of the tape, when the protrusion 131 comes into contact with the receiver plate 173D, the movable holder 130 reaches the partial-cut position. A portion of the tape which is located at the space formed between the cutting edge 103A and the receiver stand 173 (i.e., a portion of the tape in the thickness direction) is not cut. As a result, the partial-cut blade 103 partially cuts the tape with the cutting edge 103A in the widthwise direction. The driving of the cutting motor 105 is then finished. A position in the conveying direction at which the partial-cut blade 103 partially cuts the tape in the widthwise direction will be hereinafter referred to as "second cutting position P4" (see FIG. 2). The second cutting position P4 is located downstream of a first cutting position P3, which will be described below, in the conveying direction.

When the cutting motor 105 is rotated in a direction reverse to that at the start of the partial-cut operation, each of the rotor 150, the first linkage member 110, the second linkage member 120, and the movable holder 130 is rotated or pivoted in a direction reverse to that at the start of the partial-cut operation. The pin 113 is moved back to a position located on an inner side of the recessed portion 139 of the upper end portion 117. The cutting unit 100 is returned to the initial state. When the driving of the cutting motor 105 is finished, the partial-cut operation is completed.

Figure 12:
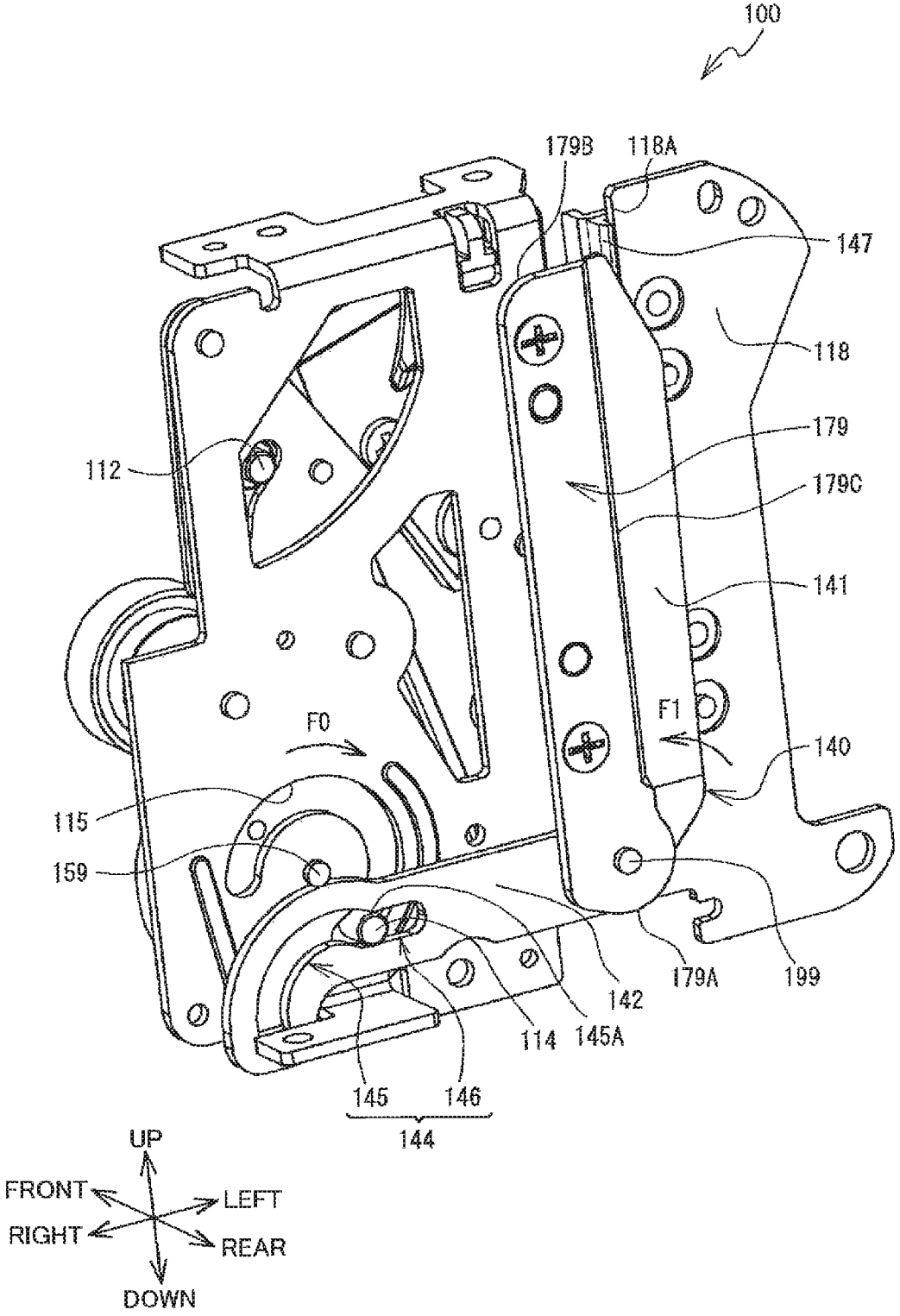
FIG. 12 is a perspective view of the full-cut blade located at a full-cut position which is viewed from an upper rear right side thereof.

There will be next described a full-cut operation performed by the cutting unit 100 with reference to FIGS. 6, 8, and 12. The full-cut operation is a cutting operation for cutting the tape along the widthwise direction such that the entire portion of the tape in the thickness direction is cut. Before the start of the full-cut operation, the cutting unit 100 is in the initial state.

The cutting motor 105 starts rotating in a direction reverse to that at the start of the partial-cut operation. This rotation rotates the rotor 150 in the counterclockwise direction in front view (as indicated by arrow F0). In this movement, the grooved cam 152 of the grooved cam 153 (see FIG. 6) is slid relative to the pin 111, and thus the grooved cam 153 does not press the pin 111. Accordingly, the movable holder 130 is kept stopped at the retracted position.

With the rotation of the rotor 150, the pin 114 is slid relative to the straight cam 146 while pressing the straight cam 146 downward. This movement causes the movable holder 130 to start pivoting toward the full-cut position (as indicated by arrow F1). As the pin 114 slides relative to the straight cam 146, the cutting edge 141A of the full-cut blade 140 gradually contacts the tape from its lower end portion such that the tape is interposed between the cutting edge 141A and the cutting edge 179C of the fixed blade 179. As a result, the tape is gradually cut from a lower side into two portions. After the cut is formed across the tape in the up and down direction, the full-cut blade 140 reaches the full-cut position. The full-cut blade 140 fully cuts the tape with the cutting edges 141A, 179C. The driving of the cutting motor 105 is stopped. A position in the conveying direction at which the full-cut blade 140 fully cuts the tape will be hereinafter referred to as "first cutting position P3". The first cutting position P3 is located downstream of the first nipping position P2 in the conveying direction.

The cutting motor 105 is rotated in a direction reverse to that at the start of the full-cut operation. Each of the rotor 150 and the full-cut blade 140 is rotated or pivoted in a direction reverse to that at the start of the full-cut operation, so that the cutting unit 100 is returned to the initial state. When the driving of the cutting motor 105 is finished, the full-cut operation is completed.

Figure 13:
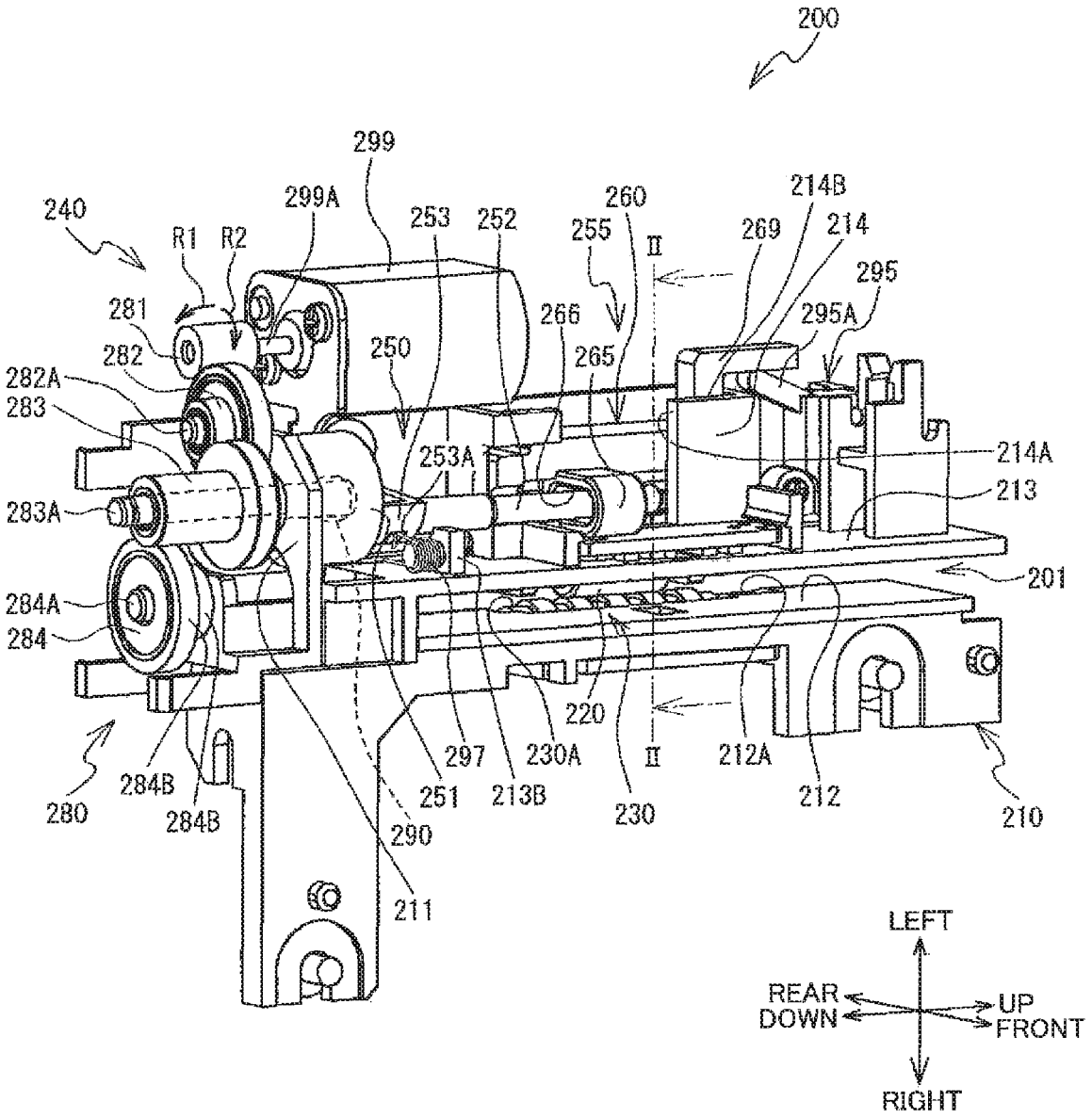
FIG. 13 is a perspective view of an output unit viewed from a lower front left side thereof when an output roller is located at a nip position.
Figure 14:
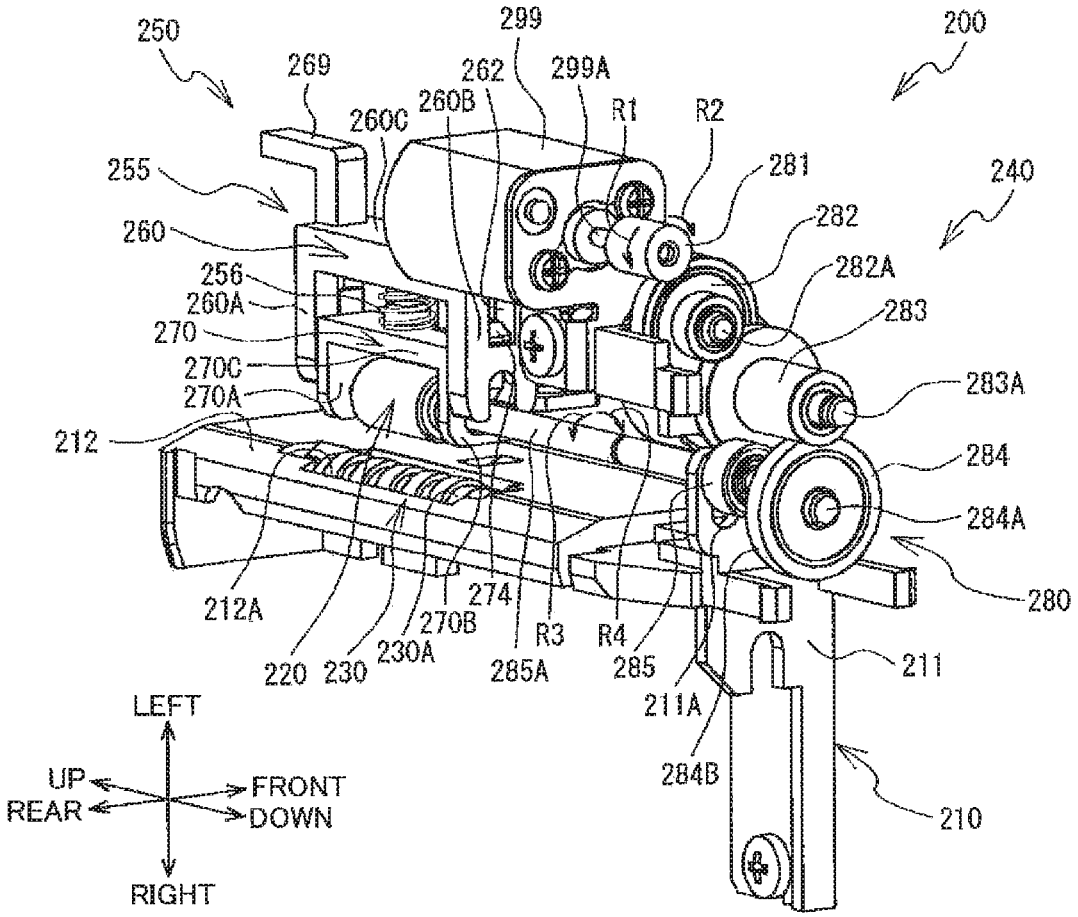
FIG. 14 is a perspective view of the output unit viewed from a lower rear left side thereof when the output roller is located at a release position.

There will be next described a configuration of the output unit 200 in detail with reference to FIGS. 13-17. FIG. 14 omits illustration of a third frame 213, a guide frame 214, and a position detecting sensor 295 of the output unit 200. As illustrated in FIG. 2, the output unit 200 is provided in the housing 2 at a position located at a rear of the output opening 11 and downstream of the cutting unit 100 in the conveying direction (i.e., in front of the cutting unit 100).

As illustrated in FIGS. 13 and 14, the output unit 200 includes a fixed frame 210, an output roller 220, an opposed roller 230, an output motor 299, a first coupling mechanism 280, a moving mechanism 250, a second coupling mechanism 240, and the position detecting sensor 295. The fixed frame 210 is fixed in the housing 2 at a position near a rear portion of the output opening 11 and includes a first frame 211, a second frame 212, and the third frame 213.

The first frame 211 is provided at a lower portion of the output unit 200 and extends in a direction orthogonal to the up and down direction. Each of the second frame 212 and the third frame 213 extends upward from the first frame 211 and extends in a direction orthogonal to the right and left direction. The third frame 213 is located to the left of the second frame 212 and opposed to the second frame 212 with a predetermined space therebetween. The space between the second frame 212 and the third frame 213 is the second passage opening 201. The second passage opening 201 is located in front of the first passage opening 118A and at a rear of the output opening 11 (see FIGS. 16 and 17), and these openings are arranged in a row. The tape is conveyed forward from the upstream side (i.e., the rear side) toward the downstream side (i.e., the front side) in the conveying direction through the first passage opening 118A, the second passage opening 201, and the output opening 11 in this order.

In the case where the tape is the receptor tape 5, for example, the receptor tape 5 is conveyed through the first passage opening 118A, the second passage opening 201, and the output opening 11 in a state in which one of opposite surfaces of the receptor tape 5 as a surface of the substrate 51 faces rightward, and the other of the opposite surfaces of the receptor tape 5 as a surface of the release paper sheet 52 faces leftward. In the case where the tape is the die cut tape 9, the die cut tape 9 is conveyed through the first passage opening 118A, the second passage opening 201, and the output opening 11 in a state in which one of opposite surfaces of the die cut tape 9 partly as surfaces of the respective substrates 91 faces rightward, and the other of the opposite surfaces of the die cut tape 9 as a surface of the release paper sheet 92 faces leftward.

Figure 16:
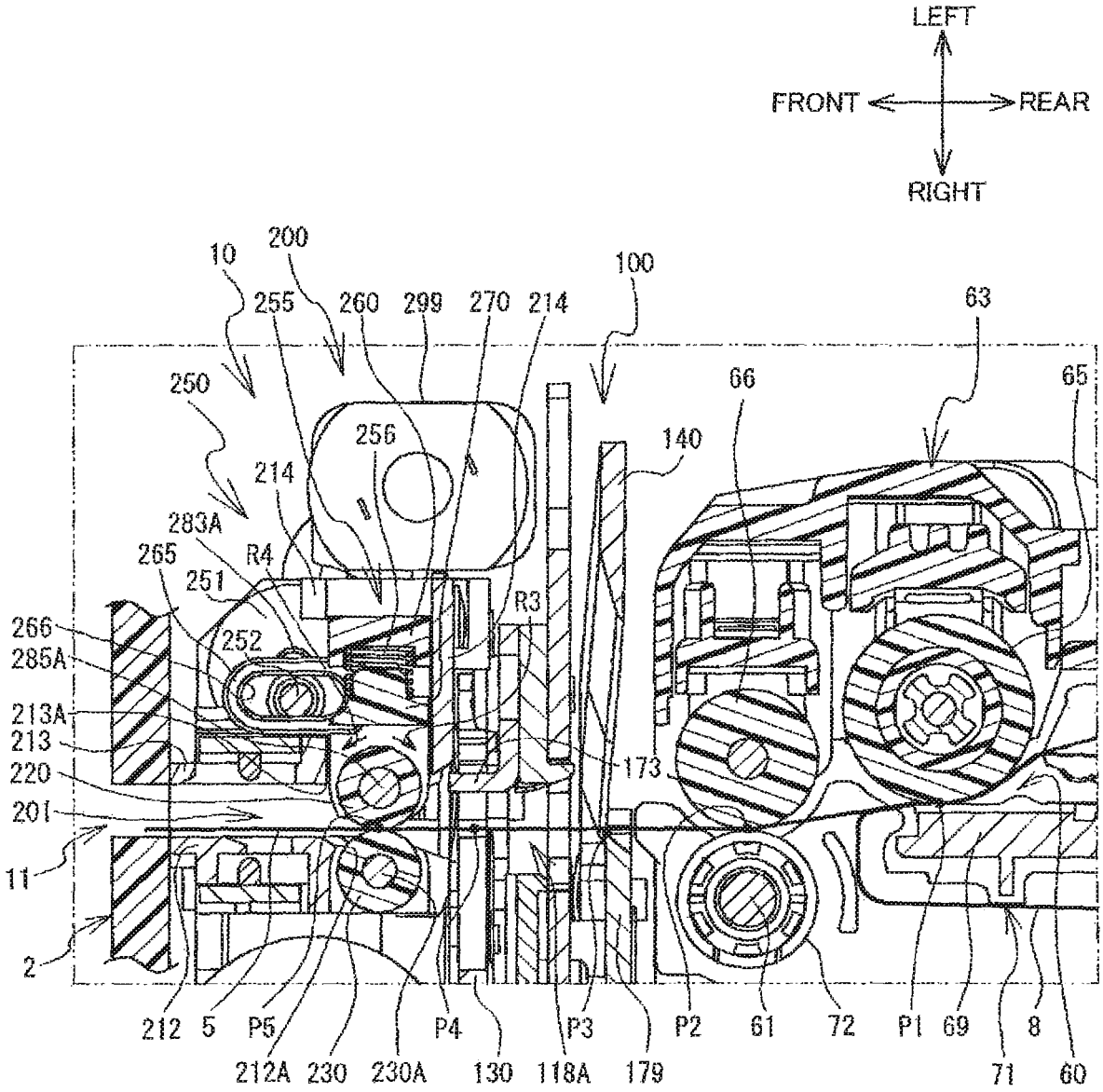
FIG. 16 is an enlarged view of a region W in FIG. 2 when the output roller is located at the nip position.
Figure 17:
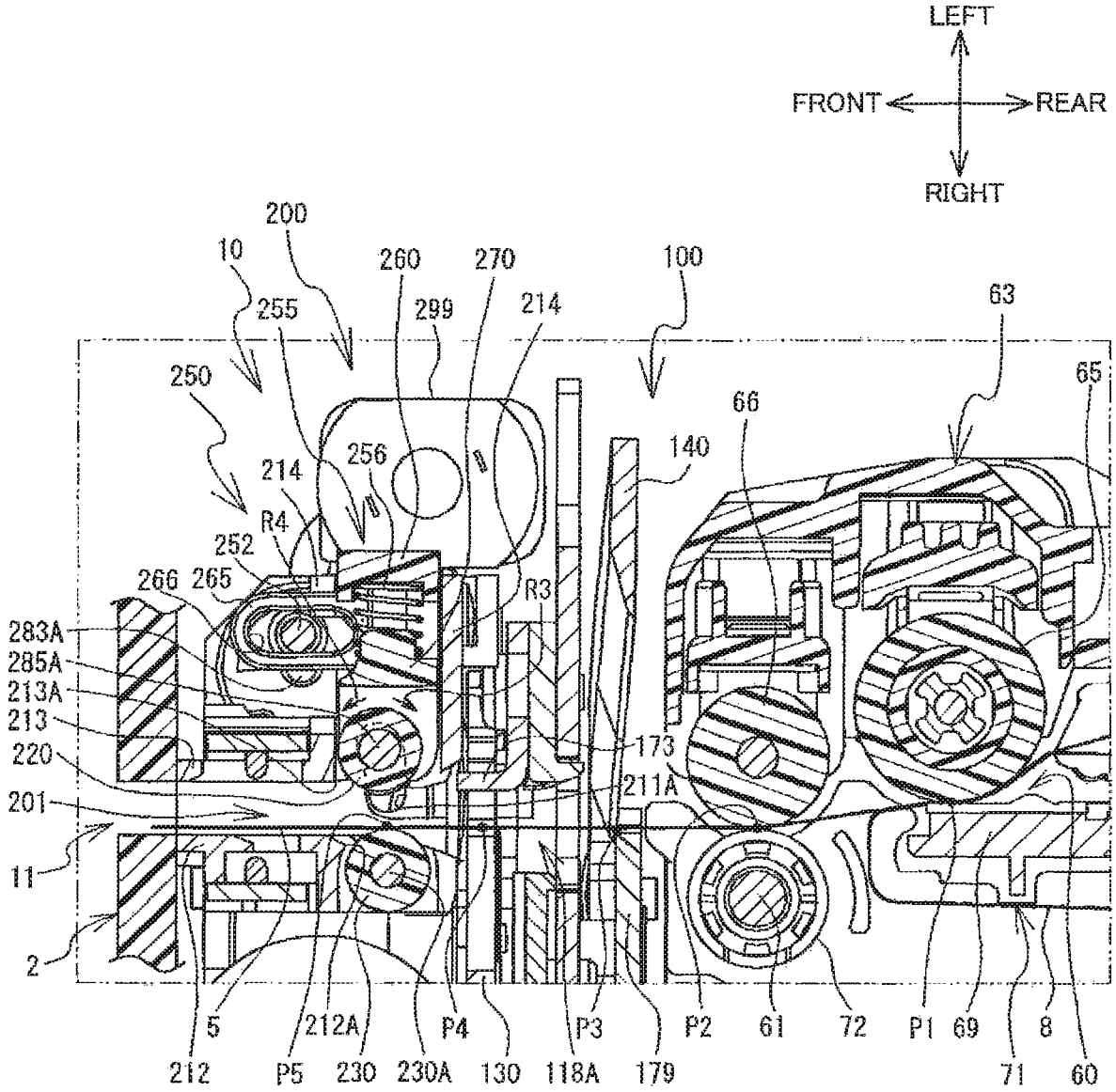
FIG. 17 is an enlarged view of the region W in FIG. 2 when the output roller is located at the release position.

As illustrated in FIGS. 16 and 17, the output roller 220 is disposed to the left of the second passage opening 201 and downstream of the conveying roller 66 and the tape driving shaft 61 in the conveying direction (i.e., in front of the conveying roller 66 and the tape driving shaft 61). That is, the output roller 220 is disposed nearer to the release paper sheet 52 of the receptor tape 5 than to the substrate 51. The output roller 220 is a cylindrical elastic member extending in the up and down direction and disposed in a hole 213A (see FIGS. 16 and 17). The hole 213A is formed through a rear end portion of the third frame 213 in the right and left direction so as to extend in a rectangular shape elongated in the up and down direction in side view.

As illustrated in FIGS. 16 and 17, the opposed roller 230 is disposed to the right of the second passage opening 201 and downstream of the conveying roller 66 and the tape driving shaft 61 in the conveying direction (i.e., in front of the conveying roller 66 and the tape driving shaft 61). That is, the opposed roller 230 is disposed nearer to the substrate 51 of the receptor tape 5 than to the release paper sheet 52. The opposed roller 230 is located to the output roller 220 and opposed to the output roller 220 with the second passage opening 201 therebetween. The opposed roller 230 extends in the up and down direction and is disposed in a hole 212A. The opposed roller 230 includes a plurality of cylindrical elastic members spaced uniformly in the up and down direction. The hole 212A is formed through a rear end portion of the second frame 212 in the right and left direction so as to extend in a rectangular shape elongated in the up and down direction in side view. A left end portion of the opposed roller 230 is located to the left of a left surface of the second frame 212. A rotation shaft 230A is rotatably inserted in a central hole of the opposed roller 230. The rotation shaft 230A is a circular cylindrical member extending in the up and down direction. Opposite end portions of the rotation shaft 230A are secured to inner walls of upper and lower portions of the hole 212A.

The output motor 299 is a DC motor secured to a left end portion of the first frame 211. An output shaft 299A of the output motor 299 extends downward from the output motor 299. The output motor 299 is capable of rotating the output shaft 299A in any of the counterclockwise direction (indicated by arrow R1) and the clockwise direction (indicated by arrow R2) in bottom view. Hereinafter, an operation of the output motor 299 in which the output motor 299 is driven so as to be rotated to rotate the output shaft 299A in the counterclockwise direction in bottom view may be referred to as "forward rotation". An operation of the output motor 299 in which the output motor 299 is driven so as to be rotated to rotate the output shaft 299A in the clockwise direction in bottom view may be referred to as "reverse rotation ".

The first coupling mechanism 280 is provided at the lower portion of the output unit 200 and power-transmittably couples the output motor 299 and the output roller 220 to each other. The first coupling mechanism 280 includes coupling gears 281-284, a moving gear 285, and a rotation shaft 285A. The rotation axis of each of the coupling gears 281-284 and the moving gear 285 extends in the up and down direction. The coupling gear 281 is a spur gear secured to a lower end portion of the output shaft 299A.

The coupling gear 282 is disposed on a front right side of the coupling gear 281. The coupling gear 282 is a double gear constituted by a large-diameter gear and a small-diameter gear. A rear left end portion of the large-diameter gear of the coupling gear 282 is engaged with a front right end portion of the coupling gear 281. A rotation shaft 282A is rotatably inserted in a central hole of the coupling gear 282. The rotation shaft 282A is a circular cylindrical member secured to the first frame 211 and extending downward from the first frame 211. The coupling gear 283 is disposed on a front right side of the coupling gear 282. The coupling gear 283 is a double gear constituted by a large-diameter gear and a small-diameter gear. A rear left end portion of the large-diameter gear of the coupling gear 283 is engaged with a front right end portion of the small-diameter gear of the coupling gear 282. A lower end portion of a rotation shaft 283A is inserted and secured in a central hole of the coupling gear 283. The rotation shaft 283A extends through the first frame 211 in the up and down direction. An upper end portion of the rotation shaft 283A is located above an upper surface of the first frame 211. The rotation shaft 283A is rotatably supported by the first frame 211. A portion of the rotation shaft 283A which is located above the first frame 211 has a circular cylindrical shape. A portion of the rotation shaft 283A which is located below the first frame 211 has a D-cut shape.

The coupling gear 284 is provided to the right of the coupling gear 283. The coupling gear 284 is a double gear constituted by a large-diameter gear and a small-diameter gear. A left end portion of the large-diameter gear of the coupling gear 284 is engaged with a right end portion of the small-diameter gear of the coupling gear 283. A rotation shaft 284A is rotatably inserted in a central hole of the coupling gear 284. The rotation shaft 284A is a circular cylindrical member secured to the first frame 211 and extending downward from the first frame 211. The moving gear 285 is a spur gear provided at a rear of the coupling gear 284. A front end portion of the moving gear 285 is engaged with a rear end portion of the small-diameter gear of the coupling gear 284. The rotation shaft 285A extends parallel with the rotation shaft 230A. A lower end portion of the rotation shaft 285A has a D-cut shape. The entire portion of the rotation shaft 285A which is different from its lower end portion has a circular cylindrical shape. The lower end portion of the rotation shaft 285A is located below the first frame 211 and inserted and secured in a central hole of the moving gear 285. The rotation shaft 285A extends upward to an upper end of the hole 213A and is inserted and secured in a central hole of the output roller 220.

The first frame 211 has a guide hole 211A. The guide hole 211A extends in the up and down direction through a portion of the first frame 211 which is located at a rear of the coupling gear 284. The guide hole 211A extends in an arc shape in plan view along an outer circumferential surface 284B of the coupling gear 284 on which teeth of the coupling gear 284 are provided (see FIG. 17). It is noted that a portion of the guide hole 211A which is hidden by, e.g., the output roller 220 is indicated by the broken line in FIG. 17. A portion of the rotation shaft 285A which is located above the moving gear 285 is inserted in the guide hole 211A. The rotation shaft 285A is movable in the guide hole 211A along the guide hole 211A.

The moving mechanism 250 moves the output roller 220 toward and away from the opposed roller 230. In the present embodiment, the moving mechanism 250 moves the output roller 220 between a position at which the output roller 220 is located to the left of the opposed roller 230 and close to or in contact with the opposed roller 230 as illustrated in FIGS. 13 and 16 (noted that this position will be hereinafter referred to as "nip position") and a position at which the output roller 220 is located to the left of and far from the opposed roller 230 as illustrated in FIGS. 14 and 17 (noted that this position will be hereinafter referred to as "release position").

The moving mechanism 250 includes a rotor 251, an eccentric member 252, and a roller holder 255. The rotor 251 is a cylindrical member disposed on an opposite side of the first frame 211 from the coupling gear 283. The upper end portion of the rotation shaft 283A is rotatably inserted in a central hole of the rotor 251. The eccentric member 252 is a circular cylindrical member extending upward from a position on the rotor 251 which is eccentric to the rotation shaft 283A. Thus, with rotation of the rotor 251, the eccentric member 252 is rotated about the rotation shaft 283A in plan view.

A larger-diameter portion 253 is provided at a lower end portion of the eccentric member 252. The larger-diameter portion 253 is a portion to which the eccentric member 252 and an upper surface of the rotor 251 are fixed. The larger-diameter portion 253 is greater in diameter than the eccentric member 252 and has a semicircular shape in plan view. The larger-diameter portion 253 has a recessed portion 253A (see FIG. 13). The recessed portion 253A is recessed from an arc portion of the larger-diameter portion 253 toward the rotation shaft 283A (i.e., toward the center of rotation of the eccentric member 252). An urging member 297 is engageable with the recessed portion 253A. The urging member 297 is a torsion spring secured to an urging-member fixed member 213B. The urging-member fixed member 213B is provided on a left surface of the third frame 213 at a position located near an upper front portion of the rotor 251. Both ends of the urging member 297 extend rearward. When the larger-diameter portion 253 is located to the right of the rotation shaft 283A, the recessed portion 253A opens rightward, so that an end portion of the urging member 297 is engaged with the recessed portion 253A from a right side thereof (see FIG. 13). When the larger-diameter portion 253 is located to the left of the rotation shaft 283A, the recessed portion 253A opens leftward, so that the end portion of the urging member 297 is separated from the recessed portion 253A (not illustrated).

Figure 15:
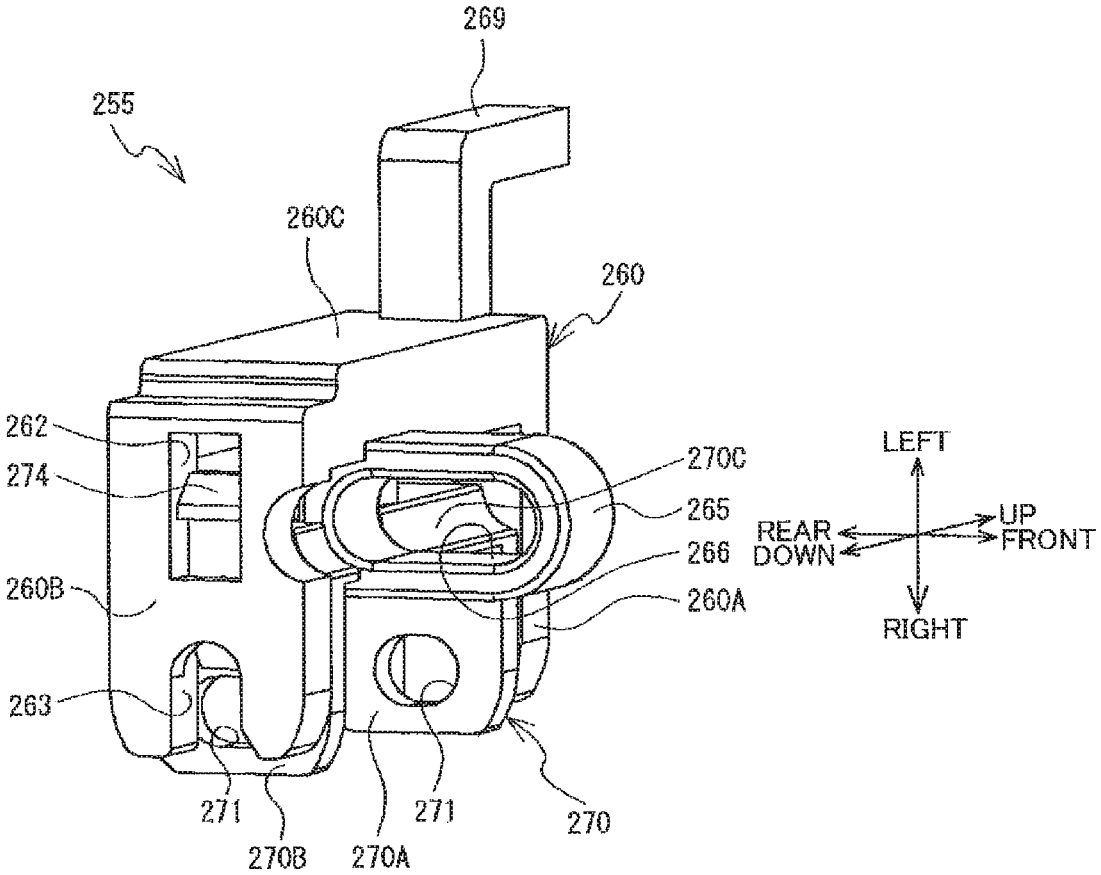
FIG. 15 is a perspective view of a roller holder viewed from a lower front left side thereof.

As illustrated in FIG. 15, the roller holder 255 includes a first member 260, a second member 270, and an urging member 256 (see FIG. 14). The first member 260 has a U-shape that opens rightward in front view. Engaging holes 262 are respectively formed in an upper wall portion 260A and a lower wall portion 260B of the first member 260. It is noted that FIG. 15 omits illustration of the engaging hole 262 formed in the wall portion 260A. Each of the engaging holes 262 extends in the up and down direction through a left end portion of a corresponding one of the wall portions 260A, 260B. Each of the engaging holes 262 has a rectangular shape elongated in the right and left direction in plan view. The wall portion 260B has a recessed portion 263. The recessed portion 263 is recessed leftward from a right end portion of the wall portion 260B.

A protrusion 265 and a detecting piece 269 are provided on a wall portion 260C as a left portion of the first member 260. The protrusion 265 protrudes frontward from a right end portion of a front surface of the wall portion 260C. The protrusion 265 has a first support hole 266. The first support hole 266 is formed through the protrusion 265 in the up and down direction and elongated in the front and rear direction. The eccentric member 252 (see FIG. 13) is inserted in the first support hole 266. The first support hole 266 supports the eccentric member 252 such that the eccentric member 252 is movable in the front and rear direction. The detecting piece 269 extends leftward from an upper end portion of a left surface of the wall portion 260C and then extends upward.

The second member 270 has a U-shape that opens rightward in front view. The second member 270 is smaller than the first member 260. The second member 270 is disposed on an inner side of a recessed portion of the first member 260. The output roller 220 (see FIG. 14) is disposed in a recessed portion of the second member 270, i.e., between an upper wall portion 270A and a lower wall portion 270B of the second member 270. A right end portion of the second member 270 serves as a right end portion of the roller holder 255. A right end portion of the output roller 220 is located to the right of the right end portion of the roller holder 255. Second support holes 271 are formed in the respective wall portions 270A, 270B. Each of the second support holes 271 extends in the up and down direction through a right end portion of a corresponding one of the wall portions 270A, 270B. Each of the second support holes 271 is elongated in the front and rear direction. The rotation shaft 285A is inserted in the second support holes 271. The second support holes 271 support the rotation shaft 285A such that the rotation shaft 285A is rotatable and movable in the front and rear direction.

Engaging pieces 274 are provided on the respective wall portions 270A, 270B. It is noted that FIG. 15 omits illustration of the engaging piece 274 provided on the wall portion 270A. The engaging pieces 274 are shaped like hooks protruding leftward from left end portions of the respective wall portions 270A, 270B and facing away from each other. The hooked portion of each of the engaging pieces 274 is engaged with a corresponding one of the engaging holes 262 so as to be movable in the right and left direction. With this configuration, the second member 270 is supported by the first member 260 so as to be movable in the right and left direction, i.e., a direction toward and away from the opposed roller 230.

As illustrated in FIG. 14, the urging member 256 is provided between a right surface of the wall portion 260C and a left surface of a left wall portion 270C of the second member 270. The urging member 256 is a compression coil spring that urges the second member 270 rightward toward the opposed roller 230 with respect to the first member 260. Thus, in the case where a leftward force does not act on the second member 270, the second member 270 is kept by an urging force of the urging member 256 to a position at which the hooked portion of each of the engaging pieces 274 is in contact with a right end portion of the corresponding one of the engaging holes 262.

As illustrated in FIGS. 13, 16, and 17, the roller holder 255 is disposed at a rear of a left surface of the third frame 213 and on an inner side of the guide frame 214. The guide frame 214 extends leftward from the third frame 213. When viewed from a left side, the guide frame 214 has a substantially rectangular shape extending along the shape of the roller holder 255. The guide frame 214 has openings 214A, 214B. The opening 214A opens frontward at a lower front corner portion of the guide frame 214. The protrusion 265 protrudes frontward from the opening 214A. The opening 214B opens leftward at a left end of the guide frame 214. The detecting piece 269 protrudes leftward from the opening 214B. The guide frame 214 guides the roller holder 255 linearly in the right and left direction.

As illustrated in FIGS. 13 and 14, the second coupling mechanism 240 is provided at the lower portion of the output unit 200 and configured to power-transmittably couple the output motor 299 and the moving mechanism 250 to each other. The second coupling mechanism 240 includes the coupling gears 281-283, the rotation shaft 283A, and a one-way clutch 290. That is, the coupling gears 281-283 power-transmittably couple the output motor 299 and the output roller 220 to each other and power-transmittably couple the output motor 299 and the moving mechanism 250 to each other.

The one-way clutch 290 is provided between an inner wall of the rotor 251 and the upper end portion of the rotation shaft 283A. In FIG. 13, the one-way clutch 290 and portions of the rotation shaft 283A which are located inside the coupling gear 283, the first frame 211, and the rotor 251 are indicated by the broken lines.

The one-way clutch 290 power-transmittably couples the output motor 299 and the rotor 251 to each other when the output motor 299 is rotated reversely. The one-way clutch 290 disengages power transmission between the output motor 299 and the rotor 251 (that is, the one-way clutch 290 decouples the output motor 299 and the rotor 251 from each other) when the output motor 299 is rotated forwardly. In the present embodiment, when the output motor 299 is rotated reversely (as indicated by arrow R2), the rotation shaft 283A is rotated via the coupling gears 281-283 in the clockwise direction in bottom view. When the rotation shaft 283A is rotated in the clockwise direction in bottom view, the one-way clutch 290 rotates the rotor 251 with the rotation shaft 283A. When the output motor 299 is rotated forwardly (as indicated by arrow R1), the rotation shaft 283A is rotated via the coupling gears 281-283 in the counterclockwise direction in bottom view. When the rotation shaft 283A is rotated in the counterclockwise direction in bottom view, the one-way clutch 290 idles the rotor 251 with respect to the rotation shaft 283A.

As illustrated in FIG. 13, the position detecting sensor 295 is secured to the left surface of the third frame 213 above the guide frame 214. The position detecting sensor 295 is a switch sensor and includes a movable piece 295A. The movable piece 295A is provided to the right of an upper end portion of the detecting piece 269. The movable piece 295A is always urged leftward and engaged at a predetermined engaging position. When the movable piece 295A pivots rightward to a predetermined movable position, the position detecting sensor 295 outputs a detection signal. The position detecting sensor 295 detects whether the output roller 220 is located at the nip position.

There will be next described, with reference to FIGS. 13 and 14, operations of components of the output unit 200 in the case where the output motor 299 is rotated forwardly. A driving force generated by the output motor 299 rotating forwardly (as indicated by arrow R1) is transmitted by the first coupling mechanism 280 from the output shaft 299A to the output roller 220 via the coupling gears 281, 282, 283, 284, the moving gear 285, and the rotation shaft 285A in this order. It is noted that the driving force generated by the output motor 299 rotating forwardly may be hereinafter referred to as "forward driving force generated by the output motor 299". Thus, when the output motor 299 is rotated forwardly, the output roller 220 is rotated in the counterclockwise direction in bottom view (indicated by arrow R3). This rotational direction of the output roller 220 may be hereinafter referred to as "discharging direction". When the tape comes into contact with the output roller 220 rotating in the discharging direction, the tape is conveyed forward.

The forward driving force generated by the output motor 299 is transmitted by the second coupling mechanism 240 from the output shaft 299A to the coupling gears 281, 282, 283 and the rotation shaft 283A in this order. In this case, the one-way clutch 290 disengages power transmission between the output motor 299 and the rotor 251, so that the forward driving force generated by the output motor 299 is not transmitted from the rotation shaft 283A to the rotor 251. Thus, the rotor 251 is not rotated even when the output motor 299 is rotated forwardly. Accordingly, the printer 1 can rotate the output motor 299 forwardly to rotate the output roller 220 in the discharging direction in a state in which the output roller 220 is kept at its position. That is, the printer 1 can rotate the output motor 299 forwardly to rotate the output roller 220 in the discharging direction without movement of the output roller 220 between the nip position (see FIGS. 13 and 16) and the release position (see FIGS. 14 and 17).

There will be next described, with reference to FIGS. 13, 14, 16, and 17, operations of the components of the output unit 200 in the case where the output motor 299 is rotated reversely. As illustrated in FIGS. 13 and 14, a driving force generated by the output motor 299 rotating reversely (as indicated by arrow R2) is transmitted by the first coupling mechanism 280 from the output shaft 299A to the output roller 220 via the coupling gears 281, 282, 283, 284, the moving gear 285, and the rotation shaft 285A in this order. It is noted that the driving force generated by the output motor 299 rotating reversely may be hereinafter referred to as "reverse driving force generated by the output motor 299". Thus, when the output motor 299 is rotated reversely, the output roller 220 is rotated in the clockwise direction in bottom view, i.e., a direction reverse to the discharging direction (as indicated by arrow R4). This rotational direction of the output roller 220 may be hereinafter referred to as "returning direction".

The reverse driving force generated by the output motor 299 is transmitted by the second coupling mechanism 240 from the output shaft 299A to the coupling gears 281, 282, 283 and the rotation shaft 283A in this order. In this case, the one-way clutch 290 power-transmittably couples the output motor 299 and the rotor 251 to each other, so that the reverse driving force generated by the output motor 299 is transmitted from the rotation shaft 283A to the rotor 251. Thus, when the output motor 299 is rotated reversely, the rotor 251 is rotated about the rotation shaft 283A in the clockwise direction in bottom view. In this case, the eccentric member 252 is rotated about the rotation shaft 283A in the clockwise direction in bottom view.

In this case, as illustrated in FIGS. 16 and 17, the eccentric member 252 presses the protrusion 265 leftward or rightward while moving in the first support hole 266 in the front and rear direction. This operation moves the roller holder 255 leftward or rightward in the guide frame 214 along the guide frame 214. With the leftward or rightward movement of the roller holder 255, inner walls of the respective second support holes 271 (see FIG. 15) or the recessed portion 263 (see FIG. 15) presses the rotation shaft 285A leftward or rightward. The leftward or rightward movement of the rotation shaft 285A moves the output roller 220 between the nip position and the release position. Accordingly, the printer 1 can rotate the output motor 299 reversely to cause the moving mechanism 250 to move the output roller 220 between the nip position (see FIG. 16) and the release position (see FIG. 17).

In the case where the output roller 220 is moved between the nip position and the release position, the rotation shaft 285A is moved along the guide hole 211A while moving in the front and rear direction in the second support holes 271 (see FIG. 15). That is, the rotation shaft 285A is moved along the outer circumferential surface 284B of the coupling gear 284. Thus, when the output roller 220 is moved from the release position to the nip position, the output roller 220 approaches the opposed roller 230 diagonally from a slightly front and left side of the opposed roller 230 (see FIG. 17). The moving gear 285 is moved together with the rotation shaft 285A along the outer circumferential surface 284B of the coupling gear 284. Accordingly, the moving gear 285 is moved in a state in which the moving gear 285 is engaged with the coupling gear 284. Thus, the output roller 220 is moved between the nip position and the release position in a state in which the output motor 299 and the output roller 220 are kept power-transmittably coupled to each other by the first coupling mechanism 280. That is, even when the output roller 220 is located any of the nip position and the release position, the output motor 299 and the output roller 220 are power-transmittably coupled to each other by the first coupling mechanism 280.

When the output roller 220 is located at the nip position, the tape is nipped between the output roller 220 and the opposed roller 230. In the case where no tape is located between the output roller 220 and the opposed roller 230, the output roller 220 is in contact with the opposed roller 230. It is noted that the output roller 220 may be opposed to the opposed roller 230 at a distance less than the thickness of the tape. When the output roller 220 is located at the release position, the output roller 220 is located to the left of and separated from the tape. Hereinafter, a position in the conveying direction at which the tape is nipped between the output roller 220 and the opposed roller 230 may be referred to as "second nipping position P5". A load at which the tape is nipped between the output roller 220 and the opposed roller 230 may be referred to as "nip load at the second nipping position P5". The second nipping position P5 is located downstream of the second cutting position P4 in the conveying direction. The nip load at the second nipping position P5 is less than the nip load at the first nipping position P2.

More specifically, as illustrated in FIG. 17, when the eccentric member 252 is located to the left of the rotation shaft 283A, the eccentric member 252 is located at a left end of a moving area of the eccentric member 252 in the right and left direction. In this case, the roller holder 255 is located at a left end of a moving area of the roller holder 255 in the right and left direction, and the output roller 220 is located at the release position. When the eccentric member 252 is rotated in this state about the rotation shaft 283A in the counterclockwise direction in plan view, the eccentric member 252 presses the protrusion 265 rightward while moving rearward in the first support hole 266. In this case, the first member 260, the second member 270, and the output roller 220 are moved rightward together until the output roller 220 is located at the nip position, i.e., until the output roller 220 is located at the position at which the tape is nipped between the output roller 220 and the opposed roller 230.

In the present embodiment, as illustrated in FIG. 16, before the eccentric member 252 reaches a right end of the moving area of the eccentric member 252 in the right and left direction, the output roller 220 is positioned at the position at which the tape is nipped between the output roller 220 and the opposed roller 230, i.e., the nip position. After the output roller 220 is positioned at the nip position, when the eccentric member 252 is moved to the right end of the moving area of the eccentric member 252 in the right and left direction, the first member 260 is moved rightward. In this case, rightward movement of the second member 270 and the output roller 220 is inhibited by the opposed roller 230. That is, the first member 260 approaches the second member 270 and the output roller 220 against the urging force of the urging member 256. Accordingly, in the case where the eccentric member 252 is moved between the left end and the right end of the moving area of the eccentric member 252 in the right and left direction, an amount of movement of the first member 260 in the right and left direction is greater than an amount of movement of the output roller 220 and the second member 270 in the right and left direction.

In the case where the first member 260 is moved toward the second member 270 and the output roller 220 against the urging force of the urging member 256, the urging force of the urging member 256 for urging the output roller 220 toward the opposed roller 230 increases. This configuration enables the printer 1 to adjust the nip load at the second nipping position P5 in accordance with the position of the eccentric member 252 in the right and left direction. When the output roller 220 is located at the nip position, the distance from the opposed roller 230 to the first member 260 is determined by the thickness of the tape. Increase in the thickness of the tape decreases the distance from the second member 270 to the first member 260 and accordingly increases the urging force of the urging member 256. This configuration enables the printer 1 to change the nip load at the second nipping position P5 in accordance with the thickness of the tape.

As illustrated in FIG. 13, when the output roller 220 is located at the nip position, the larger-diameter portion 253 is located to the right of the rotation shaft 283A. Thus, the urging member 297 is engaged with the recessed portion 253A. In this case, the urging member 297 urges the larger-diameter portion 253 diagonally to a front left side thereof. That is, the urging member 297 urges the rotor 251 in the counterclockwise direction in bottom view. When the rotor 251 is rotated in the clockwise direction in bottom view, the urging member 297 restricts the output roller 220 from moving from the nip position to the release position. The urging force of the urging member 297 is less than a force required to rotate the rotor 251 in the counterclockwise direction in bottom view. Thus, the output roller 220 is kept at the nip position by the urging force of the urging member 297.

When the output roller 220 is located at the release position, the detecting piece 269 is located to the left of and separated from the movable piece 295A (not illustrated). The detecting piece 269 presses the movable piece 295A rightward in a process in which the output roller 220 is moved from the release position to the nip position. When the output roller 220 is moved to the nip position, the movable piece 295A pivots to the movable position while being pressed rightward by the detecting piece 269. In the present embodiment, when the eccentric member 252 is positioned at the right end of the moving area of the eccentric member 252 in the right and left direction, the detecting piece 269 is located at a right end of a moving area of the detecting piece 269 in the right and left direction. In this case, the movable piece 295A is located at the movable position. This configuration enables the position detecting sensor 295 to detect whether the output roller 220 is located at the nip position by detecting whether the detecting piece 269 (i.e., the first member 260) is located at the right end of the moving area of the detecting piece 269 in the right and left direction.

Figure 18:
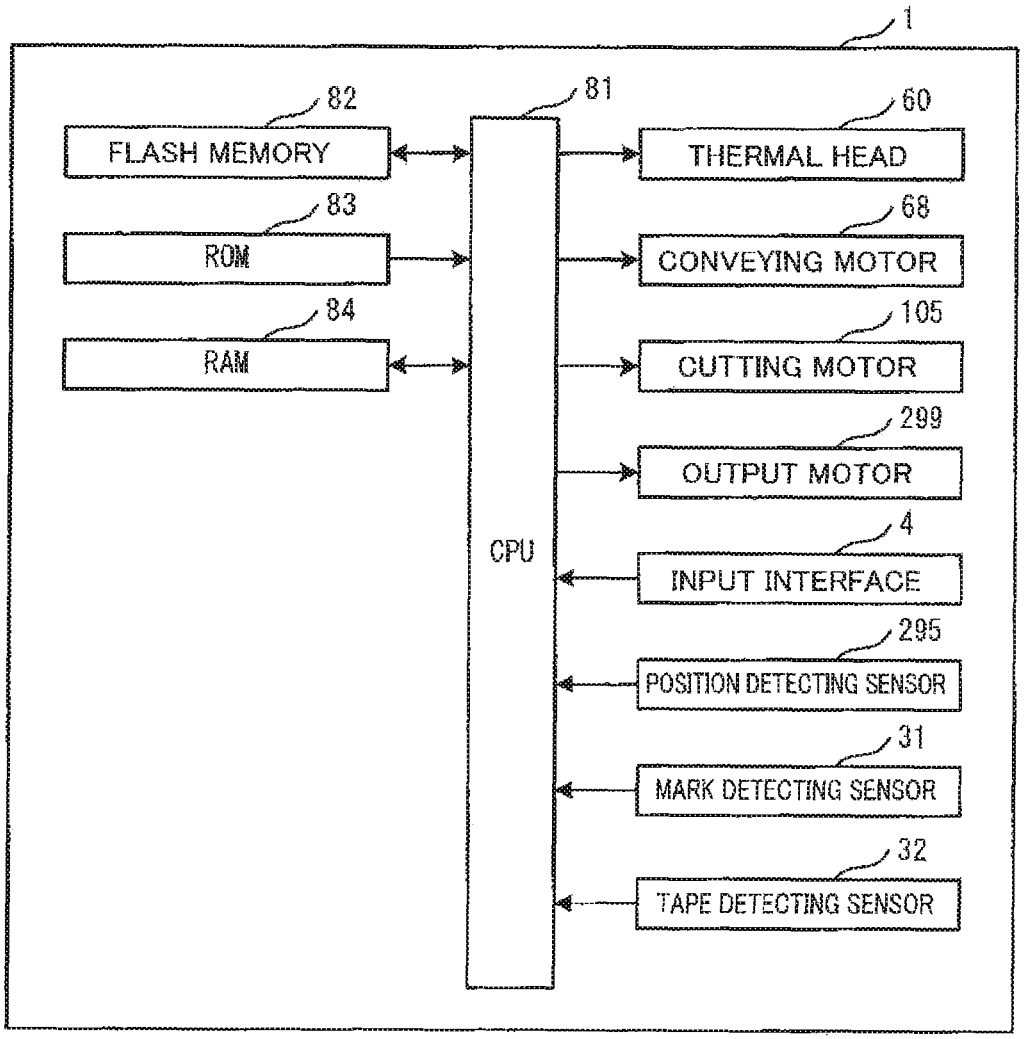
FIG. 18 is a block diagram illustrating an electric configuration of the printer.

There will be next described an electric configuration of the printer 1 with reference to FIG. 18. The printer 1 includes a CPU 81. The CPU 81 serves as a processor configured to control the printer 1 and execute a main process which will be described below. Devices connected to the CPU 81 include a flash memory 82, a ROM 83, a RAM 84, the thermal head 60, the conveying motor 68, the cutting motor 105, the output motor 299, the input interface 4, the position detecting sensor 295, the mark detecting sensor 31, and a tape detecting sensor 32. The flash memory 82 is a nonvolatile storage medium that stores programs for the CPU 81 to execute the main process, for example. The ROM 83 is a nonvolatile storage medium that stores various parameters required for the CPU 81 to execute various programs. The RAM 84 is a volatile storage medium that stores temporal data such as data relating to a timer and a counter.

The tape detecting sensor 32 is disposed downstream of the tape driving shaft 61 and the conveying roller 66 in the conveying direction and upstream of the output roller 220 in the conveying direction. The tape detecting sensor 32 is a photo sensor of a transmission type and detects whether there is a tape at a predetermined detecting position, not illustrated, between the first nipping position P2 and the second nipping position P5 in the conveying direction. The tape detecting sensor 32 outputs a detection signal when the tape is present at the detecting position.

There will be next described the main process with reference to FIGS. 19-24. After establishing the printing prepared state of the printer 1, the user turns on a power source of the printer 1. When the power source of the printer 1 is turned on, the CPU 81 starts the main process by transferring the program stored in the flash memory 82 to the RAM 84.

Figure 19:
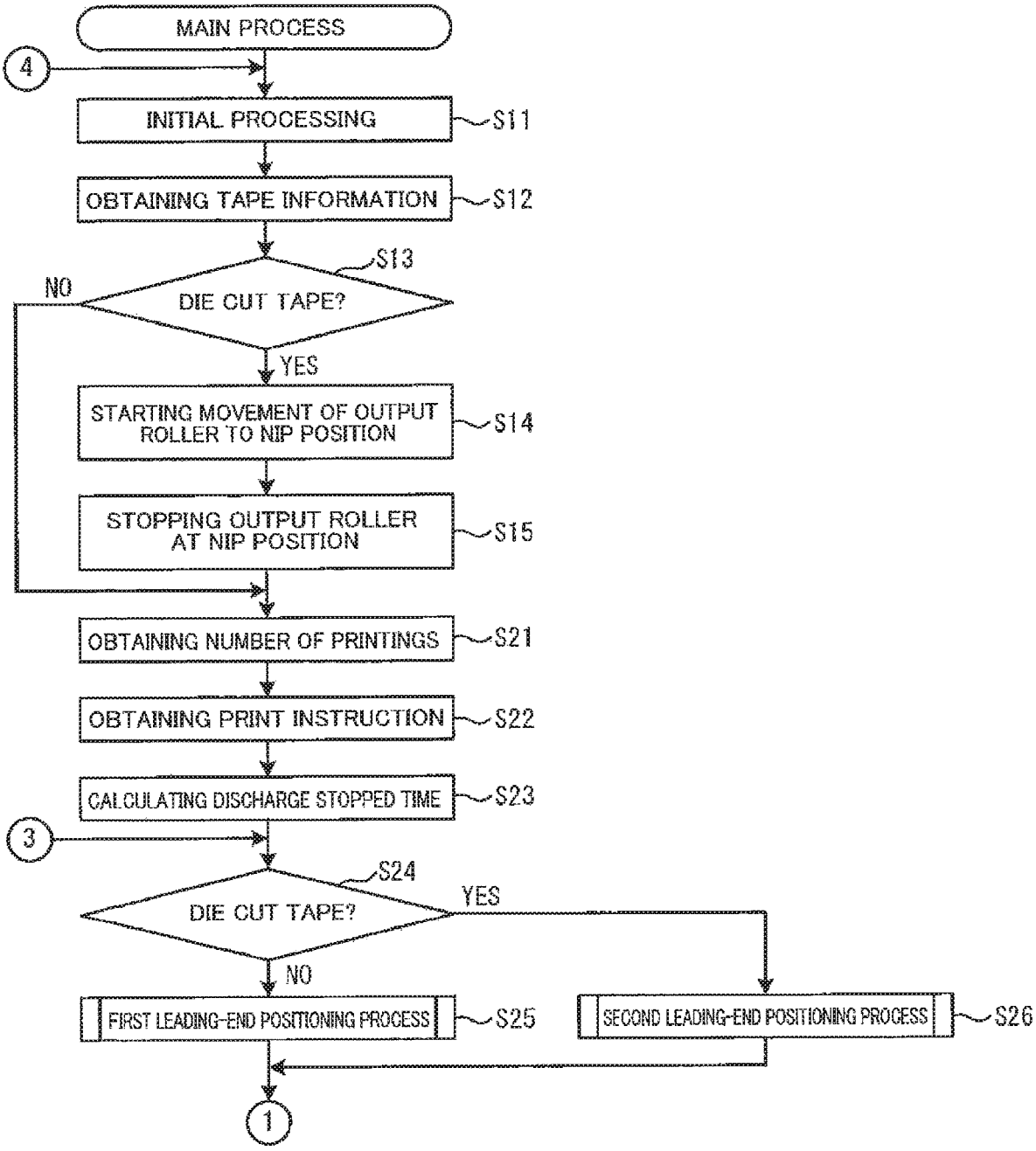
FIG. 19 is a flowchart representing a portion of a main process.

As illustrated in FIG. 19, the flow of the main process begins with S11 at which the CPU 81 executes an initial processing. In the initial processing, the CPU 81 controls the cutting motor 105 to change the cutting unit 100 to the initial state. The CPU 81 changes the output unit 200 to the initial state by rotating the output motor 299 reversely. In the case where the output unit 200 is in the initial state, the output roller 220 is located at the release position. The CPU 81 determines that the output unit 200 is in the initial state, by detecting that no detection signal is output from the position detecting sensor 295. It is noted that a state in which the output roller 220 is located at the nip position may be an initial state of the output unit 200. The CPU 81 clears information stored in the RAM 84. In particular, the CPU 81 sets a value K of a number-of-performed-printings counter to zero. The number-of-performed-printings counter is stored in the RAM 84 and indicates the number of the printing operations performed.

The CPU 81 obtains tape information at S12. The tape information indicates a type of the tape such as the receptor tape 5, the die cut tape 9, the thermal tape, the transparent film tape, and the double-sided adhesive tape. The user operates the input interface 4 to input the tape information in accordance with the type of the tape stored in a cassette to be used. The obtained tape information is stored into the RAM 84.

The CPU 81 at S13 determines whether the tape indicated by the obtained tape information is the die cut tape 9. When the tape is not the die cut tape 9 (S13: NO), this flow goes to S21.

The die cut tape 9 is different in thickness between its portions having the substrates 91 and its portions not having the substrates 91 in the longitudinal direction of the die cut tape 9, i.e., the conveying direction. Thus, a step is formed in the die cut tape 9 at a position between each of the portions having the substrates 91 and a corresponding one of the portions not having the substrates 91. Thus, in the case where a distal end of the die cut tape 9 (i.e., a downstream end portion of the die cut tape 9 in the conveying direction) pivots in the thickness direction in a state in which the cassette is mounted on the mount portion 6, there is a possibility that the cutting edge 179C of the fixed blade 179 contacts the step of the die cut tape 9, for example. Since the adhesive layers 93 are present at the step of the die cut tape 9, if the cutting edge 179C of the fixed blade 179 contacts the adhesive layer 93, for example, there is a possibility that the substrate 91 is peeled off from the release paper sheet 92. There is a possibility that the die cut tape 9 is unintentionally discharged by its own weight from the cassette without the printer 1 rotating the conveying motor 68 in the forward-conveyance direction.

When the tape is the die cut tape 9 (S13: YES), the CPU 81 at S14 starts rotating the output motor 299 reversely to start moving the output roller 220 to the nip position (see FIG. 16). When a detection signal is received from the position detecting sensor 295, the CPU 81 at S15 stops the reverse rotation of the output motor 299 to stop the output roller 220 at the nip position. Thus, the die cut tape 9 is nipped between the output roller 220 and the opposed roller 230, thereby reducing pivotal movement of the distal end of the die cut tape 9. This reduces peeling of the substrate 91 off from the release paper sheet 92 in the die cut tape 9. Also, since the die cut tape 9 is nipped between the output roller 220 and the opposed roller 230, it is possible to restrict the die cut tape 9 from moving downstream in the conveying direction at the second nipping position P5. This reduces unintentional discharge of the die cut tape 9 from the cassette. As described above, the position detecting sensor 295 outputs a detection signal when the output roller 220 is located at the nip position. This configuration enables the CPU 81 to reliably stop the output roller 220 at the nip position based on the detection signal output from the position detecting sensor 295.

The CPU 81 at S21 obtains the number of printings. The number of printings indicates the number of the printing operations to be performed repeatedly. The user operates the input interface 4 to input the number of printings. The obtained number of printings is stored into the RAM 84. The CPU 81 at S22 obtains a print instruction. The user operates the input interface 4 to input the print instruction. The print instruction contains print data. The CPU 81 at S23 calculates a discharge stopped time based on the print data. The discharge stopped time is a difference between a predetermined reference time and a printing time required from the start of the printing operation to the end (or a stop) of the printing operation. The length of the reference time is less than that of a motor driving time. The motor driving time is a length of time for which the output motor 299 is rotated reversely to move the output roller 220 from the nip position to the release position. That is, the motor driving time is a length of time in which the output motor 299 is rotated reversely to move the eccentric member 252 from the right end to the left end (or from the left end to the right end) of the moving area of the eccentric member 252 in the right and left direction. The reference time and the motor driving time are stored in the ROM 83. It is noted that the reference time may be changed as long as the reference time is less than the motor driving time. The calculated discharge stopped time is stored into the RAM 84.

The CPU 81 at S24 determines whether the tape indicated by the tape information obtained at S12 is the die cut tape 9. When the tape is not the die cut tape 9 (S24: NO), the CPU 81 executes a first leading-end positioning process at S25. When the tape is the die cut tape 9 (S24: YES), the CPU 81 executes a second leading-end positioning process at S26. Upon completion of the first leading-end positioning process or the second leading-end positioning process, this flow goes to S61 (see FIG. 20).

Figure 22:
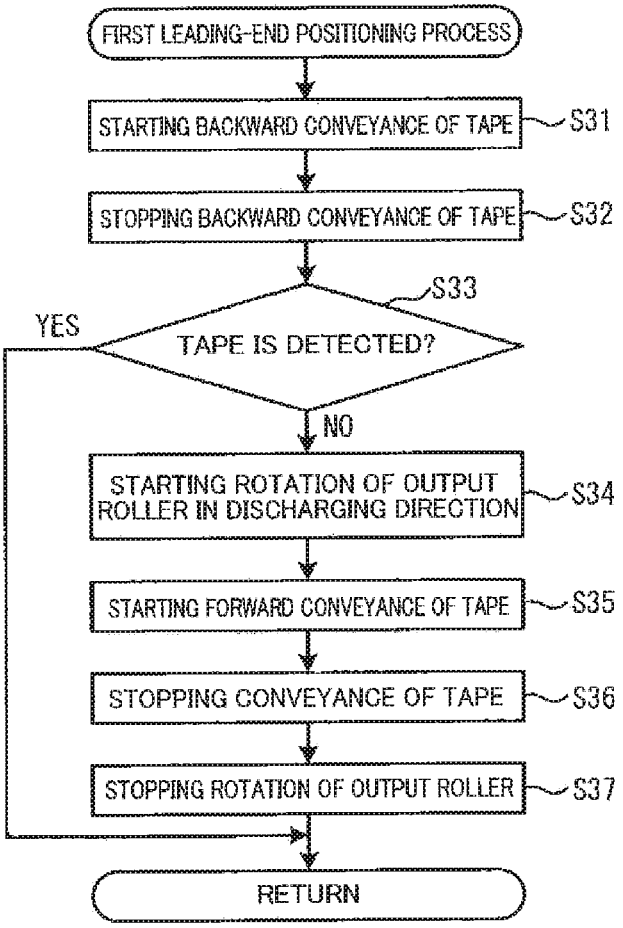
FIG. 22 is a flowchart representing a first leading-end positioning process.

There will be next described the first leading-end positioning process with reference to FIG. 22. In the first leading-end positioning process, the leading-end positioning is performed for a tape different from the die cut tape 9, such as the receptor tape 5, the thermal tape, the stencil tape, and the laminate tape.

The CPU 81 at S31 starts conveying the tape backward by starting rotation of the conveying motor 68 in the backward-conveyance direction. This operation reduces the length of a portion of the tape which is located downstream of the thermal head 60 in the conveying direction. When the tape is conveyed backward by a predetermined amount by the backward-conveyance operation, the CPU 81 at S32 stops the rotation of the conveying motor 68 to stop the backward conveyance of the tape. The CPU 81 at S33 determines whether the tape is present at the detecting position, based on the detection signal output from the tape detecting sensor 32. When the leading end of the tape (i.e., the downstream end portion of the tape in the conveying direction) is located downstream of the detecting position in the conveying direction, the tape detecting sensor 32 outputs a detection signal (S33: YES). In this case, this flow returns to the main process (see FIG. 19).

When the leading end of the tape is located upstream of the detecting position in the conveying direction, the tape detecting sensor 32 does not output the detection signal (S33: NO). In this case, the CPU 81 at S34 starts rotating the output motor 299 forwardly to start rotation of the output roller 220 in the discharging direction. As a result, the output roller 220 is rotated in the discharging direction (indicated by arrow R3) in the state in which the output roller 220 is kept at the release position (see FIG. 17). Even if the tape comes into contact with the output roller 220 in this state, the tape is nipped at the first nipping position P2 and thus not conveyed forward.

The CPU 81 at S35 starts conveying the tape forward by starting rotation of the conveying motor 68 in the forward-conveyance direction. Even if the tape comes into contact with the output roller 220 in this state, the forward conveyance of the tape is not interfered (see FIG. 17) because the output roller 220 is being rotated in the discharging direction (indicated by arrow R3). When the detection signal is obtained from the tape detecting sensor 32, the CPU 81 at S36 stops the rotation of the conveying motor 68 to stop the forward conveyance of the tape. As a result, the leading end of the tape is positioned at the detecting position for the tape detecting sensor 32 or a position located downstream of the detecting position in the conveying direction. The CPU 81 at S37 stops the forward rotation of the output motor 299 to stop the rotation of the output roller 220, and this flow returns to the main process.

The first leading-end positioning process reduces the length of a portion of the tape which is located downstream of the printing position P1 in the conveying direction. This reduces the area of a portion of the tape on which no characters are printed. Also, the leading end of the tape is positioned at least at the detecting position for the tape detecting sensor 32 or a position located downstream of the detecting position in the conveying direction. The detecting position is located downstream of the first nipping position P2 in the conveying direction. This configuration reduces failures of conveyance of the tape due to the tape being not nipped at the first nipping position P2.

Figure 23:
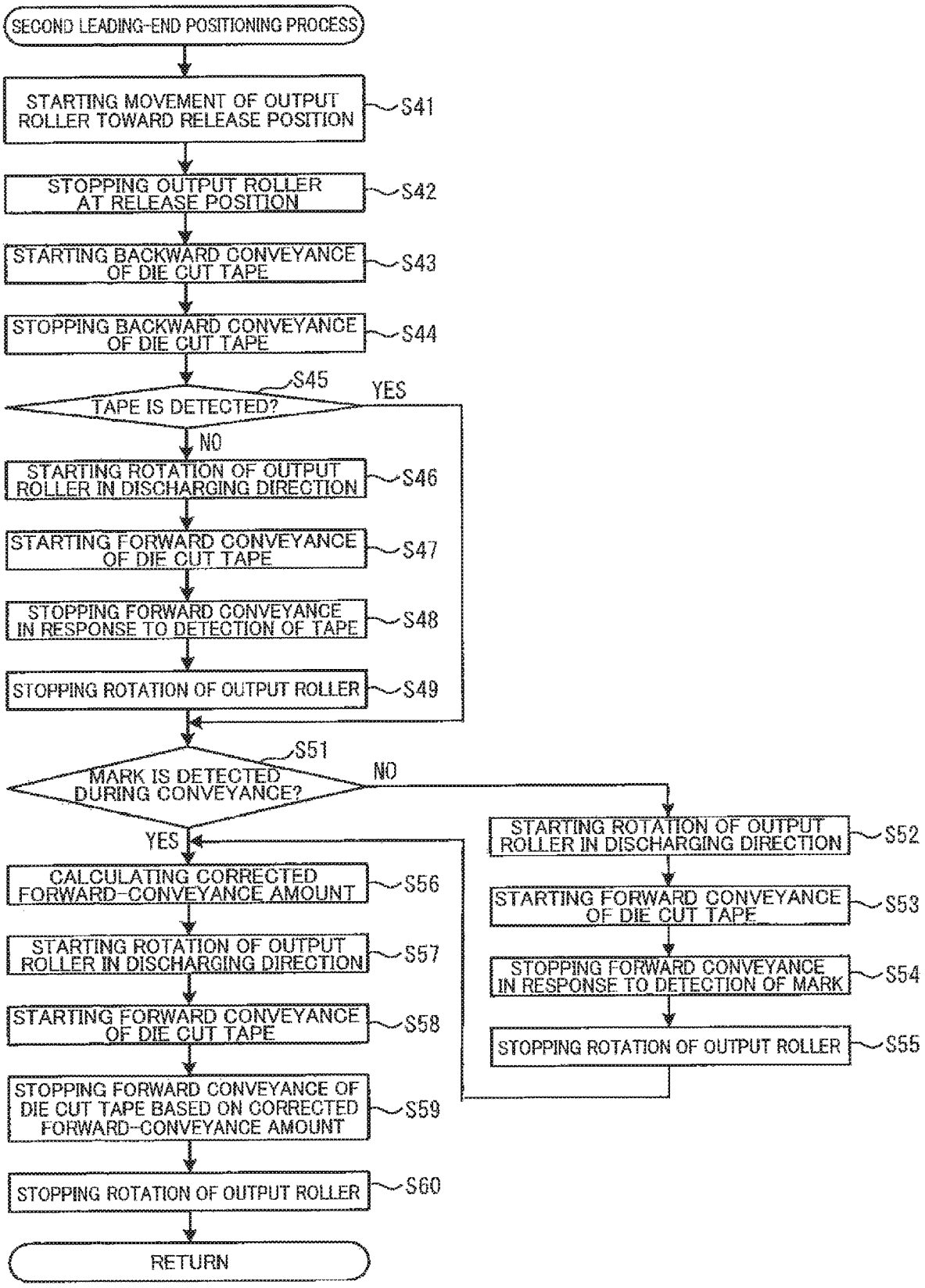
FIG. 23 is a flowchart representing a second leading-end positioning process.

There will be next described the second leading-end positioning process with reference to FIG. 23. In the second leading-end positioning process, leading-end positioning of the die cut tape 9 is performed. In the following description, processings of the second leading-end positioning process which are different from the first leading-end positioning process will be mainly explained.

The CPU 81 at S41 starts rotating the output motor 299 reversely to start movement of the output roller 220 to the release position. When the output motor 299 is rotated reversely for the motor driving time, the CPU 81 at S42 stops the reverse rotation of the output motor 299 to stop the output roller 220 at the release position. It is noted that a stepping motor may be employed for the output motor 299. In this case, the CPU 81 controls an amount of rotation of the output motor 299 rotating reversely from the timing when the output roller 220 is located at the nip position, whereby the output roller 220 is stopped at the release position.

The processings at S43-S49 are the same as those at S31-S37, respectively. The CPU 81 at S51 determines whether any of the marks 99 is detected by the mark detecting sensor 31 during conveyance of the die cut tape 9, i.e., during the backward conveyance of the die cut tape 9 (S43, S44) or the forward conveyance of the die cut tape 9 (S47, S48). Upon detecting the mark 99, the mark detecting sensor 31 outputs a detection signal. When the detection signal is obtained from the mark detecting sensor 31 during conveyance of the die cut tape 9 (S51: YES), this flow goes to S56.

When no detection signal is obtained from the mark detecting sensor 31 during conveyance of the die cut tape 9 (S51: NO), the CPU 81 at S52 starts rotating the output motor 299 forwardly to start rotation of the output roller 220 in the discharging direction. As a result, the output roller 220 is rotated in the discharging direction (indicated by arrow R3) in the state in which the output roller 220 is kept at the release position (see FIG. 17). The CPU 81 at S53 starts conveying the die cut tape 9 forward by starting rotation of the conveying motor 68 in the forward-conveyance direction. When the detection signal is obtained from the mark detecting sensor 31, the CPU 81 at S54 stops rotating the conveying motor 68 in the forward-conveyance direction to stop the forward conveyance of the die cut tape 9. The CPU 81 at S55 stops the forward rotation of the output motor 299 to stop the rotation of the output roller 220.

The CPU 81 at S56 calculates a corrected forward-conveyance amount. The corrected forward-conveyance amount is an amount of forward conveyance of the die cut tape 9 for positioning one of the substrates 91 of the die cut tape 9 to the printing position P1. In the die cut tape 9, the substrates 91 are spaced uniformly, and the marks 99 are spaced uniformly at the same intervals as those of the substrates 91. This configuration enables the CPU 81 to calculate the corrected forward-conveyance amount with respect to a position of the die cut tape 9 in the conveying direction at the timing when the mark 99 is detected by the mark detecting sensor 31. The calculated corrected forward-conveyance amount is stored into the RAM 84.

The CPU 81 at S57 starts rotating the output motor 299 forwardly to start rotation of the output roller 220 in the discharging direction. As a result, the output roller 220 is rotated in the discharging direction (indicated by arrow R3) in the state in which the output roller 220 is kept at the release position (see FIG. 17). The CPU 81 at S58 starts conveying the die cut tape 9 forward by starting rotation of the conveying motor 68 in the forward-conveyance direction. When the die cut tape 9 is conveyed forward by the corrected forward-conveyance amount calculated at S56, the CPU 81 at S59 stops the rotation of the conveying motor 68 to stop the forward conveyance of the die cut tape 9. As a result, the substrate 91 of the die cut tape 9 is positioned at the printing position P1. This configuration prevents printing of characters on a portion of the die cut tape 9 between adjacent two of the substrates 91 (i.e., the release paper sheet 92). The CPU 81 at S60 stops the forward rotation of the output motor 299 to stop the rotation of the output roller 220, and this flow returns to the main process (see FIG. 19).

Figure 20:
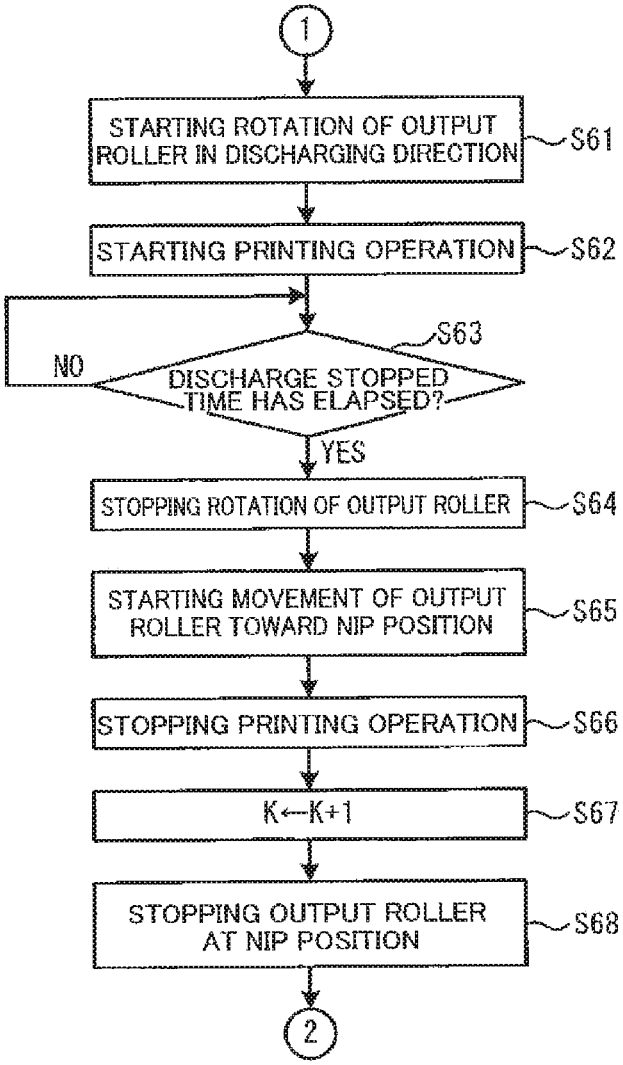
FIG. 20 is a flowchart representing another portion of the main process which is continued from FIG. 19.

As illustrated in FIG. 20, the CPU 81 at S61 starts rotating the output motor 299 forwardly to start rotation of the output roller 220 in the discharging direction. As a result, the output roller 220 is rotated in the discharging direction (indicated by arrow R3) in the state in which the output roller 220 is kept at the release position (see FIG. 17). The CPU 81 at S62 starts the printing operation in this state. Specifically, the CPU 81 starts rotating the conveying motor 68 in the forward-conveyance direction. The CPU 81 controls the thermal head 60 to selectively heat its heating elements, so that characters are printed line by line on the tape being conveyed forward.

The CPU 81 at S63 determines whether the discharge stopped time calculated at S23 has elapsed from the start of the printing operation at S62. When the discharge stopped time has not elapsed (S63: NO), the CPU 81 waits until the discharge stopped time has elapsed. When the discharge stopped time has elapsed (S63: YES), the CPU 81 at S64 stops the forward rotation of the output motor 299 to stop the rotation of the output roller 220. As a result, the rotation of the output roller 220 in the discharging direction is stopped when the printing operation is being performed. The CPU 81 at S65 starts rotating the output motor 299 reversely to start moving the output roller 220 toward the nip position (see FIG. 16). That is, movement of the output roller 220 toward the nip position is started when the printing operation is being performed. Since the length of the reference time is less than that of the motor driving time, the output roller 220 does not reach the nip position during the printing operation.

The CPU 81 at S66 stops the printing operation. Specifically, the CPU 81 stops controlling the thermal head 60 and then stops the rotation of the conveying motor 68. As a result, printing of the tape is stopped, and then the forward conveyance of the tape is stopped. More specifically, when the full-cut operation is to be performed after the printing operation, the CPU 81 stops the forward conveyance of the tape such that the tape is positioned at the first cutting position P3. When the partial-cut operation is to be performed after the printing operation, the CPU 81 stops the forward conveyance of the tape such that the tape is positioned at the second cutting position P4. In the case where the tape is the die cut tape 9, when the full-cut operation is to be performed after the printing operation, the CPU 81 can specify a position of the mark 99 in the conveying direction based on the detection signal output from the mark detecting sensor 31. The CPU 81 stops the forward conveyance of the die cut tape 9 based on the specified position of the mark 99 in the conveying direction such that a portion of the die cut tape 9 which is located between adjacent two of the substrates 91 is located at the first cutting position P3.

The CPU 81 at S67 adds one to the value K of the number-of-performed-printings counter. When a detection signal is received from the position detecting sensor 295, the CPU 81 at S68 stops the reverse rotation of the output motor 299 to stop the output roller 220 at the nip position.

Figure 21:
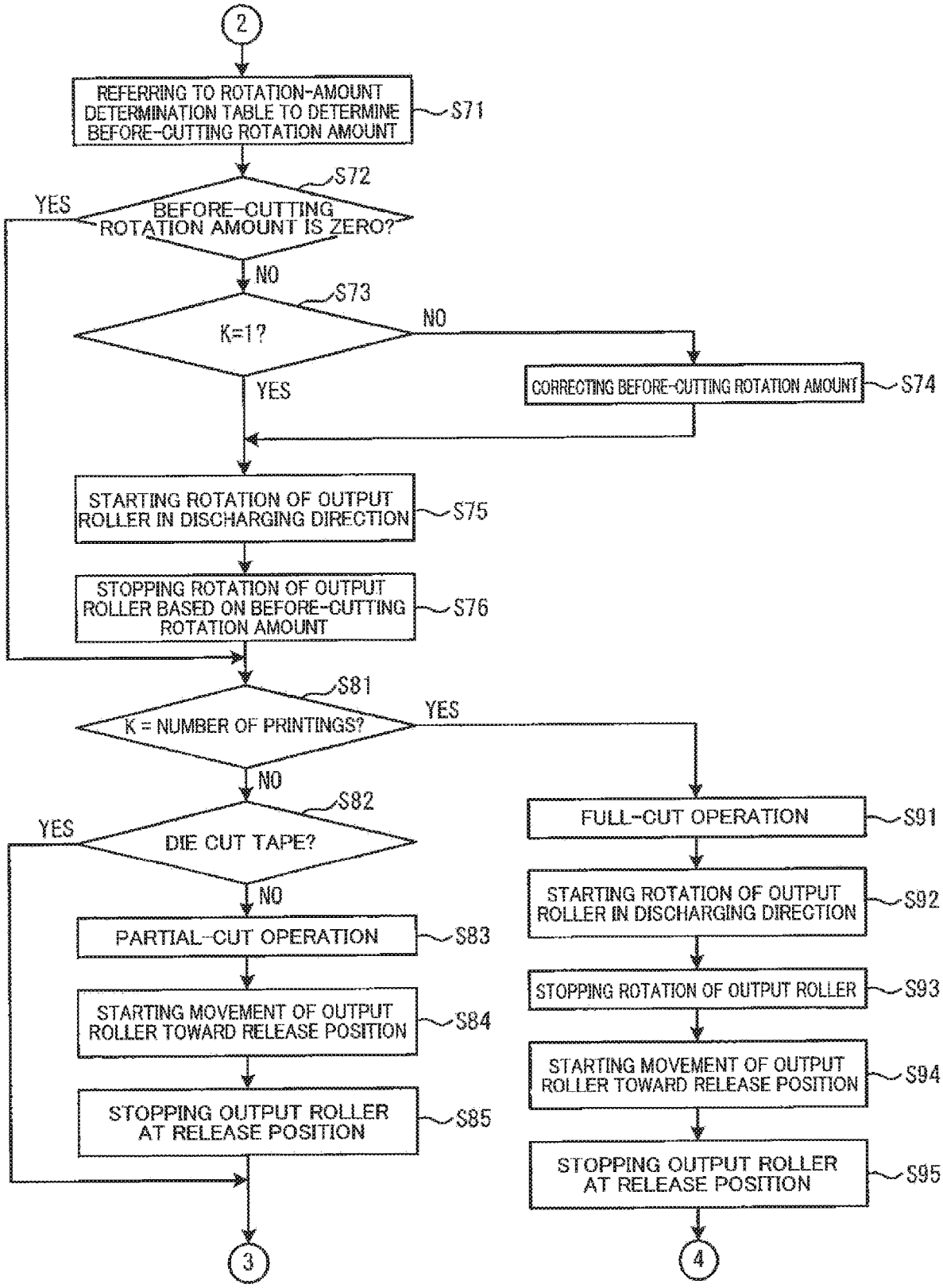
FIG. 21 is a flowchart representing yet another portion of the main process which is continued from FIG. 20.

As illustrated in FIG. 21, the CPU 81 at S71 refers to a rotation-amount determination table 30 (see FIG. 24) to determine a before-cutting rotation amount of the output roller 220. The before-cutting rotation amount of the output roller 220 is an amount of rotation of the output roller 220 at S75 and S76 which will be described below.

As illustrated in FIG. 24, the rotation-amount determination table 30 stores a relationship between each type of the tape and the before-cutting rotation amount of the output roller 220. In FIG. 24, the before-cutting rotation amount of the output roller 220 is represented as "LARGE", "MEDIUM", "SMALL", and "ZERO" for easy understanding. The before-cutting rotation amounts of the output roller 220 are set such that "LARGE" is greater than "MEDIUM", and "MEDIUM" is greater than "SMALL". "SMALL" is greater than zero. "ZERO" indicates that the before-cutting rotation amount of the output roller 220 is zero, that is, "ZERO" indicates that the CPU 81 does not execute control for rotating the output roller 220.

In the present embodiment, "LARGE" is associated with the receptor tape 5 and the thermal tape. "MEDIUM" is associated with the laminate tape. "SMALL" is associated with the stencil tape. "ZERO" is associated with the die cut tape 9. That is, the before-cutting rotation amount of the output roller 220 increases with increase in easiness of bending of the tape except the die cut tape 9 in the rotation-amount determination table 30. At S71, the CPU 81 refers to the rotation-amount determination table 30 to determine the before-cutting rotation amount of the output roller 220 which corresponds to the type of the tape based on the tape information obtained at S12. The determined before-cutting rotation amount of the output roller 220 is stored into the RAM 84.

As illustrated in FIG. 21, the CPU 81 at S72 determines whether the before-cutting rotation amount of the output roller 220 is determined to "ZERO" at S71. For example, in the case where the tape is the die cut tape 9, the before-cutting rotation amount of the output roller 220 is determined to "ZERO" (S72: YES). In this case, this flow goes to S81.

For example, in the case where the tape is any of the receptor tape 5, the thermal tape, the stencil tape, and the laminate tape, the before-cutting rotation amount of the output roller 220 is not determined to "ZERO" (S72: NO). In this case, the CPU 81 at S73 determines whether the value K of the number-of-performed-printings counter is "1". As described above, the value K of the number-of-performed-printings counter is at S67 incremented by one each time when one printing operation is performed (see FIG. 20). Thus, the value K of the number-of-performed-printings counter is "1" after the end of the first printing operation and before the start of the second printing operation (S73: YES). In this case, this flow goes to S75.

After the second printing operation is performed, the value K of the number-of-performed-printings counter is greater than or equal to "2" (S73: NO). In this case, the CPU 81 at S74 corrects the before-cutting rotation amount of the output roller 220. Specifically, the CPU 81 changes the before-cutting rotation amount of the output roller 220 from the before-cutting rotation amount determined at S71 to a rotation amount that is smaller than the determined before-cutting rotation amount by a particular amount. Particular amounts corresponding respectively to "LARGE", "MEDIUM", and "SMALL" are stored in the ROM 83 in advance. The particular amounts corresponding respectively to "LARGE", "MEDIUM", and "SMALL" are respectively less than the before-cutting rotation amounts corresponding respectively to "LARGE", "MEDIUM", and "SMALL". The corrected rotation amount is stored into the RAM 84 as the before-cutting rotation amount of the output roller 220.

The CPU 81 at S75 starts rotating the output motor 299 forwardly to start rotation of the output roller 220 in the discharging direction. As a result, the output roller 220 is rotated in the discharging direction (indicated by arrow R3) in the state in which the output roller 220 is kept at the nip position (see FIG. 16). In this case, since the nip load at the second nipping position P5 is less than the nip load at the first nipping position P2, the tape is not conveyed forward. The tape is tensioned downstream in the conveying direction. Thus, even if the tape is nipped at S68 (see FIG. 20) between the output roller 220 and the opposed roller 230 in a state in which there are wrinkles in the tape, the wrinkles in the tape are removed. As a result, the widthwise direction of the tape coincides with the up and down direction, enabling the printer 1 to accurately cut the tape at S83 or S91 which will be described below. In the case of the die cut tape 9, as described above, the processings at S75 and S76 are not executed for the following reasons. Since a portion of the release paper sheet 92 which is located between adjacent two of the substrates 91 is cut in the die cut tape 9, there is no need to accurately cut the die cut tape 9. That is, even if there are wrinkles in the die cut tape 9, there is no need to remove the wrinkles.

When the output roller 220 is rotated by the before-cutting rotation amount determined at S71 or corrected at S74 (i.e., the before-cutting rotation amount stored in the RAM 84), the CPU 81 at S76 stops the forward rotation of the output motor 299 to stop the rotation of the output roller 220.

The CPU 81 at S81 determines whether the value K of the number-of-performed-printings counter is equal to the number of printings which is obtained at S21 (see FIG. 19). Before the printing operations corresponding to the number of printings are finished, the value K of the number-of-performed-printings counter is less than the number of printings (S81: NO). In this case, the CPU 81 at S82 determines whether the type of the tape indicated by the tape information obtained at S12 (see FIG. 19) is the die cut tape 9. When the tape is the die cut tape 9 (S82: YES), this flow returns to S24 (see FIG. 19).

When the tape is not the die cut tape 9 (S82: NO), the CPU 81 at S83 controls the cutting motor 105 to perform the partial-cut operation. As a result, the tape is partially cut in the state in which the tape is nipped between the output roller 220 and the opposed roller 230. The CPU 81 at S84 starts rotating the output motor 299 reversely to start movement of the output roller 220 to the release position. When the output motor 299 is rotated reversely for the motor driving time, the CPU 81 at S85 stops the reverse rotation of the output motor 299 to stop the output roller 220 at the release position, and this flow returns to S24. Thus, the processings at S24-S76 are repeated until the value K of the number-of-performed-printings counter becomes equal to the number of printings, i.e., until the printing operations corresponding to the number of printings are finished.

When the CPU 81 at S81 determines that the printing operations corresponding to the number of printings are finished, the value K of the number-of-performed-printings counter is equal to the number of printings (S81: YES). In this case, the CPU 81 at S91 controls the cutting motor 105 to perform the full-cut operation. As a result, the tape is fully cut in the state in which the tape is nipped between the output roller 220 and the opposed roller 230. Since the second nipping position P5 is located downstream of the first cutting position P3 in the conveying direction, the cut tape (i.e., a portion of the tape which is separated from a tape-roll-side portion of the tape) is held between the output roller 220 and the opposed roller 230. The CPU 81 at S92 starts rotating the output motor 299 forwardly to start rotation of the output roller 220 in the discharging direction. As a result, the output roller 220 is rotated in the discharging direction (indicated by arrow R3) in the state in which the output roller 220 is kept at the nip position (see FIG. 16). This rotation conveys the cut tape forward to discharge the tape from the output opening 11 to the outside of the printer 1.

Based on the length of the cut tape, the CPU 81 at S93 stops the forward rotation of the output motor 299 to stop the rotation of the output roller 220. Specifically, in the case where an upstream end portion of the cut tape in the conveying direction is positioned at the second nipping position P5, the CPU 81 stops the forward rotation of the output motor 299. As a result, the upstream end portion of the cut tape in the conveying direction is nipped between the output roller 220 and the opposed roller 230. Thus, a leading end of the cut tape (i.e., a downstream end portion of the cut tape in the conveying direction) is kept protruding from the output opening 11 without the cut tape falling from the output opening 11 to the outside of the printer 1.

The CPU 81 at S94 starts rotating the output motor 299 reversely to start movement of the output roller 220 to the release position. When the output motor 299 is rotated reversely for the motor driving time, the CPU 81 at S95 stops the reverse rotation of the output motor 299 to stop the output roller 220 at the release position. As a result, the cut tape falls from the output opening 11 to the outside of the printer 1. It is noted that the user may take the cut tape after the processing at S93 and before the processing at S94, the user may take the cut tape in a state in which the leading end of the cut tape (i.e., the downstream end portion of the cut tape in the conveying direction) protrudes from the output opening 11. Upon completion of the processing at S95, this flow returns to S11 (see FIG. 19).

The printer 1 described above includes the conveying roller 66, the thermal head 60, the output roller 220, the opposed roller 230, and the moving mechanism 250. The conveying roller 66 conveys the tape forward and backward. The thermal head 60 prints an image on the tape conveyed by the conveying roller 66. The output roller 220 is provided downstream of the conveying roller 66 in the conveying direction. The opposed roller 230 is opposed to the output roller 220. The moving mechanism 250 moves the output roller 220 to any of the nip position and the release position. The tape is nipped between the output roller 220 and the opposed roller 230 at the nip position. The output roller 220 is separated from the tape at the release position. The CPU 81 at S31 and S43 controls the conveying roller 66 to perform the backward-conveyance operation in the state in which the output roller 220 is located at the release position.

With this configuration, in the case where the backward-conveyance operation is performed, the tape is not nipped between the output roller 220 and the opposed roller 230. Thus, no load acts on the tape between the output roller 220 and the opposed roller 230 even when the backward-conveyance operation is performed. This reduces damage to the tape when the tape is conveyed backward.

The CPU 81 at S22 obtains the print instruction. The CPU 81 at S62 controls the thermal head 60 to perform the printing operation when the print instruction is accepted. Before the print instruction is accepted, the CPU 81 at S14 and S15 controls the moving mechanism 250 to move the output roller 220 to the nip position. When the print instruction is accepted, the CPU 81 at S41 and S42 controls the moving mechanism 250 to move the output roller 220 to the release position before the printing operation is performed by the thermal head 60. When the output roller 220 is moved to the release position, the CPU 81 at S43 executes the backward-conveyance operation before the printing operation is performed by the thermal head 60. With this configuration, the tape is nipped between the output roller 220 and the opposed roller 230 while the output roller 220 is located at the nip position. This reduces contact of the tape with the other components due to movement of the tape before the start of printing. Thus, it is possible to reduce damage to the tape before the start of printing.

The CPU 81 obtains the tape information at S12. The CPU 81 at S41 and S42 moves the output roller 220 to the nip position based on the obtained tape information. There is a case where the tape need not be nipped between the output roller 220 and the opposed roller 230 before the start of the printing operation. One example of this case is a case where a tape not easily bent is used. In such a case, the printer 1 may be configured not to move the output roller 220 to the nip position. This configuration reduces power consumption of the printer 1.

The CPU 81 accepts the print instruction at S22. The CPU 81 at S62 performs the printing operation when the print instruction is accepted. The CPU 81 moves the output roller 220 to the release position in the initial processing. Thus, when the print instruction is accepted, the output roller 220 is located at the release position. When the print instruction is accepted, the CPU 81 at S31 and S32 controls the backward-conveyance operation before the printing operation is performed. With this configuration, the output roller 220 is located at the release position at the time when the print instruction is accepted. Thus, it is possible to reduce a time extending from acceptance of the print instruction to the start of the backward-conveyance operation.

In the above-described embodiment, the tape is one example of the printing medium. The conveying roller 66 is one example of the conveyor. The thermal head 60 is one example of the printing device. The output roller 220 is one example of the roller. The opposed roller 230 is one example of the opposed member. The output roller 220 is one example of a moving member. The nip position is one example of a first position. The release position is one example of a second position. The moving mechanism 250 is one example of a moving mechanism. Each of the processing at S31 in FIG. 22 and the processing at S43 in FIG. 23 is one example of a conveyor-backward-conveyance processing.

The processing at S22 in FIG. 19 is one example of a first obtainment processing. The processing at S62 in FIG. 20 is one example of a print processing. Each of the processings at S14 and S15 in FIG. 19 is one example of a first movement processing. Each of the processings at S41 and S42 in FIG. 23 is one example of a second movement processing. The tape information is one example of medium information. The processing at S12 in FIG. 19 is one example of a second obtainment processing.

While the embodiment has been described above, it is to be understood that the disclosure is not limited to the details of the illustrated embodiment, but may be embodied with various changes and modifications, which may occur to those skilled in the art, without departing from the spirit and scope of the disclosure. For example, in the above-described embodiment, in the case where the output roller 220 is moved between the nip position and the release position, the rotation shaft 285A is moved along the outer circumferential surface 284B of the coupling gear 284. In contrast, in the case where the output roller 220 is moved between the nip position and the release position, the rotation shaft 285A may not be moved along the outer circumferential surface 284B. There will be described an output unit 200A in a first modification with reference to FIG. 25 by way of example. It is noted that the same reference numerals and numbers as used in the above-described embodiment are used to designate the corresponding elements and numbers in the following modifications, and an explanation of which is dispensed with or simplified. Elements of the printer 1 other than the output unit 200A are the same between the first modification and the above-described embodiment. It is noted that the elements of the printer 1 other than the output unit 200A are also the same between the above-described embodiment and each of second to fifth modifications which will be described below.

The output unit 200A is different from the output unit 200 in the above-described embodiment in that the output unit 200A includes a first coupling mechanism 280A instead of the first coupling mechanism 280. The first coupling mechanism 280A is provided at a lower portion of the output unit 200A and configured to power-transmittably couple the output motor 299 and the output roller 220 to each other. The first coupling mechanism 280A includes the coupling gears 281-284, the moving gear 285, the rotation shaft 285A, and a coupling gear 286. The rotation axis of each of the coupling gears 281-284, 286 and the moving gear 285 extends in the up and down direction.

The coupling gear 286 is provided at a rear of the coupling gear 283. The coupling gear 286 is a double gear constituted by a large-diameter gear and a small-diameter gear. A front end portion of the large-diameter gear of the coupling gear 286 is engaged with a rear end portion of the small-diameter gear of the coupling gear 283. A rotation shaft 286A is rotatably inserted in a central hole of the coupling gear 286. The rotation shaft 286A is a circular cylindrical member extending downward from a fourth frame 215. The fourth frame 215 extends rearward from a left end portion of the first frame 211. The moving gear 285 is located at a rear of the coupling gear 284 and to the right of the coupling gear 286.

The first frame 211 has a guide hole 211B instead of the guide hole 211A formed in the above-described embodiment. The guide hole 211B extends in the up and down direction through a portion of the first frame 211 which is located at a rear of the coupling gear 284. The guide hole 211B is elongated in the right and left direction. A portion of the rotation shaft 285A which is located above the moving gear 285 is inserted in the guide hole 211B. The rotation shaft 285A is movable in the guide hole 211B along the guide hole 211B in the right and left direction.

Figure 25:
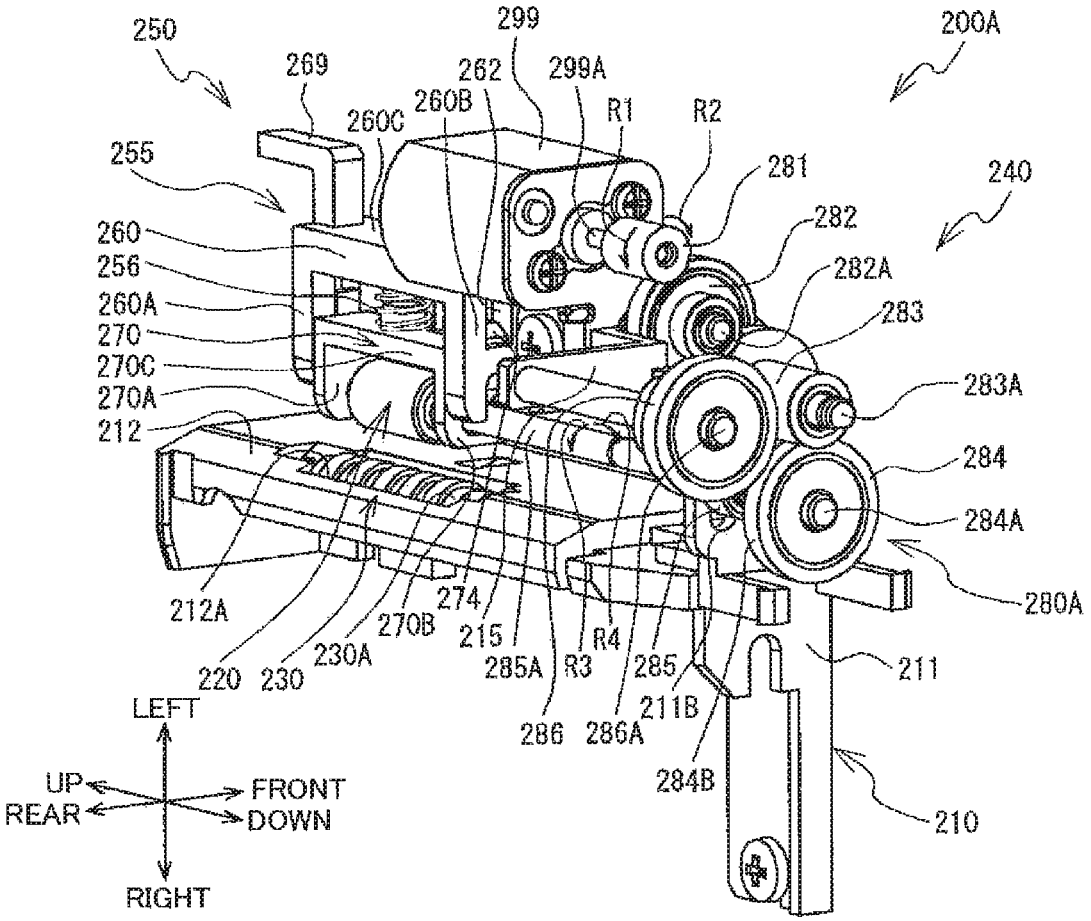
FIG. 25 is a perspective view of an output unit in a first modification which is viewed from a lower rear left side thereof.

When the rotation shaft 285A is located at a right end of the guide hole 211B, a front end portion of the moving gear 285 is engaged with the rear end portion of the small-diameter gear of the coupling gear 284 (see FIG. 25). In this case, the moving gear 285 is located to the right of and separated from the small-diameter gear of the coupling gear 286. That is, a left end portion of the moving gear 285 is not engaged with a right end portion of the small-diameter gear of the coupling gear 286. In the case where the rotation shaft 285A is located at a left end of the guide hole 211B, the left end portion of the moving gear 285 is engaged with the right end portion of the small-diameter gear of the coupling gear 286 (not illustrated). In this case, the moving gear 285 is located diagonally on a left and rear side of and separated from the small-diameter gear of the coupling gear 284. That is, in the case where the rotation shaft 285A is located at the left end of the guide hole 211B, the front end portion of the moving gear 285 is not engaged with the rear end portion of the small-diameter gear of the coupling gear 284.

There will be described a difference between this first modification and the above-described embodiment in operations of the components of the output unit 200A in the case where the output motor 299 is rotated forwardly. In the case where the front end portion of the moving gear 285 is engaged with the rear end portion of the small-diameter gear of the coupling gear 284, the forward driving force generated by the output motor 299 is transmitted by the first coupling mechanism 280A from the output shaft 299A to the output roller 220 via the coupling gears 281, 282, 283, 284, the moving gear 285, and the rotation shaft 285A in this order. As a result, the output roller 220 is rotated in the discharging direction (indicated by arrow R3). In the case where the left end portion of the moving gear 285 is engaged with the right end portion of the small-diameter gear of the coupling gear 286, the forward driving force generated by the output motor 299 is transmitted by the first coupling mechanism 280A from the output shaft 299A to the output roller 220 via the coupling gears 281, 282, 283, 286, the moving gear 285, and the rotation shaft 285A in this order. As a result, the output roller 220 is rotated in the discharging direction (indicated by arrow R3).

There will be described a difference between this first modification and the above-described embodiment in operations of the components of the output unit 200A in the case where the output motor 299 is rotated reversely. In the case where the front end portion of the moving gear 285 is engaged with the rear end portion of the small-diameter gear of the coupling gear 284, the reverse driving force generated by the output motor 299 is transmitted by the first coupling mechanism 280A from the output shaft 299A to the output roller 220 via the coupling gears 281, 282, 283, 284, the moving gear 285, and the rotation shaft 285A in this order. As a result, the output roller 220 is rotated in the clockwise direction in bottom view, i.e., in the returning direction (indicated by arrow R4).

As in the above-described embodiment, the reverse driving force generated by the output motor 299 is transmitted by the second coupling mechanism 240 from the output shaft 299A to the coupling gears 281, 282, 283 and the rotation shaft 283A in this order. In this case, as in the above-described embodiment, the moving mechanism 250 is capable of moving the output roller 220 to any of the nip position, not illustrated, and the release position (see FIG. 25).

In the case where the output roller 220 is moved between the nip position and the release position, the rotation shaft 285A is moved along the guide hole 211B in the right and left direction. In the case where the output roller 220 is moved from the release position to the nip position, the output roller 220 approaches the opposed roller 230 from a left side thereof (i.e., the direction orthogonal to the conveying direction). The moving gear 285 is moved together with the rotation shaft 285A in the right and left direction. When the output roller 220 is located at the nip position, the rotation shaft 285A is located at the right end of the guide hole 211B. When the output roller 220 is located at the release position, the rotation shaft 285A is located at the left end of the guide hole 211B. Accordingly, in the case where the output roller 220 is moved between the nip position and the release position, the moving gear 285 is moved between a position at which the moving gear 285 is engaged with the coupling gear 284 and a position at which the moving gear 285 is engaged with the coupling gear 286. Thus, in the case where the output roller 220 is located at any of the nip position and the release position, the output motor 299 and the output roller 220 are power-transmittably coupled to each other by the first coupling mechanism 280A.

In the output unit 200A, in the case where the output roller 220 is moved between the nip position and the release position, the rotation shaft 285A is moved linearly in the right and left direction. Thus, each of the second support holes 271 may not be a hole elongated in the front and rear direction. That is, the second support holes 271 only needs to support the rotation shaft 285A rotatably.

In the first modification, the first coupling mechanism 280A may not include the coupling gear 286. In this case, when the output roller 220 is located at the release position, the moving gear 285 is not engaged with any of the coupling gears. Accordingly, even when the output motor 299 is driven in this case, the output roller 220 is not rotated.

In the above-described embodiment, rotation of the one output motor 299 is switched between the forward rotation and the reverse rotation, whereby the rotation of the output roller 220 and the movement of the output roller 220 between the nip position and the release position are switched. In contrast, the rotation of the output roller 220 and the movement of the output roller 220 between the nip position and the release position may be driven by different motors. There will be described an output unit 200B in the second modification with reference to FIG. 26 by way of example. The output unit 200B is different from the output unit 200 in the above-described embodiment in that the output unit 200B further includes an output motor 298, includes a first coupling mechanism 280B instead of the first coupling mechanism 280, and includes a second coupling mechanism 240B instead of the second coupling mechanism 240. The output motor 298 is secured to a right end portion of the first frame 211 at a position located to the right of the second frame 212 and connected to the CPU 81 (see FIG. 18). An output shaft 298A of the output motor 298 extends downward from the output motor 298. The output motor 298 is capable of rotating the output shaft 298A in any of the clockwise direction in bottom view (indicated by arrow R5) and the counterclockwise direction (indicated by arrow R6).

The first coupling mechanism 280B is provided at a lower portion of the output unit 200B and power-transmittably couples the output motor 298 and the output roller 220 to each other. The first coupling mechanism 280B includes the coupling gear 284, the moving gear 285, and the rotation shaft 285A and further includes coupling gears 287-289 instead of the coupling gears 281-283. The rotation axis of each of the coupling gears 284, 287-289 and the moving gear 285 extends in the up and down direction. The coupling gear 287 is a spur gear secured to a lower end portion of the output shaft 298A.

The coupling gear 288 is a spur gear provided on a rear left side of the coupling gear 287. A front right end portion of the coupling gear 288 is engaged with a rear left end portion of the coupling gear 287. A rotation shaft 288A is rotatably inserted in a central hole of the coupling gear 288. The rotation shaft 288A is a circular cylindrical member secured to the first frame 211 and extending downward from the first frame 211. The coupling gear 289 is a spur gear provided on a front left side of the coupling gear 288. A rear right end portion of the coupling gear 289 is engaged with a front left end portion of the coupling gear 288. A rotation shaft 289A is rotatably inserted in a central hole of the coupling gear 289. The rotation shaft 289A is a circular cylindrical member secured to the first frame 211 and extending downward from the first frame 211. The coupling gear 284 is provided to the left of the coupling gear 289. A right end portion of the coupling gear 284 is engaged with a left end portion of the coupling gear 289.

Figure 26:
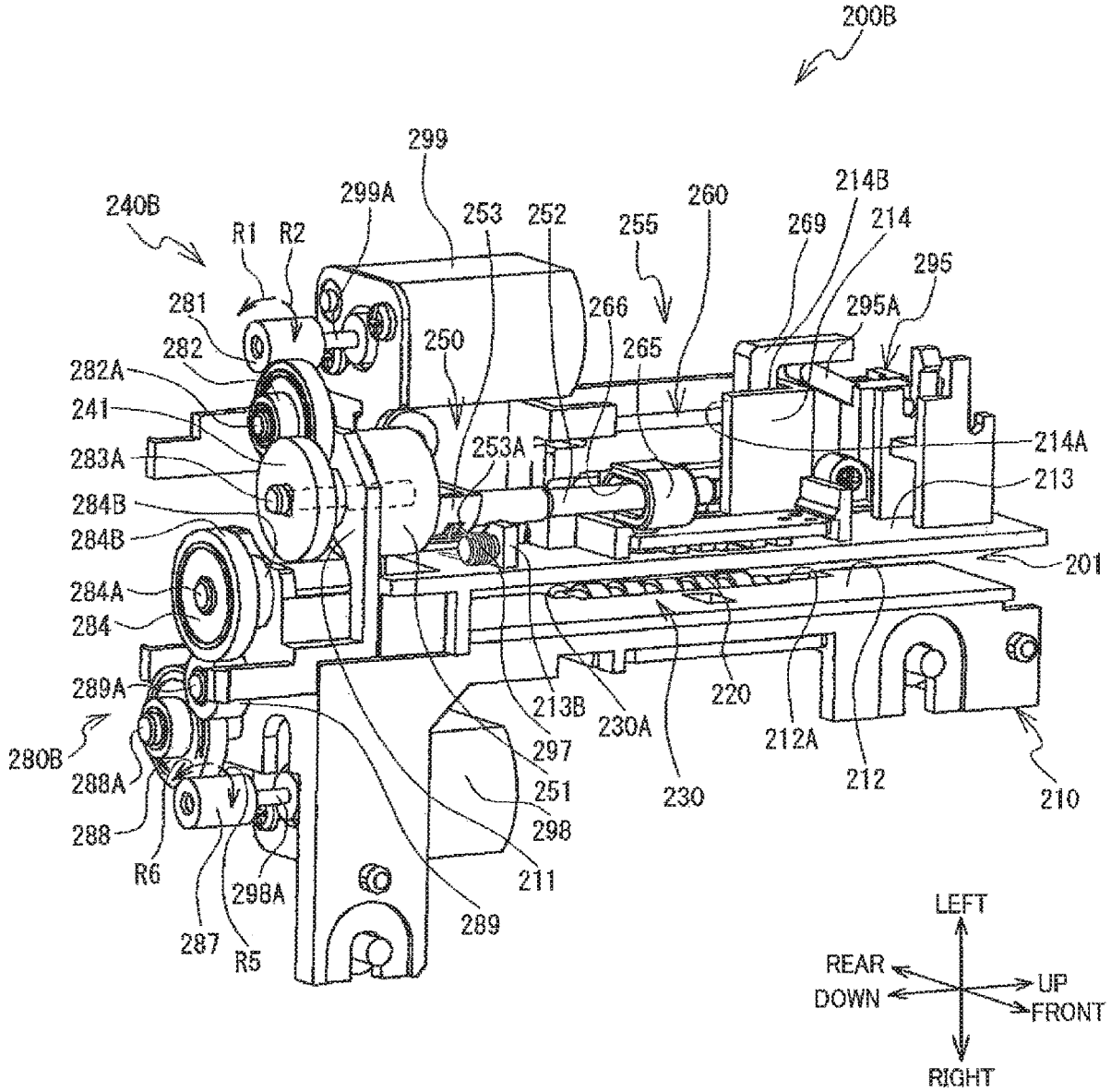
FIG. 26 is a perspective view of an output unit in a second modification which is viewed from a lower front left side thereof.

Though not illustrated in FIG. 26, the moving gear 285 is provided at a rear of the coupling gear 284 as in the above-described embodiment. A lower end portion of the rotation shaft 285A is inserted in and secured to the coupling gear 284. The first frame 211 has the guide hole 211A.

The second coupling mechanism 240B is provided at a lower portion of the output unit 200B and configured to power-transmittably couple the output motor 299 and the moving mechanism 250 to each other. The second coupling mechanism 240B includes the coupling gears 281, 282 and the rotation shaft 283A and includes a coupling gear 241 instead of the coupling gear 283. The second coupling mechanism 240B does not include the one-way clutch 290. The coupling gear 241 is a spur gear disposed on a front right side of the coupling gear 282. A rear left end portion of the coupling gear 241 is engaged with the front right end portion of the small-diameter gear of the coupling gear 282. The lower end portion of the rotation shaft 283A is inserted and secured in a central hole of the coupling gear 241. Unlike the coupling gear 283 in the above-described embodiment, the coupling gear 241 is not engaged with the coupling gear 284.

There will be described operations of the components of the output unit 200B in the case where the output motor 298 is driven. A driving force generated by the output motor 298 is transmitted by the first coupling mechanism 280B from the output shaft 298A to the output roller 220 via the coupling gears 287, 288, 289, 284, the moving gear 285, and the rotation shaft 285A in this order. Thus, in the case where the output motor 298 is rotated in the clockwise direction in bottom view (indicated by arrow R5), the output roller 220 is rotated in the discharging direction (indicated by arrow R3). In the case where the output motor 298 is rotated in the counterclockwise direction in bottom view (indicated by arrow R6), the output roller 220 is rotated in the returning direction (indicated by arrow R4). Thus, by driving the output motor 298, the printer 1 can rotate the output roller 220 in any of the discharging direction and the returning direction in a state in which the position of the output roller 220 is kept. That is, by driving the output motor 298, the printer 1 can rotate the output roller 220 in any of the discharging direction and the returning direction without moving the output roller 220 between the nip position and the release position.

There will be described operations of the components of the output unit 200B in the case where the output motor 299 is driven. A driving force generated by the output motor 299 is transmitted by the second coupling mechanism 240B from the output shaft 299A to the rotor 251 via the coupling gears 281, 282, 241 and the rotation shaft 283A in this order. Thus, when the output motor 299 is rotated reversely (as indicated by arrow R2), the rotor 251 is rotated about the rotation shaft 283A in the clockwise direction in bottom view. In this case, the moving mechanism 250 can move the output roller 220 to any of the nip position and the release position as in the above-described embodiment.

According to the output unit 200B in the second modification, by driving the output motors 298, 299 at the same time, the printer 1 can rotate the output roller 220 in any of the discharging direction and the returning direction while moving the output roller 220 between the nip position and the release position. The CPU 81 in the second modification may execute a first leading-end positioning process described below, instead of the first leading-end positioning process in the above-described embodiment.

Figure 27:
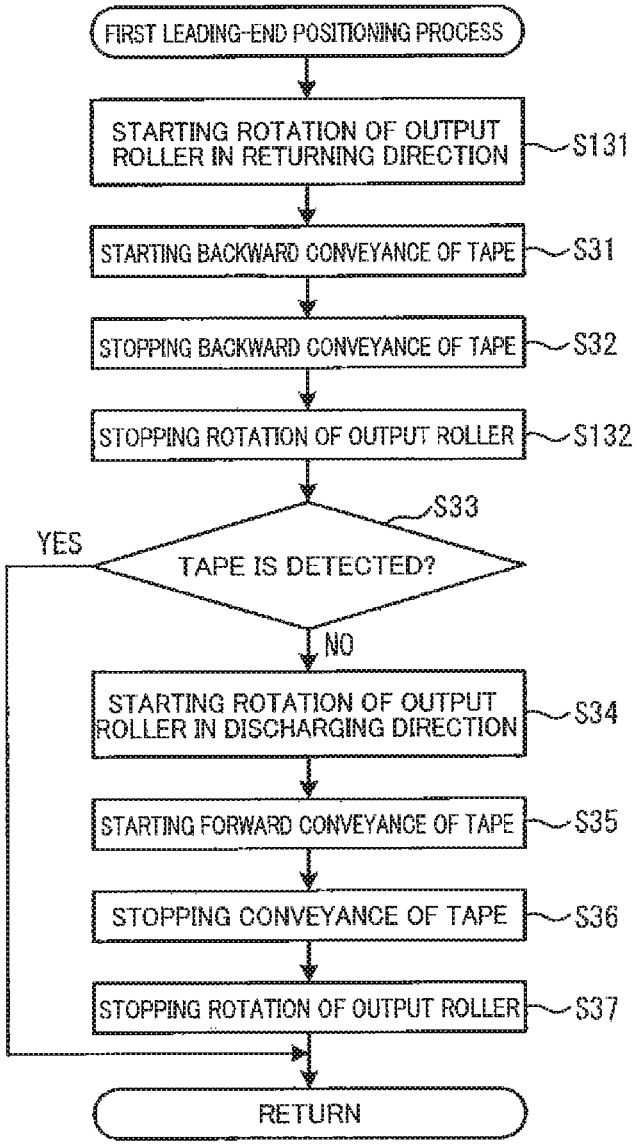
FIG. 27 is a flowchart representing a first leading-end positioning process in the second modification.

There will be described the first leading-end positioning process in the second modification with reference to FIG. 27. At S131, the CPU 81 starts rotating the output motor 298 in the counterclockwise direction in bottom view (as indicated by arrow R6) to start rotation of the output roller 220 in the returning direction (indicated by arrow R4). The CPU 81 at S31 starts conveying the tape backward by starting rotation of the conveying motor 68 in the backward-conveyance direction. The CPU 81 at S32 stops the rotation of the conveying motor 68 to stop the backward conveyance of the tape. The CPU 81 at S132 stops rotating the output motor 298 to stop the rotation of the output roller 220. Processings at S33 and subsequent steps are the same as those at S33 and subsequent steps in the first leading-end positioning process in the above-described embodiment, and an explanation of which is dispensed with. The CPU 81 may execute the processing at S131 between S42 and S43 in the second leading-end positioning process and execute the processing at S132 between S44 and S45 in the second leading-end positioning process.

In the first leading-end positioning process in the second modification, the output roller 220 is rotated in the returning direction during the backward-conveyance operation. Thus, even in the case where the tape comes into contact with the output roller 220 during the backward-conveyance operation, interference with the backward-conveyance operation is reduced. This reduces occurrences of a jam during the backward-conveyance operation.

In the second modification, the output motor 298 is one example of a first motor. The processing at S131 in FIG. 27 is one example of a roller driving processing.

It is noted that the moving mechanism 250 in the second modification may include a rack-and-pinion mechanism instead of the rotor 251 and the eccentric member 252. For example, a pinion is provided on the upper end portion of the rotation shaft 283A. A rack extends in the right and left direction and is engaged with the pinion. A rod extending in the up and down direction is provided on the rack. The rod is inserted in the first support hole 266. The printer 1 may switch between the forward rotation and the reverse rotation of the output motor 299 to move the roller holder 255 in the right and left direction using the rack-and-pinion mechanism. In this case, the first support hole 266 may not be a hole elongated in the front and rear direction.

In the above-described embodiment, the output roller 220 is moved to any of the nip position and the release position and rotated by the output motor 299. In contrast, the output roller 220 may not be rotated by the output motor 299. There will be described an output unit 200C in the third modification with reference to FIG. 28 by way of example. The output unit 200C is different from the output unit 200 in the above-described embodiment in that the output unit 200C further includes an output motor 296, includes a first coupling mechanism 280C instead of the first coupling mechanism 280, and includes a second coupling mechanism 240C instead of the second coupling mechanism 240. The output motor 296 is secured to the right end portion of the first frame 211 at a position located to the right of the second frame 212 and connected to the CPU 81 (see FIG. 18). An output shaft 296A of the output motor 296 extends downward from the output motor 296. The output motor 296 is capable of rotating the output shaft 296A in any of the clockwise direction in bottom view (indicated by arrow R7) and the counterclockwise direction (indicated by arrow R8).

The first coupling mechanism 280C is provided at a lower portion of the output unit 200C and configured to power-transmittably couple the output motor 296 and the opposed roller 230 to each other. The first coupling mechanism 280C includes coupling gears 243-246 and a rotation shaft 230B. The rotation axis of each of the coupling gears 243-246 extends in the up and down direction. The coupling gear 243 is a spur gear secured to a lower end portion of the output shaft 296A.

The coupling gear 244 is a spur gear provided on a rear left side of the coupling gear 243. A front right end portion of the coupling gear 244 is engaged with a rear left end portion of the coupling gear 243. A rotation shaft 244A is rotatably inserted in a central hole of the coupling gear 244. The rotation shaft 244A is a circular cylindrical member secured to the first frame 211 and extending downward from the first frame 211. The coupling gear 245 is provided on a front left side of the coupling gear 244. The coupling gear 245 is a double gear constituted by a large-diameter gear and a small-diameter gear. A rear right end portion of the small-diameter gear of the coupling gear 245 is engaged with a front left end portion of the coupling gear 244. A rotation shaft 245A is rotatably inserted in a central hole of the coupling gear 245. The rotation shaft 245A is a circular cylindrical member secured to the first frame 211 and extending downward from the first frame 211. The coupling gear 246 is a spur gear provided on a front left side of the coupling gear 245. A rear right end portion of the coupling gear 246 is engaged with a front left end portion of the large-diameter gear of the coupling gear 245.

The rotation shaft 230B is provided instead of the rotation shaft 230A in the above-described embodiment and extends parallel with the rotation shaft 285A.

Figure 28:
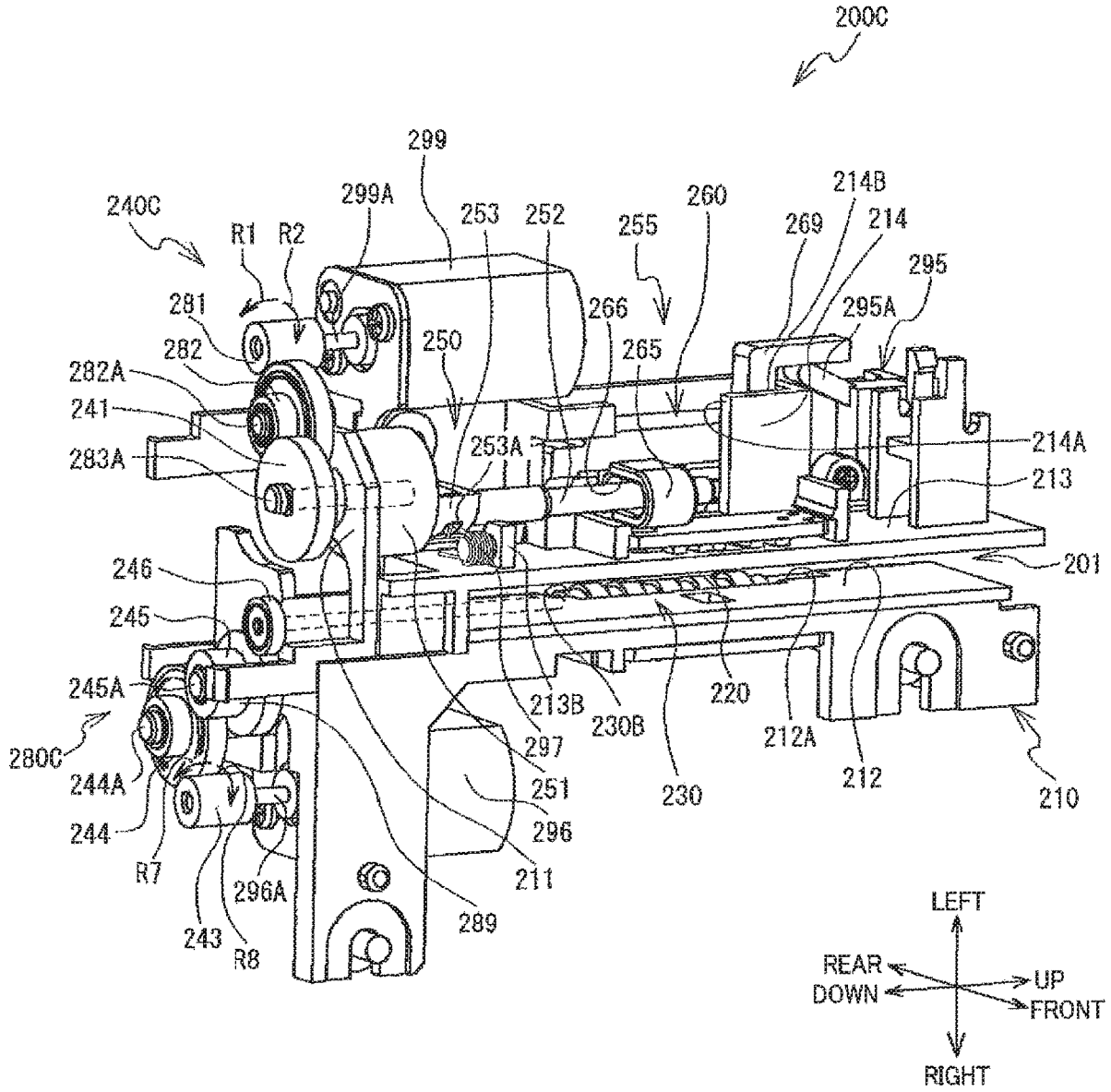
FIG. 28 is a perspective view of an output unit in a third modification which is viewed from a lower front left side thereof.

In FIG. 28, a portion of the rotation shaft 230B which is located below a lower end of the opposed roller 230 is indicated by the broken lines. A lower end portion of the rotation shaft 230B has a D-cut shape. The entire portion of the rotation shaft 230B which is different from its lower end portion has a circular cylindrical shape. The lower end portion of the rotation shaft 230B is located below the first frame 211 and inserted and secured in a central hole of the coupling gear 246. An upper end portion of the rotation shaft 230B extends to an upper end of the hole 212A and is inserted and secured in the central hole of the opposed roller 230. The rotation shaft 230B is rotatably supported by inner walls of upper and lower portions of the hole 212A. The second coupling mechanism 240C is the same as the second coupling mechanism 240B in the second modification, and an explanation of which is dispensed with.

There will be described operations of the components of the output unit 200C in the case where the output motor 296 is driven. A driving force generated by the output motor 296 is transmitted by the first coupling mechanism 280C from the output shaft 296A to the opposed roller 230 via the coupling gears 243, 244, 245, 246 and the rotation shaft 230B. Thus, in the case where the output motor 296 is rotated in the counterclockwise direction in bottom view (indicated by arrow R7), the opposed roller 230 is rotated in the clockwise direction in bottom view. When the tape comes into contact with the opposed roller 230 rotating in the counterclockwise direction in bottom view, the tape is conveyed forward. In the case where the output motor 296 is rotated in the clockwise direction in bottom view (indicated by arrow R8), the opposed roller 230 is rotated in the clockwise direction in bottom view. When the tape comes into contact with the opposed roller 230 rotating in the clockwise direction in bottom view, the tape is conveyed backward. Operations of the components of the output unit 200C in the case where the output motor 299 is driven are the same as the operations of the components of the output unit 200B in the case where the output motor 299 is driven, and an explanation of which is dispensed with.

In the above-described embodiment, in the case where the eccentric member 252 is located at the left end of the moving area of the eccentric member 252 in the right and left direction, the output roller 220 is separated from the tape. That is, the output roller 220 is located at the release position. In contrast, the output roller 220 may not be moved to the release position. That is, when the eccentric member 252 is located at the left end of the moving area of the eccentric member 252 in the right and left direction, the tape may be nipped between the output roller 220 and the opposed roller 230. There will be described an output unit, not illustrated, in the fourth modification by way of example. In this modification, the eccentric member 252 is preferably provided such that the distance between the eccentric member 252 and the rotation shaft 283A in the radial direction is small when compared with that in the above-described embodiment. More specifically, when the eccentric member 252 is located at the left end of the moving area of the eccentric member 252 in the right and left direction, the distance between a right end of the output roller 220 and a left end of the opposed roller 230 only needs to be less than the thickness of the tape. When the eccentric member 252 is located at the left end of the moving area of the eccentric member 252 in the right and left direction, the right end of the output roller 220 and the left end of the opposed roller 230 may be in contact with each other in a state in which the tape is absent between the output roller 220 and the opposed roller 230.

This configuration enables the printer 1 according to the fourth modification to adjust the nip load at the second nipping position P5 in accordance with the position of the eccentric member 252 in the right and left direction. The printer 1 is capable of adjusting the nip load at the second nipping position P5 selectively to one of a first load, a third load, and a fourth load. In the following description, the third load and the fourth load may be collectively referred to as "second load". It is noted that the printer 1 may be configured to adjust the nip load at the second nipping position P5 selectively to only two levels, namely, the first load and the second load and may adjust the nip load selectively to more than three levels.

The second load is less than the first load. The fourth load is less than the third load. In the printer 1 according to the fourth modification, the first load is the nip load at the second nipping position P5 in the case where the eccentric member 252 is located at the right end of the moving area of the eccentric member 252 in the right and left direction. The third load is the nip load at the second nipping position P5 in the case where the eccentric member 252 is located at the center of the moving area of the eccentric member 252 in the right and left direction. The fourth load is the nip load at the second nipping position P5 in the case where the eccentric member 252 is located at the left end of the moving area of the eccentric member 252 in the right and left direction. In this case, the CPU 81 may execute a main process described below.

There will be next described a main process in the fourth modification with reference to FIGS. 29-33. It is noted that there will be mainly described a portion of the main process which is different from the main process in the above-described embodiment.

Figure 29:
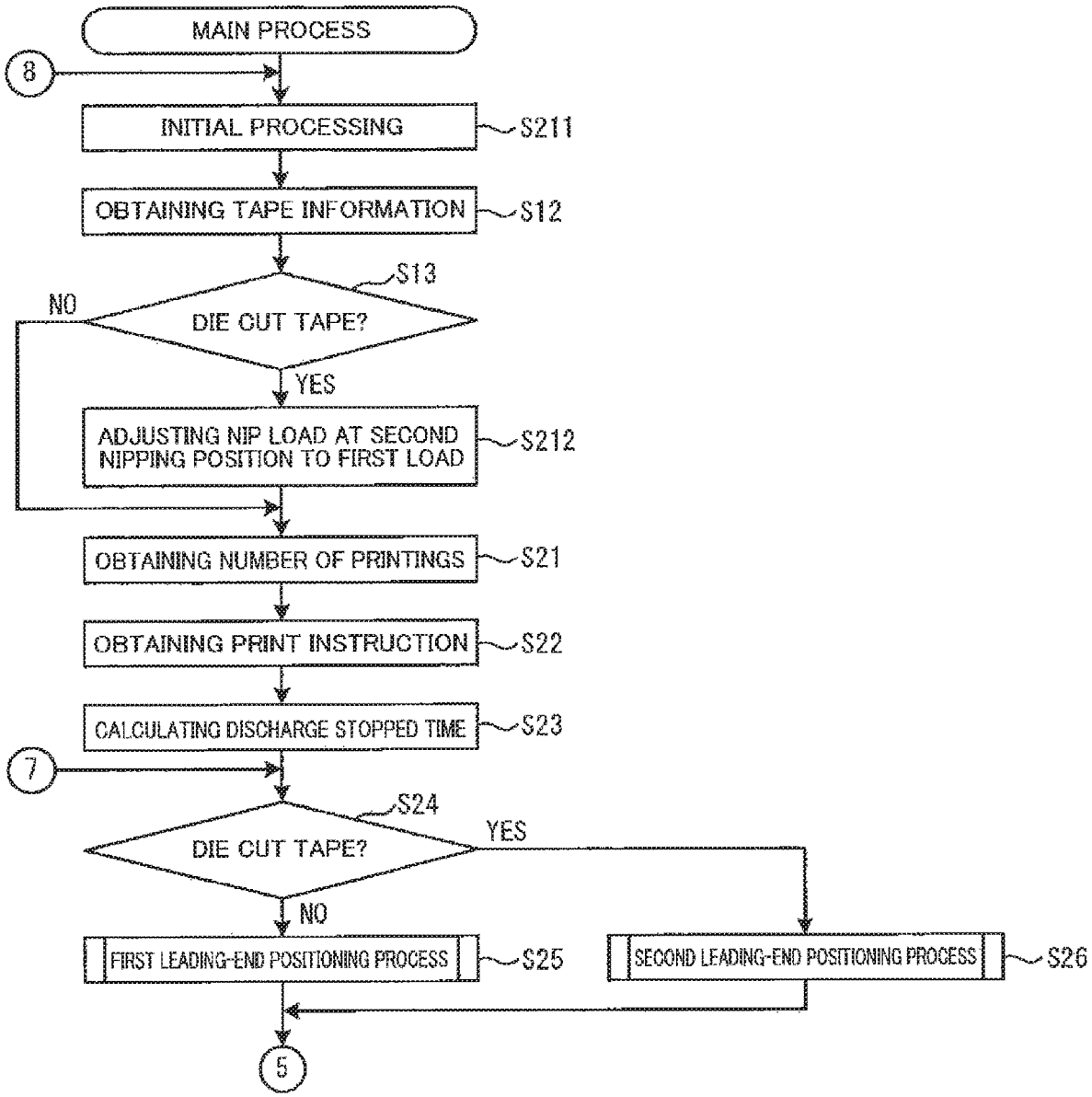
FIG. 29 is a flowchart representing a portion of a main process in a fourth modification.

As illustrated in FIG. 29, the CPU 81 executes an initial processing at S211. The initial processing at S211 is different from the initial processing in the above-described embodiment (S11) in that the nip load at the second nipping position P5 is adjusted to the fourth load. Specifically, the CPU 81 rotates the output motor 299 reversely to move the eccentric member 252 to the left end of the moving area of the eccentric member 252 in the right and left direction. Upon the completion of the processing at S211, this flow goes to S12.

When CPU 81 determines at S13 that the tape is the die cut tape 9 (S13: YES), the CPU 81 at S212 adjusts the nip load at the second nipping position P5 to the first load. Specifically, the CPU 81 reversely rotates the output motor 299 until the detection signal is obtained from the position detecting sensor 295. As a result, the eccentric member 252 is moved to the right end of the moving area of the eccentric member 252 in the right and left direction. Upon the completion of the processing at S13, this flow goes to S21. First and second leading-end positioning processes described below are executed at S25 and S26, respectively.

Figure 32:
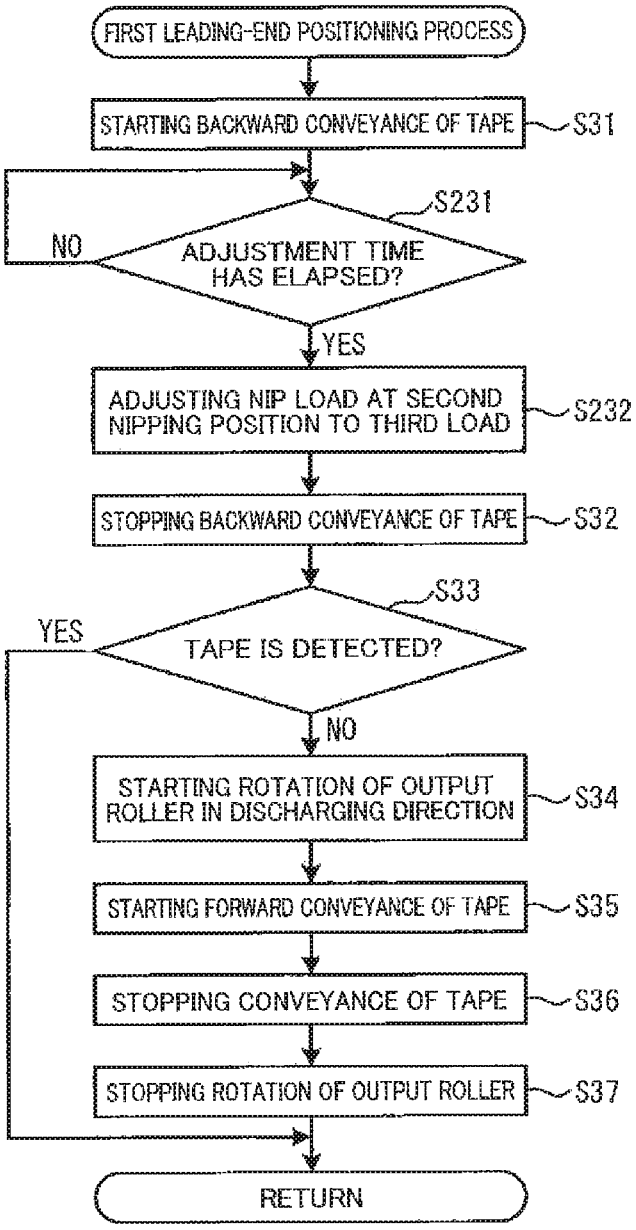
FIG. 32 is a flowchart representing a first leading-end positioning process in the fourth modification.

There will be described the first leading-end positioning process in the fourth modification with reference to FIG. 32. The CPU 81 at S31 starts conveying the tape backward by starting rotation of the conveying motor 68 in the backward-conveyance direction. As a result, the tape is conveyed backward in a state in which the nip load at the second nipping position P5 is the fourth load. The CPU 81 at S231 determines whether an adjustment time has elapsed. The adjustment time is stored in the ROM 83 in advance. The adjustment time is less than a length of time for which the tape is conveyed backward (i.e., a length of time between S31 and S32). When the adjustment time has not elapsed (S231: NO), the CPU 81 waits until the adjustment time has elapsed.

When the adjustment time has elapsed (S231: YES), the CPU 81 at S232 adjusts the nip load at the second nipping position P5 to the third load. Specifically, the CPU 81 rotates the output motor 299 reversely for a particular length of time to move the eccentric member 252 to the center of the moving area of the eccentric member 252 in the right and left direction. As a result, the tape is conveyed backward in a state in which the nip load at the second nipping position P5 is the third load. The CPU 81 at S32 stops the rotation of the conveying motor 68 to stop the backward conveyance of the tape.

Figure 33:
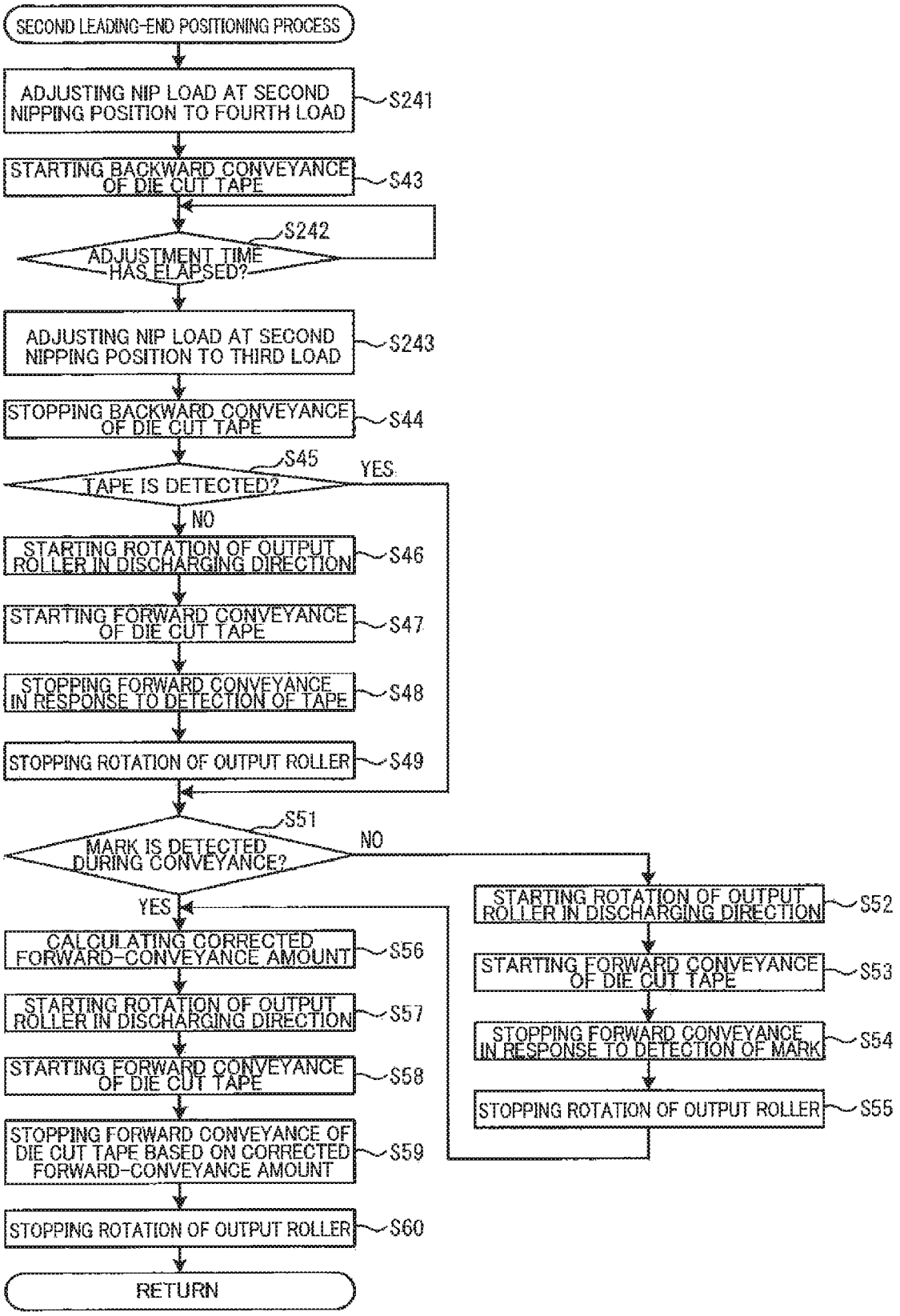
FIG. 33 is a flowchart representing a second leading-end positioning process in the fourth modification.

There will be next described the second leading-end positioning process in the fourth modification with reference to FIG. 33. The CPU 81 at S241 adjusts the nip load at the second nipping position P5 to the fourth load. Specifically, the CPU 81 rotates the output motor 299 reversely for a particular length of time to move the eccentric member 252 to the left end of the moving area of the eccentric member 252 in the right and left direction. The processings at S242 and 5243 are the same as those at S231 and S232, respectively.

Figure 30:
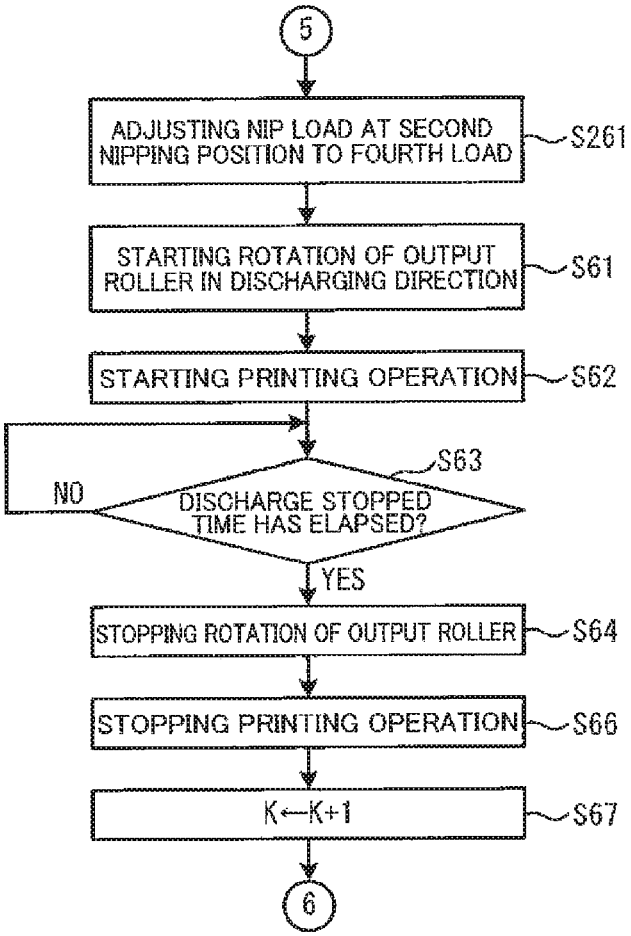
FIG. 30 is a flowchart representing another portion of the main process in the fourth modification which is continued from FIG. 29.

As illustrated in FIG. 30, upon completion of the first leading-end positioning process or the second leading-end positioning process, the CPU 81 at S261 rotates the output motor 299 reversely to adjust the nip load at the second nipping position P5 to the fourth load. After the CPU 81 executes the processings at S64, S66, and S67 in this order, this flow goes to S271 (see FIG. 31). That is, the processings at S65 and S68 (see FIG. 20) in the main process in the above-described embodiment are omitted.

Figure 31:
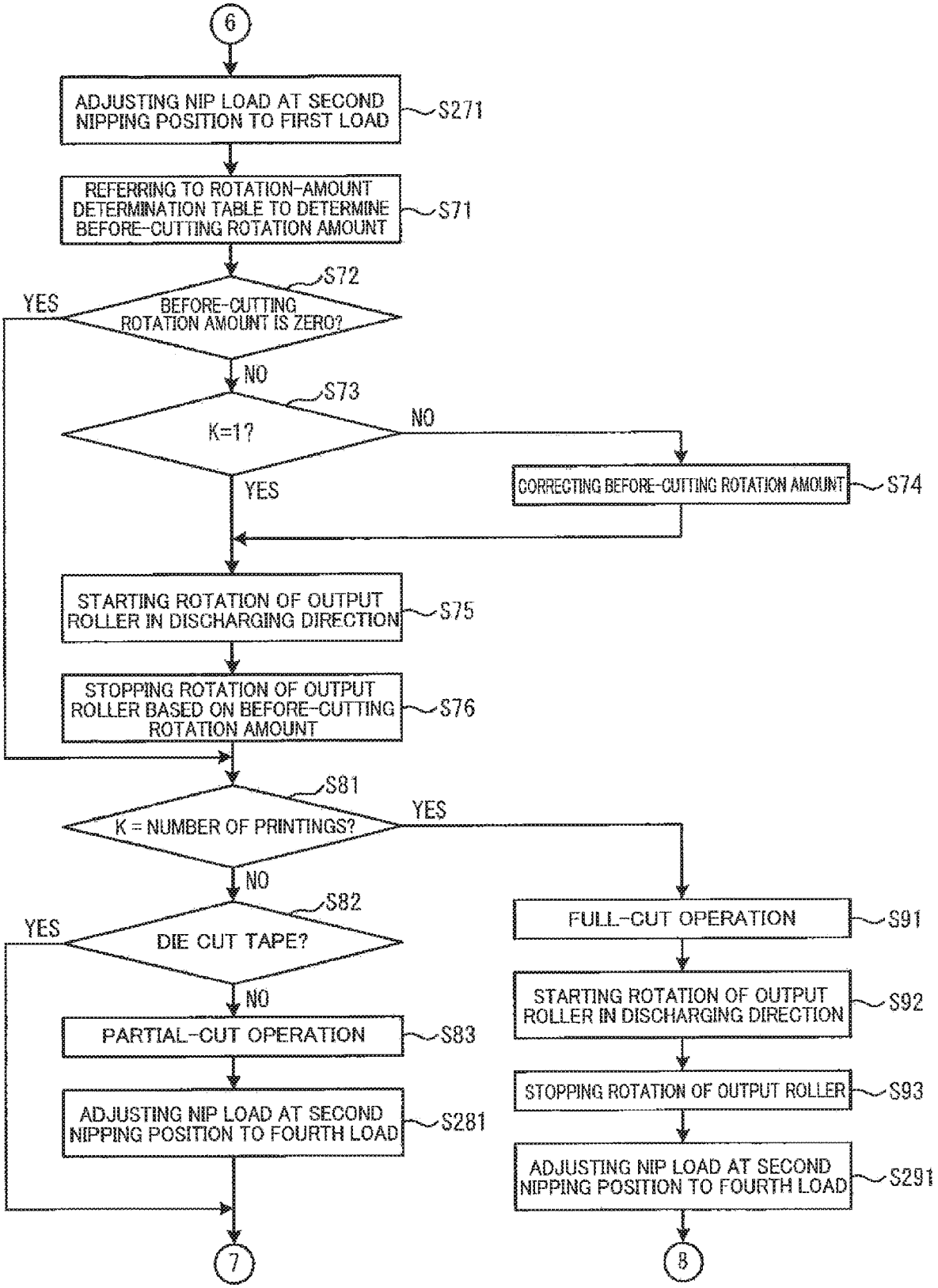
FIG. 31 is a flowchart representing yet another portion of the main process in the fourth modification which is continued from FIG. 30.

As illustrated in FIG. 31, the CPU 81 at S271 rotates the output motor 299 reversely to adjust the nip load at the second nipping position P5 to the first load, and this flow goes to S71. After the processing at S83, the CPU 81 at S281 rotates the output motor 299 reversely to adjust the nip load at the second nipping position P5 to the fourth load, and this flow returns to S24 (see FIG. 29). After the processing at S93, the CPU 81 at S291 rotates the output motor 299 reversely to adjust the nip load at the second nipping position P5 to the fourth load, and this flow returns to S211 (see FIG. 29).

In the fourth modification, the backward-conveyance operation is performed in the state in which the nip load at the second nipping position P5 is adjusted to the fourth load. This reduces damage to the tape when the tape is conveyed backward. Since the printer 1 can stably convey the tape backward when compared with a case where no nip load acts on the tape at the second nipping position P5, it is possible to reduce occurrences of a jam during the backward-conveyance operation.

In the case where the tape is cut, the CPU 81 at S92 rotates the output roller 220 in the discharging direction by driving the output motor 299 in the state in which the nip load at the second nipping position P5 is the first load. In this case, the cut tape is conveyed forward in the state in which the tape is nipped at the second nipping position P5 under the first load. This configuration enables the printer 1 to reliably convey the cut tape forward between the output roller 220 and the opposed roller 230.

The CPU 81 at S31 and S43 starts the backward-conveyance operation in the state in which the nip load at the second nipping position P5 is the fourth load. The CPU 81 at S232 and S243 changes the nip load at the second nipping position P5 to the third load after the start of the backward-conveyance operation and before the end of the backward-conveyance operation. With this configuration, the nip load at the second nipping position P5 is the fourth load at the start of the backward-conveyance operation. This reduces damage to the tape at the start of the backward-conveyance operation. Since the nip load at the second nipping position P5 is changed from the fourth load to the third load during the backward-conveyance operation, the printer 1 can more stably convey the tape backward.

In the fourth modification, the moving mechanism 250 is one example of an adjusting mechanism. Each of the processing at S31 in FIG. 32 and the processing at S43 in FIG. 33 is one example of a second conveyor-backward-conveyance processing. The output motor 299 is one example of a second motor. The full-cut blade 140 is one example of a cutter. The processing at S92 in FIG. 31 is one example of a second roller driving processing. Each of the processing at S232 in FIG. 32 and the processing at S243 in FIG. 33 is one example of a load adjusting processing.

Figure 34:
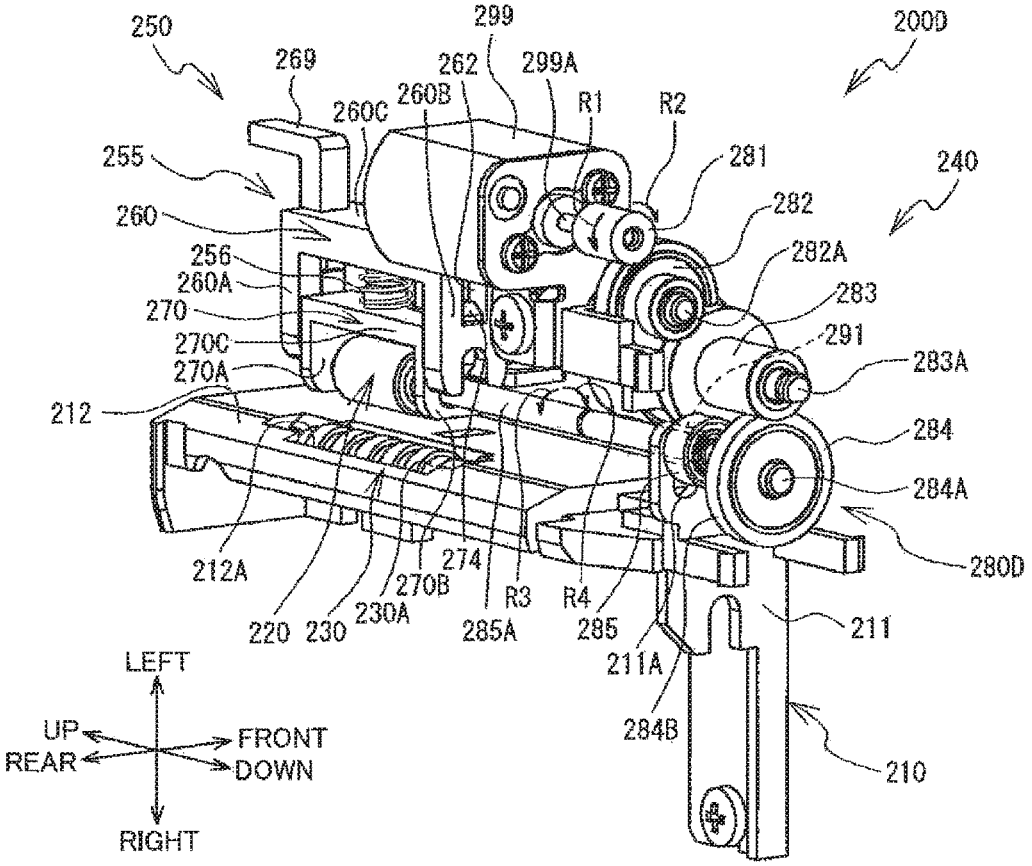
FIG. 34 is a perspective view of an output unit in a fifth modification which is viewed from a lower rear left side thereof.

There will be described an output unit 200D in the fifth modification with reference to FIG. 34. The output unit 200D is different from the output unit 200 in the above-described embodiment in that the output unit 200D includes a first coupling mechanism 280D instead of the first coupling mechanism 280. The first coupling mechanism 280D includes the coupling gears 281-284, the moving gear 285, and the rotation shaft 285A and further includes a one-way clutch 291. The one-way clutch 291 is provided between the central hole of the moving gear 285 and the lower end portion of the rotation shaft 285A. In FIG. 34, the one-way clutch 291 and a portion of the rotation shaft 285A which is located on an inner side of the moving gear 285 and the first frame 211 are indicated by the broken lines. In this modification, the lower end portion of the rotation shaft 285A is rotatably inserted in the central hole of the moving gear 285. It is noted that the one-way clutch 291 may be provided between an upper end portion of the rotation shaft 285A and the central hole of the output roller 220.

When the output motor 299 is rotated forwardly, the one-way clutch 291 power-transmittably couples the output motor 299 and the rotation shaft 285A (the output roller 220) to each other. When the output motor 299 is rotated reversely, the one-way clutch 291 disengages power transmission between the output motor 299 and the rotor 251 (the output roller 220). When the output motor 299 is rotated forwardly (as indicated by arrow R1), the moving gear 285 is rotated in the counterclockwise direction in bottom view via the coupling gears 281-284. In the case where the moving gear 285 is rotated in the counterclockwise direction in bottom view, the one-way clutch 291 rotates the rotation shaft 285A together with the moving gear 285. When the output motor 299 is rotated reversely (as indicated by arrow R2), the moving gear 285 is rotated in the clockwise direction in bottom view via the coupling gears 281-284. When the moving gear 285 is rotated in the clockwise direction in bottom view, the one-way clutch 291 idles the rotation shaft 285A with respect to the moving gear 285.

The first coupling mechanism 280D includes a second switching mechanism (the one-way clutch 291) configured to: power-transmittably couple the output motor 299 and the output roller 220 to each other when the output motor 299 is driven so as to be rotated forwardly; and disengage power transmission between the output motor 299 and the output roller 220 when the output motor 299 is driven so as to be rotated reversely.

In this configuration, the reverse driving force generated by the output motor 299 is not transmitted from the moving gear 285 to the output roller 220. Thus, even when the output motor 299 is rotated reversely, the output roller 220 is not rotated in the returning direction (indicated by arrow R4). This configuration enables the printer 1 to, by rotating the output motor 299 reversely, move the output roller 220 to any of the nip position and the release position in a state in which rotation of the output roller 220 is kept stopped. Accordingly, the printer 1 according to the fifth modification reduces backward conveyance of the tape even in the case where the tape comes into contact with the output roller 220 during movement of the output roller 220 between the nip position and the release position.

The following modifications may be made to the above-described embodiment. For example, the urging member 297 is a torsion spring in the above-described embodiment but may be a spring of any other type such as a compression coil spring, a disc spring, and a plate spring. The urging member 297 may be an elastic member formed of rubber, for example. The urging member 256 is a compression coil spring in the above-described embodiment but may be a spring of any other type such as a disc spring and a plate spring. The urging member 256 may be an elastic member formed of rubber, for example.

The printer 1 may further include an urging member, not illustrated. The urging member is fixed to a fixed portion and is a torsion spring, for example. It is noted that this urging member is not limited to the torsion spring like the urging member 297. The fixed portion is provided near a lower rear end of the rotor 251. Both ends of the urging member extend frontward. In the case where the output roller 220 is located at the nip position, the larger-diameter portion 253 is located to the right of the rotation shaft 283A. In this case, the recessed portion 253A opens rightward, and thus an end portion of the urging member is separated from the recessed portion 253A. In the case where the output roller 220 is located at the release position, the larger-diameter portion 253 is located to the left of the rotation shaft 283A. In this case, the recessed portion 253A opens leftward, and thus the end portion of the urging member is engaged with the recessed portion 253A from a left side thereof. The urging member urges the larger-diameter portion 253 diagonally toward a rear right side thereof. That is, the urging member urges the rotor 251 in the counterclockwise direction in bottom view. Rotation of the rotor 251 in the counterclockwise direction in bottom view prevents the output roller 220 from moving from the release position to the nip position. An urging force of the urging member is less than a force required to rotate the rotor 251 in the counterclockwise direction in bottom view. Thus, the output roller 220 is kept at the release position by the urging force of the urging member. That is, the printer 1 may include the urging member configured to urge the rotor 251 to keep the output roller 220 at the release position when the output roller 220 is located at the release position. This configuration enables the printer 1 to reduce unintentional movement of the output roller 220 from the release position to the nip position. It is noted that this urging member and the urging member 297 may be formed as one unit. That is, the urging member 297 may urge the rotor 251 so as to keep the output roller 220 at the release position when the output roller 220 is located at the release position.

The configuration of the cutting unit 100 is not limited to that in the above-described embodiment. For example, the cutting unit 100 may be configured to perform only one of the full-cut operation and the partial-cut operation. The cutting unit 100 may be configured to perform the full-cut operation or the partial-cut operation with a single cutting blade. The cutting unit 100 may include as what is called a rotary cutter having a disc shape and configured to be rotated to cut the tape. The cutting unit 100 may include what is called a slide cutter configured to be moved in the widthwise direction of the tape to cut the tape. The cutting unit 100 may include a manual cutter without including the cutting motor 105. The cutting unit 100 may perform the partial-cut operation by forming perforation extending in the widthwise direction in the tape.

The number of the coupling gears 281-284 is not limited to that in the above-described embodiment. Each of the first coupling mechanism 280 and the second coupling mechanism 240 may include a belt, a pulley, and/or other similar components. The printer 1 may use a belt or the like instead of the conveying roller 66 to convey the tape.

In the above-described embodiment, the roller holder 255 is moved linearly in the right and left direction by the guide frame 214. In contrast, the printer 1 may include, instead of the guide frame 214, a member configured to guide the roller holder 255 along the outer circumferential surface 284B of the coupling gear 284. In this configuration, each of the second support holes 271 may not be a hole elongated in the front and rear direction. That is, the second support holes 271 only need to support the rotation shaft 285A rotatably.

The first frame 211 may be located below the moving gear 285. In this case, a guide groove may be formed in the first frame 211 instead of the guide hole 211A. The guide groove is recessed downward from the first frame 211. The lower end portion of the rotation shaft 285A is slid in the guide groove. Protrusions may be provided instead of the first support hole 266 and the second support holes 271. In this case, recessed portions may be respectively formed in upper ends of the eccentric member 252 and the rotation shaft 285A. The protrusions are inserted in the respective recessed portions to support the eccentric member 252 and the rotation shaft 285A.

In the above-described embodiment, the nip load at the second nipping position P5 is less than the nip load at the first nipping position P2. The nip load at the first nipping position P2 is less than the nip load at the printing position P1. In contrast, the nip load at the second nipping position P5 may be greater than or equal to the nip load at the first nipping position P2 and may be greater than or equal to the nip load at the printing position P1. The nip load at the first nipping position P2 may be greater than or equal to the nip load at the printing position P1.

Each of the mark detecting sensor 31 and the tape detecting sensor 32 is a photo sensor of the transmission type in the above-described embodiment but may be a sensor of any other type such as a reflective photo sensor. The position detecting sensor 295 is a switch sensor but may be a sensor of any other type such as a photo sensor. In the above-described embodiment, the position detecting sensor 295 detects the position of the first member 260 to detect whether the output roller 220 is located at the nip position. In contrast, the position detecting sensor 295 may directly detect the position of the output roller 220. For example, the movable piece 295A of the position detecting sensor 295 may be positioned on a moving path of the rotation shaft 285A. The position detecting sensor 295 may detect whether the output roller 220 is located at the release position. Each of the marks 99 is not limited to a through hole and may be a mark detectable by the mark detecting sensor 31, such as a protrusion, a recession, and a color. The position of each of the marks 99 is not limited to a portion of the release paper sheet 92 which is located between corresponding adjacent two of the substrates 91 and may be a corresponding one of the substrates 91 and may be a portion of the release paper sheet 92 which is located on an opposite side of the release paper sheet 92 from a corresponding one of the substrates 91.

The opposed roller 230 includes a plurality of cylindrical members in the above-described embodiment but may be formed as one cylindrical member. The output roller 220 is formed as one cylindrical member in the above-described embodiment but may include a plurality of cylindrical members. Each of the output roller 220 and the opposed roller 230 is an elastic member in the above-described embodiment but may be a component not having elasticity such as a metal component. The opposed roller 230 may not be rotatable and may be a plate-like elastic member, for example.

The printer 1 may not include the output motor 299. That is, the output roller 220 and the opposed roller 230 may be rotated by contact with the tape being conveyed. The output roller 220 may be manually moved between the nip position and the release position.

In the rotation-amount determination table 30, four levels of the before-cutting rotation amount of the output roller 220, namely, "LARGE", "MEDIUM", "SMALL", and "ZERO", are provided in the above-described embodiment, but five or more levels or three or less levels of the before-cutting rotation amount of the output roller 220 may be provided. For example, the die cut tape 9 may be associated with any amount other than "ZERO", and each tape other than the die cut tape 9 may be associated with "ZERO". In the rotation-amount determination table 30, any other tape (such as a tube tape) and the before-cutting rotation amount of the output roller 220 may be associated with each other.

The printer 1 is a general-type printer capable of using cassettes of various types in the above-described embodiment but may be a printer of a specific type using a cassette of a specific one type. In this case, the printer 1 may not obtain the tape information. For example, in the case of a printer specific to a cassette containing the die cut tape 9, the CPU 81 may move the output roller 220 to the nip position in the initial processing. This configuration enables the printer 1 to further reduce peeling of the substrates 91 off from the release paper sheet 92 in the die cut tape 9. Furthermore, it is possible to further reduce unintentional discharge of the die cut tape 9 from the cassette.

In the above-described embodiment, the CPU 81 obtains the tape information by input of the tape information via the input interface 4. In contrast, the CPU 81 may obtain the tape information by input of the tape information into the printer 1 via an external terminal. The cassette 7 may have an identifier identifying the tape information, and the printer 1 may include a sensor for reading the tape information from the identifier. Examples of the identifier include a QR code (registered trademark), an IC chip, and protrusions and recessions formed in a pattern related to the type of the tape. The CPU 81 may obtain the tape information read by the sensor.

In the above-described embodiment, the CPU 81 obtains the print instruction by input of the print instruction via the input interface 4. In contrast, the CPU 81 may obtain the print instruction by input of the print instruction into the printer 1 via the external terminal.

The printer 1 may have a function of performing printing on the tape while conveying the tape backward. In this case, the printer 1 may perform printing on the tape while conveying the tape backward in the state in which the output roller 220 is positioned at the release position.

In the above-described embodiment, the before-cutting rotation amount of the output roller 220 in the case where the value K of the number-of-performed-printings counter is greater than or equal to "2" is less than the before-cutting rotation amount of the output roller 220 in the case where the value K of the number-of-performed-printings counter is "1" but may be equal to or greater than the before-cutting rotation amount of the output roller 220 in the case where the value K of the number-of-performed-printings counter is "1". That is, the processings at S73 and S74 may be omitted.

In the above-described embodiment, the CPU 81 starts rotating the output roller 220 in the discharging direction at S61 before starting the printing operation at S62. In contrast, the CPU 81 may start rotating the output roller 220 in the discharging direction in the case where a leading end of the tape conveyed forward reaches the second nipping position P5 after the start of the printing operation at S62. In the case where the leading end of the tape is located upstream of the second nipping position P5 in the conveying direction, the tape does not contact the output roller 220. Since the output motor 299 is not driven in this case, it is possible to reduce power consumption of the printer 1.

In the above-described embodiment, the CPU 81 at S65 starts moving the output roller 220 to the nip position before stopping the printing operation at S66. In contrast, the CPU 81 may start moving the output roller 220 to the nip position after stopping the printing operation at S66. This configuration enables the printer 1 to nip the tape between the output roller 220 and the opposed roller 230 in a state in which the tape is reliably stopped. This reduces interference with conveyance of the tape due to contact of the output roller 220 with the tape during conveyance of the tape. Furthermore, the CPU 81 may stop rotation of the output roller 220 in the discharging direction after stopping the printing operation at S66 before starting movement of the output roller 220 to the nip position. In this case, the output roller 220 is always rotated in the discharging direction during the printing operation. This configuration reduces interference with conveyance of the tape even if the tape comes into contact with the output roller 220 during the printing operation.

In the above-described embodiment, when the discharge stopped time has elapsed (S63: YES), the CPU 81 at S64 stops rotation of the output roller 220. However, the timing when the CPU 81 stops rotation of the output roller 220 in the printing operation is not limited to this timing. For example, after stopping control of the thermal head 60, the CPU 81 may stop rotation of the output roller 220 before stopping rotation of the conveying motor 68. In the case where the printer 1 prints a plurality of characters, the CPU 81 may stop rotation of the output roller 220 upon completion of printing of a character existing a predetermined number prior to a character to be printed last. In the case where printing of a line of characters existing a predetermined number of lines prior to the last line is finished, the CPU 81 may stop rotation of the output roller 220. For example, through-down printing may be performed from the middle of the printing operation. The through-down printing is printing in which the CPU controls the thermal head 60 to perform printing on the tape while controlling the conveying motor 68 to reduce the speed of conveyance of the tape. In the case where the through-down printing is started, the CPU 81 may stop rotation of the output roller 220.

The CPU 81 conveys the die cut tape 9 forward until the mark 99 is detected at S54 in the above-described embodiment. In contrast, the CPU 81 may convey the die cut tape 9 forward by a particular amount. In this case, the CPU 81 may determine whether the detection signal is obtained from the mark detecting sensor 31, after the die cut tape 9 is conveyed forward by the particular amount. When no detection signal is output from the mark detecting sensor 31, the CPU 81 may control a speaker, not illustrated, and/or a display screen, not illustrated, to make a notification of an error, for example.

In the second leading-end positioning process in the above-described embodiment, the CPU 81 moves the output roller 220 to the release position at S41 and S42 before conveying the die cut tape 9 backward at S43 and S44. In contrast, the CPU 81 may convey the die cut tape 9 backward before moving the output roller 220 to the release position. That is, the CPU 81 may execute processings at S43, S44, S41, and S42 in this order when the second leading-end positioning process is started. It is noted that the tape to be used is not limited to the die cut tape 9, and the CPU 81 may determine whether the output roller 220 is to be moved to the release position, in accordance with the type of the tape before conveying the tape backward. For example, in the case of a tape not easily bent, the CPU 81 may determine that the output roller 220 is not to be moved to the release position, before the tape is conveyed backward.

A device such as a microcomputer, an application-specific integrated circuit (ASIC), and a field-programmable gate array (FPGA) may be used as a processor instead of the CPU 81. The main process is executed by a plurality of processors, that is, distributed processing may be performed. The nonvolatile storage medium may be any storage medium as long as the nonvolatile storage medium can store information regardless of a period in which the information is stored. The nonvolatile storage medium may not contain a volatile storage medium, e.g., a signal to be transmitted. The programs may be downloaded from a server connected to a network (that is, the programs may be transmitted as transmission signals) and stored into the flash memory 82, for example. In this case, the programs at least need to be stored in a non-transitory storage medium such as a hard disc drive provided in a server.

What is claimed is:

1. A printer, comprising:

a conveyor configured to perform a forward-conveyance operation in which the conveyor conveys a printing medium downstream in a conveying direction, the conveyor being configured to perform a backward-conveyance operation in which the conveyor conveys the printing medium upstream in the conveying direction;

a printing device disposed upstream of the conveyor in the conveying direction and configured to print an image on the printing medium conveyed by the conveyor;

a roller provided downstream of the conveyor in the conveying direction, the roller being disposed downstream of the printing device in the conveying direction;

an opposed member opposed to the roller;

a moving mechanism configured to move a moving member, which is one of the roller and the opposed member, between (i) a first position at which the printing medium is nipped between the moving member and the other of the roller and the opposed member and (ii) a second position at which the moving member is separated from the printing medium; and a controller configured to execute:

a first conveyor-backward-conveyance processing in which the controller controls the conveyor to perform the backward-conveyance operation in a state in which the moving member is located at the second position;

a first obtainment processing in which the controller obtains a print instruction for starting printing performed by the printing device;

a print processing in which the controller controls the printing device to perform the printing, when the print instruction is obtained in the first obtainment processing;

a first movement processing in which the controller controls the moving mechanism to move the moving member to the first position before the print instruction is obtained; and a second movement processing in which the controller controls the moving mechanism to move the moving member to the second position after the print instruction is obtained and before the printing is performed in the print processing, and wherein the controller is configured to, in the first conveyor-backward-conveyance processing, execute the backward-conveyance operation after the moving member is moved to the second position in the second movement processing and before the printing is performed in the print processing.

2. The printer according to claim 1, wherein the controller is configured to execute a second obtainment processing in which the controller obtains medium information indicating a type of the printing medium, and wherein the controller is configured to, in the first movement processing, control the moving mechanism to move the moving member to the first position, based on the medium information obtained in the second obtainment processing.

3. The printer according to claim 2, wherein the medium information comprises information indicating that the printing medium is a die cut tape, and wherein the controller is configured to, in the first movement processing, control the moving mechanism to move the moving member to the first position, when the medium information obtained in the second obtainment processing indicates that the printing medium is the die cut tape.

4. The printer according to claim 1, wherein the controller is configured to control the moving mechanism to move the moving member to the first position, when the printing medium is a die cut tape at a time before a print instruction for starting printing performed by the printing device is obtained.

5. The printer according to claim 4, wherein the controller is configured to:

move the moving member from the first position to the second position when the print instruction is obtained in a state in which the moving member is located at the first position;

in the first conveyor-backward-conveyance processing, control the conveyor to perform the backward-conveyance operation after the moving member is moved to the second position; and control the printing device to start the printing after the backward-conveyance operation is completed.

6. The printer according to claim 1, further comprising a first motor configured to rotate the roller, wherein the controller is configured to, when the backward-conveyance operation is to be performed in the first conveyor-backward-conveyance processing, execute a first roller driving processing in which the controller drives the first motor to rotate the roller in a direction for conveying the printing medium upstream in the conveying direction.

7. A printer comprising:

a conveyor configured to perform a forward-conveyance operation in which the conveyor conveys a printing medium downstream in a conveying direction, the conveyor being configured to perform a backward-conveyance operation in which the conveyor conveys the printing medium upstream in the conveying direction;

a printing device disposed upstream of the conveyor in the conveying direction and configured to print an image on the printing medium conveyed by the conveyor;

a roller provided downstream of the conveyor in the conveying direction, the roller being disposed downstream of the printing device in the conveying direction;

an opposed member opposed to the roller;

a moving mechanism configured to move a moving member, which is one of the roller and the opposed member, between (i) a first position at which the printing medium is nipped between the moving member and the other of the roller and the opposed member and (ii) a second position at which the moving member is separated from the printing medium; and a controller configured to execute:

a first conveyor-backward-conveyance processing in which the controller controls the conveyor to perform the backward-conveyance operation in a state in which the moving member is located at the second position;

a first obtainment processing in which the controller obtains a print instruction for starting printing performed by the printing device; and a print processing in which the controller controls the printing device to perform the printing, when the print instruction is obtained in the first obtainment processing, wherein the moving member is located at the second position when the print instruction is obtained in the first obtainment processing, and wherein the controller is configured to, when the print instruction is accepted in the first obtainment processing, control the conveyor to perform the backward-conveyance operation in the first conveyor-backward-conveyance processing before the printing is performed in the print processing.

8. A printer, comprising:

a conveyor configured to perform a forward-conveyance operation in which the conveyor conveys a printing medium downstream in a conveying direction, the conveyor being configured to perform a backward-conveyance operation in which the conveyor conveys the printing medium upstream in the conveying direction;

a printing device configured to print an image on the printing medium conveyed by the conveyor;

a roller provided downstream of the conveyor in the conveying direction;

an opposed member opposed to the roller;

an adjusting mechanism configured to adjust a nip load at which the printing medium is nipped between the roller and the opposed member, selectively to one of at least a first load and a second load that is less than the first load; and a controller configured to execute a second conveyor-backward-conveyance processing in which the controller controls the conveyor to perform the backward-conveyance operation in a state in which the nip load is the second load.

9. The printer according to claim 8, further comprising:

a second motor configured to be driven so as to rotate the roller; and a cutter configured to cut the printing medium at a position located upstream, in the conveying direction, of a position at which the printing medium is nipped between the roller and the opposed member, wherein the controller is configured to execute a second roller driving processing in which the controller rotates the roller in a direction for conveying the printing medium downstream in the conveying direction, by driving the second motor in a state in which the nip load is adjusted to the first load, after the printing medium is cut by the cutter.

10. The printer according to claim 9, wherein the controller is configured to control the cutter to cut the printing medium in the state in which the nip load is adjusted to the first load.

11. The printer according to claim 10, wherein the controller is configured to reduce the nip load from the first load to the second load after driving of the roller in the second roller driving processing is completed.

12. The printer according to claim 8, wherein the adjusting mechanism is configured to adjust the nip load selectively to one of at least the first load, a third load, and a fourth load that is less than the third load, the third load and the fourth load serving as the second load, wherein the controller is configured to, in the second conveyor-backward-conveyance processing, start the backward-conveyance operation in a state in which the nip load is the fourth load, and wherein the controller is configured to execute a load adjusting processing in which the controller changes the nip load to the third load after the backward-conveyance operation is started in the second conveyor-backward-conveyance processing and before the backward-conveyance operation is finished.

* * * * *